US009922656B2

(12) United States Patent
Peters et al.

(10) Patent No.: US 9,922,656 B2
(45) Date of Patent: Mar. 20, 2018

(54) TRANSITIONING OF AMBIENT HIGHER-ORDER AMBISONIC COEFFICIENTS

(71) Applicant: QUALCOMM Incorporated, San Diego, CA (US)

(72) Inventors: Nils Günther Peters, San Diego, CA (US); Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 158 days.

(21) Appl. No.: 14/594,533

(22) Filed: Jan. 12, 2015

(65) Prior Publication Data

US 2015/0213803 A1 Jul. 30, 2015

Related U.S. Application Data

(60) Provisional application No. 61/933,706, filed on Jan. 30, 2014, provisional application No. 61/933,714,
(Continued)

(51) Int. Cl.
*G10L 19/00* (2013.01)
*G10L 21/00* (2013.01)
(Continued)

(52) U.S. Cl.
CPC ..... *G10L 19/002* (2013.01); *G10L 19/008* (2013.01); *H04S 2420/11* (2013.01)

(58) Field of Classification Search
None
See application file for complete search history.

(56) References Cited

U.S. PATENT DOCUMENTS 4,709,340 A 11/1987 Capizzi et al.
4,972,344 A 11/1990 Stoddard et al.
(Continued)

FOREIGN PATENT DOCUMENTS

CN 102547549 A 7/2012
CN 102823277 A 12/2012
(Continued)

OTHER PUBLICATIONS

Conlin, "Interpolation of Data Points on a Sphere: Spherical Harmonics as Basis Functions," Feb. 28, 2012, 6 pp.
(Continued)

*Primary Examiner* — Kevin Ky
(74) *Attorney, Agent, or Firm* — Shumaker & Sieffert, P.A.

(57) ABSTRACT

In general, techniques are described for transitioning an ambient higher order ambisonic coefficient. A device comprising a memory and a processor may be configured to perform the techniques. The processor may obtain, from a frame of a bitstream of encoded audio data, a bit indicative of a reduced vector. The reduced vector may represent, at least in part, a spatial component of a sound field. The processor may also obtain, from the frame, a bit indicative of a transition of an ambient higher-order ambisonic coefficient. The ambient higher-order ambisonic coefficient may represent, at least in part, an ambient component of the sound field. The reduced vector may include a vector element associated with the ambient higher-order ambisonic coefficient in transition. The memory may be configured to store the frame of the bitstream.

54 Claims, 19 Drawing Sheets

Related U.S. Application Data filed on Jan. 30, 2014, provisional application No. 61/949,591, filed on Mar. 7, 2014, provisional application No. 61/949,583, filed on Mar. 7, 2014, provisional application No. 62/004,067, filed on May 28, 2014, provisional application No. 62/029,173, filed on Jul. 25, 2014.

(51) Int. Cl.
*G10L 19/002* (2013.01)
*G10L 19/008* (2013.01)

(56) References Cited

U.S. PATENT DOCUMENTS 5,012,518 A 4/1991 Liu et al.
5,263,312 A 11/1993 Walker et al.
5,363,050 A 11/1994 Guo et al.
5,633,981 A 5/1997 Davis
5,757,927 A 5/1998 Gerzon et al.
5,790,759 A 8/1998 Chen
5,819,215 A 10/1998 Dobson et al.
5,821,887 A 10/1998 Zhu
5,970,443 A 10/1999 Fujii
6,167,375 A 12/2000 Miseki et al.
6,370,502 B1 4/2002 Wu et al.
6,493,664 B1 12/2002 Udaya et al.
6,904,152 B1 6/2005 Moorer
7,271,747 B2 9/2007 Baraniuk et al.
7,447,317 B2 11/2008 Herre et al.
7,630,902 B2 12/2009 You
7,660,424 B2 2/2010 Davis et al.
7,822,601 B2 10/2010 Mehrotra et al.
7,920,709 B1 4/2011 Hickling
8,160,269 B2 4/2012 Mao et al.
8,374,358 B2 2/2013 Buck et al.
8,379,868 B2 2/2013 Goodwin et al.
8,391,500 B2 3/2013 Hannemann et al.
8,452,587 B2 5/2013 Liu et al.
8,570,291 B2 10/2013 Motomura et al.
8,781,197 B2 7/2014 Wang et al.
8,817,991 B2 8/2014 Jaillet et al.
8,908,873 B2 12/2014 Herre et al.
8,958,582 B2 2/2015 Yoo et al.
9,015,051 B2 4/2015 Pulkki
9,053,697 B2 6/2015 Park et al.
9,084,049 B2 7/2015 Fielder et al.
9,100,768 B2 8/2015 Batke et al.
9,129,597 B2 9/2015 Bayer et al.
9,230,558 B2 1/2016 Disch et al.
9,338,574 B2 5/2016 Jax et al.
9,397,771 B2 7/2016 Jax et al.
9,454,971 B2 9/2016 Kruger et al.
9,626,974 B2 4/2017 Thiergart et al.
2001/0036286 A1 11/2001 Layton et al.
2002/0044605 A1 4/2002 Nakamura
2002/0049586 A1 4/2002 Nishio et al.
2002/0169735 A1 11/2002 Kil et al.
2003/0147539 A1 8/2003 Elko et al.
2003/0179197 A1 9/2003 Sloan et al.
2003/0200063 A1 10/2003 Niu et al.
2004/0068399 A1 4/2004 Ding
2004/0131196 A1 7/2004 Malham
2004/0158461 A1 8/2004 Ramabadran et al.
2004/0247134 A1 12/2004 Miller et al.
2005/0053130 A1 3/2005 Jabri et al.
2005/0074135 A1 4/2005 Kushibe
2006/0031038 A1 2/2006 Simola et al.
2006/0045275 A1 3/2006 Daniel
2006/0045291 A1 3/2006 Smith
2006/0126852 A1 6/2006 Bruno et al.
2006/0282874 A1 12/2006 Ito et al.
2007/0009115 A1 1/2007 Reining et al.
2007/0094019 A1 4/2007 Nurminen
2007/0172071 A1 7/2007 Mehrotra et al.
2008/0004729 A1 1/2008 Hiipakka
2008/0137870 A1 6/2008 Nicol et al.
2008/0143719 A1 6/2008 Zhou et al.
2008/0205676 A1 8/2008 Merimaa et al.
2008/0298597 A1 12/2008 Turku et al.
2008/0306720 A1 12/2008 Nicol et al.
2009/0006103 A1 1/2009 Koishida et al.
2009/0092259 A1 4/2009 Jot et al.
2009/0248425 A1 10/2009 Vetterli et al.
2009/0265164 A1 10/2009 Yoon et al.
2009/0290156 A1 11/2009 Popescu et al.
2010/0085247 A1 4/2010 Venkatraman et al.
2010/0092014 A1 4/2010 Strauss et al.
2010/0169102 A1 7/2010 Samsudin
2010/0198585 A1 8/2010 Mouhssine et al.
2010/0228552 A1 9/2010 Suzuki et al.
2010/0329466 A1 12/2010 Berge
2011/0164466 A1 7/2011 Hald et al.
2011/0224975 A1 9/2011 Li et al.
2011/0224995 A1 9/2011 Kovesi et al.
2011/0249738 A1 10/2011 Suzuki et al.
2011/0249821 A1 10/2011 Jaillet et al.
2011/0249822 A1 10/2011 Jaillet et al.
2011/0261973 A1 10/2011 Nelson et al.
2011/0305344 A1 12/2011 Sole et al.
2012/0014527 A1 1/2012 Furse
2012/0093323 A1 4/2012 Lee et al.
2012/0093344 A1 4/2012 Sun et al.
2012/0128160 A1 5/2012 Kim et al.
2012/0141003 A1 6/2012 Wang et al.
2012/0155653 A1* 6/2012 Jax ..... G10L 19/008 381/22
2012/0163622 A1 6/2012 Karthik et al.
2012/0174737 A1 7/2012 Risan
2012/0177234 A1 7/2012 Rank et al.
2012/0221344 A1 8/2012 Yamanashi et al.
2012/0232910 A1 9/2012 Dressler et al.
2012/0243692 A1 9/2012 Ramamoorthy
2012/0257579 A1 10/2012 Li et al.
2012/0259442 A1 10/2012 Jin et al.
2012/0271629 A1* 10/2012 Sung ..... G10L 19/06 704/219
2012/0314878 A1 12/2012 Daniel et al.
2013/0028427 A1 1/2013 Yamamoto et al.
2013/0041658 A1 2/2013 Bradley et al.
2013/0064375 A1 3/2013 Atkins et al.
2013/0148812 A1 6/2013 Corteel et al.
2013/0216070 A1 8/2013 Keiler et al.
2013/0223658 A1 8/2013 Betlehem et al.
2013/0320804 A1 12/2013 Symko et al.
2014/0016784 A1 1/2014 Sen et al.
2014/0016786 A1 1/2014 Sen
2014/0016802 A1 1/2014 Sen et al.
2014/0023197 A1 1/2014 Xiang et al.
2014/0025386 A1 1/2014 Xiang et al.
2014/0029758 A1 1/2014 Nakadai et al.
2014/0133660 A1 5/2014 Jax et al.
2014/0219455 A1 8/2014 Peters et al.
2014/0226823 A1 8/2014 Sen et al.
2014/0233762 A1 8/2014 Vilkamo et al.
2014/0233917 A1 8/2014 Xiang
2014/0247946 A1 9/2014 Sen et al.
2014/0270245 A1 9/2014 Elko et al.
2014/0286493 A1 9/2014 Kordon et al.
2014/0307894 A1 10/2014 Kordon et al.
2014/0355766 A1 12/2014 Morrell et al.
2014/0355769 A1 12/2014 Peters et al.
2014/0355770 A1 12/2014 Peters
2014/0355771 A1 12/2014 Peters
2014/0358266 A1 12/2014 Peters
2014/0358557 A1 12/2014 Sen et al.
2014/0358558 A1 12/2014 Sen et al.
2014/0358559 A1 12/2014 Sen et al.
2014/0358560 A1 12/2014 Sen et al.
2014/0358561 A1 12/2014 Sen et al.
2014/0358562 A1 12/2014 Sen et al.
2014/0358563 A1 12/2014 Sen et al.
2014/0358564 A1 12/2014 Sen et al.
2014/0358565 A1 12/2014 Peters et al.

(56) References Cited

U.S. PATENT DOCUMENTS

| | | | |
|---|---|---|---|
| 2014/0358567 | A1 | 12/2014 | Koppens et al. |
| 2015/0098572 | A1 | 4/2015 | Krueger et al. |
| 2015/0127354 | A1 | 5/2015 | Peters et al. |
| 2015/0154965 | A1 | 6/2015 | Wuebbolt et al. |
| 2015/0154971 | A1 | 6/2015 | Boehm et al. |
| 2015/0163615 | A1 | 6/2015 | Boehm et al. |
| 2015/0213802 | A1 | 7/2015 | Bae et al. |
| 2015/0213805 | A1 | 7/2015 | Peters et al. |
| 2015/0213809 | A1 | 7/2015 | Peters et al. |
| 2015/0264483 | A1 | 9/2015 | Morrell et al. |
| 2015/0264484 | A1 | 9/2015 | Peters et al. |
| 2015/0287418 | A1 | 10/2015 | Vasilache et al. |
| 2015/0332679 | A1 | 11/2015 | Kruger et al. |
| 2015/0332690 | A1 | 11/2015 | Kim |
| 2015/0332691 | A1 | 11/2015 | Kim |
| 2015/0332692 | A1 | 11/2015 | Kim |
| 2015/0341736 | A1 | 11/2015 | Peters et al. |
| 2015/0358631 | A1 | 12/2015 | Zhang et al. |
| 2015/0371633 | A1 | 12/2015 | Chelba |
| 2015/0380002 | A1 | 12/2015 | Uhle et al. |
| 2016/0080886 | A1* | 3/2016 | De Bruijn ..... H04S 7/302 381/17 |
| 2016/0088415 | A1* | 3/2016 | Krueger ..... G10L 19/008 381/22 |
| 2016/0093308 | A1 | 3/2016 | Kim |
| 2016/0093311 | A1 | 3/2016 | Kim |
| 2016/0155448 | A1 | 6/2016 | Purnhagen et al. |
| 2016/0174008 | A1 | 6/2016 | Boehm |
| 2017/0032798 | A1 | 2/2017 | Peters |

FOREIGN PATENT DOCUMENTS

| | | | |
|---|---|---|---|
| CN | 104285390 | A | 1/2015 |
| EP | 2094032 | A1 | 8/2009 |
| EP | 2234104 | A1 | 9/2010 |
| EP | 2450880 | A1 | 5/2012 |
| EP | 2469741 | A1 | 6/2012 |
| EP | 2469742 | A2 | 6/2012 |
| EP | 2665208 | A1 | 11/2013 |
| EP | 2765791 | A1 | 8/2014 |
| EP | 2954700 | A1 | 12/2015 |
| JP | 2012133366 | A | 7/2012 |
| JP | 2014041362 | A | 3/2014 |
| KR | 20120070521 | A | 6/2012 |
| KR | 20130102015 | A | 9/2013 |
| KR | 20140000240 | A | 1/2014 |
| TW | 201514455 | A | 4/2015 |
| WO | 2009046223 | A2 | 4/2009 |
| WO | 2009144953 | A | 12/2009 |
| WO | 2011117399 | A1 | 9/2011 |
| WO | 2012059385 | A1 | 5/2012 |
| WO | 2012061149 | A1 | 5/2012 |
| WO | 2013000740 | A1 | 1/2013 |
| WO | 2013171083 | A1 | 11/2013 |
| WO | 2014013070 | A1 | 1/2014 |
| WO | 2014090660 | A1 | 6/2014 |
| WO | 2014122287 | A1 | 8/2014 |
| WO | 2014177455 | A1 | 11/2014 |
| WO | 2014194099 | A1 | 12/2014 |
| WO | 2014195190 | A1 | 12/2014 |
| WO | 2015007889 | A2 | 1/2015 |

OTHER PUBLICATIONS

Stohl, et al., "An Intercomparison of Results from Three Trajectory Models," Meteorological Applications, Jun. 2001, pp. 127-135.

Daniel, et al., "Multichannel Audio Coding Based on Minimum Audible Angles", Proceedings of 40th International Conference: Spatial Audio: Sense the Sound of Space, Jan. 1, 2010 , XP055009518, 10 pp.

Masgrau, et al., "Predictive SVD-Transform Coding of Speech with Adaptive Vector Quantization," Apr. 1991, IEEE, pp. 3681-3684.

Nelson et al., "Spherical Harmonics, Singular-Value Decomposition and the Head-Related Transfer Function," Aug. 29, 2000, ISVR University of Southampton, pp. 607-637.

Rockway, et al., "Interpolating Spherical Harmonics for Computing Antenna Patterns," Systems Center Pacific, Technical Report 1999, Jul. 2011, 40 pp.

Ruffini, et al., "Spherical Harmonics Interpolation, Computation of Laplacians and Gauge Theory," Starlab Research Knowledge, Oct. 25, 2001, 16 pp.

Nishimura, "Audio Information Hiding Based on Spatial Masking", Intelligent Information Hidinga ND Multimedia Signal Processing (IIH-MSP), 2010 Sixth International Conference on, IEEE, Piscataway, NJ, USA, Oct. 15, 2010, pp. 522-525, XP031801765, ISBN: 978-1-4244-8378-5.

Sayood, et al., "Application to Image Compression—JPEG," Introduction to Data Compression, Third Edition, Dec. 15, 2005, Chapter 13.6, pp. 410-416.

Solvang A., et al., "Quantization of Higher Order Ambisoncs Wave Fields," In the 124th AES Conv, May 17-20, 2008, pp. 1-9.

Response to Second Written Opinion dated Feb. 2, 2016, from International Application No. PCT/US2015/013267, filed on Mar. 31, 2016, 33 pp.

Second Written Opinion from International Application No. PCT/US2015/013267, dated Feb. 1, 2016, 10 pp.

Response to Written Opinion dated May 7, 2015, from International Application No. PCT/US2015/013267, filed on Nov. 23, 2015, 32 pp.

International Preliminary Report on Patentability from International Application No. PCT/US2015/013267, dated May 23, 2016, 12 pp.

Audio, "Call for Proposals for 3D Audio," International Organisation for Standardisation Drganisation Internationale De Normalisation ISO/IEC JTC1/SC29/WG11 Coding of Moving Pictures and Audio, ISO/IEC JTC1/SC29/WG11/N13411, Geneva, CH, Jan. 2013, 20 pp.

Audio-Subgroup: "WD1-HOA Text of MPEG-H 3D Audio," MPEG Meeting; Jan. 2014; San Jose, CA; (Motion Picture Expert Group or ISO/IEC JTC1/SC29/WG11), No. N14264, XP030021001, 84 pp.

Boehm et al., "Scalable Decoding Mode for MPEG-H 3D Audio HOA," MPEG Meeting; Mar. 2014; Valencia, ES; (Motion Picture Expert Group or ISO/IEC JTC1/SC29/WG11), No. M33195, XP030061647, 12 pp.

Boehm et al., "Detailed Technical Description of 3D Audio Phase 2 Reference Model 0 for HOA technologies," MPEG Meeting; Oct. 2014; Strasbourg, FR; (Motion Picture Expert Group or ISO/IEC JTC1/SC29/WG11), No. M35057, XP030063429, 130 pp.

Boehm et al., "HOA decoder—changes and proposed modification," Technicolor, MPEG Meeting; Mar. 2014; Valencia, ES; (Motion Picture Expert Group or ISO/IEC JTC1/SC29/WG11), No. M33196, XP030061648, 16 pp.

Wabnitz et al., "Upscaling ambisonic sound scenes using compressed sensing techniques," Applications of Signal Processing to Audio and Acoustics (WASPAA), 2011 IEEE Workshop on, IEEE, Oct. 16-19, 2011, XP032011510, 4 pp.

Wabnitz et al., "Time domain reconstruction of spatial sound fields using compressed sensing," Acoustics, Speech and Signal Processing (ICASSP), 2011 IEEE International Conference on, IEEE, May 22, 2011, pp. 465-468,XP032000775.

Wabnitz, et al., "A frequency-domain algorithm to upscale ambisonic sound scenes," 2012 IEEE International Conference on Acoustics, Speech and Signal Processing (ICASSP 2012) : Kyoto, Japan, Mar. 25-30, 2012; [Proceedings], IEEE, Piscataway, NJ, pp. 385-388, XP032227141.

Daniel et al., "Spatial Auditory Blurring and Applications to Multichannel Audio Coding," Jun. 23, 2011, XP055104301, Retrieved from the Internet: URL:http://tel.archives-ouvertes.fr/tel-00623670/en/Chapter 5. "Multichannel audio coding based on spatial blurring," pp. 121-139.

Daniel et al., "Ambisonics Encoding of Other Audio Formats for Multiple Listening Conditions," Audio Engineering Society Convention 105, Sep. 1998, San Francisco, CA, Paper No. 4795.

Davis et al., "A Simple and Efficient Method for Real-Time Computation and Transformation of Spherical Harmonic-Based Sound Fields," Proceedings of the AES 133rd Convention, Oct. 2012, 10 pp.

(56) References Cited

OTHER PUBLICATIONS

"Information Technology—High efficiency coding and media delivery in heterogeneous environments—Part 3: 3D audio," DVB Organization: ISO-IEC_23008-3_(E)_(DIS of 3DA)_v30.docx, DVB, Geneva-Switzerland, Jul. 25, 2014, XP017845569, 431 pp.
Zotter et al., "Comparison of energy-preserving and all-round Ambisonic decoders," Mar. 2013, 4 pp.
Hellerud et al., "Lossless Compression of Spherical Microphone Array Recordings," AES Convention 126, May 7-10, 2009, Munich, DE, AES, XP040508950, Section 2, Higher Order Ambisonics; 9 pp.
Gauthier et al., "Beamforming regularization, scaling matrices and inverse problems for sound field extrapolation and characterization: Part I Theory," 2011, in Audio Engineering Society 131st Convention, New York, USA, Oct. 20-23, 2011, 32 pp.
Gauthier et al., "Derivation of Ambisonics Signals and Plane Wave Description of Measured Sound Field Using Irregular Microphone Arrays and Inverse Problem Theory," 2011, In Ambisonics Symposium 2011, Lexington, KY, Jun. 2-3, 2011, 17 pp.
Gerzon, "Ambisonics in Multichannel Broadcasting and Video," Journal of the Audio Engineering Society, Nov. 1985, vol. 33(11), pp. 859-871.
Hagai et al., "Acoustic centering of sources measured by surrounding spherical microphone arrays," Jul. 25, 2011, In The Journal of the Acoustical Society of America, vol. 130, No. 4, pp. 2003-2015.
Hellerud et al., "Encoding higher order ambisonics with AAC," Audio Engineering Society—124th Audio Engineering Society Convention 2008, Amsterdam, NL, XP040508582, May 17-20, 2008, 9 pp.
Hellerud et al., "Spatial redundancy in Higher Order Ambisonics and its use for Low Delay Lossless Compression," Acoustics, Speech and Signal Processing, 2009, ICASSP 2009, IEEE International Conference on, IEEE, Apr. 19, 2009, XP031459218, pp. 269-272.
Herre et al., "MPEG-H 30 Audio—The New Standard for Coding of Immersive Spatial Audio," IEEE Journal of Selected Topics in Signal Processing, vol. 9, No. 5, Aug. 2015, 10 pp.
Information technology—MPEG audio technologies—Part 3: Unified speech and audio coding, ISO/IEC JTC 1/SC 29/WG 11, Sep. 20, 2011, 291 pp.
International Search Report and Written Opinion from International Application No. PCT/US2015/013267, dated May 7, 2015, 16 pp.
Malham, "Higher order ambisonic systems for the spatialization of sound," in Proceedings of the International computer Music Conference, Oct. 1999, Beijing, China, pp. 484-487.
Menzies, "Nearfield synthesis of complex sources with high-order ambisonics, and binaural rendering," Proceedings of the 13th International Conference on Auditory Display, Montreal, Canada, Jun. 26-29, 2007, 8 pp.
Moreau et al., "3D Sound Field Recording with Higher Order Ambisonics—Objective Measurements and Validation of Spherical Microphone," May 20-23, 2006, Audio Engineering Society Convention Paper 6857, 24 pp.
Painter et al., Perceptual Coding of Digital Audio, Proceedings of the IEEE, vol. 88, No. 4, Apr. 2000, pp. 451-513.
Poletti, "Three-Dimensional Surround Sound Systems Based on Spherical Harmonics," The Journal of the Audio Engineering Society, Nov. 2005, pp. 1004-1025, vol. 53 (11).
Poletti, "Unified Description of Ambisonics Using Real and Complex Spherical Harmonics," Ambisonics Symposium Jun. 25-27, 2009, 10 pp.
Pulkki, "Spatial Sound Reproduction with Directional Audio Coding," Journal of the Audio Engineering Society, Jun. 2007, vol. 55 (6), pp. 503-516.
Rafaely, "Spatial alignment of acoustic sources based on spherical harmonics radiation analysis," 2010, in Communications, Control and Signal Processing (ISCCSP), 2010 4th International Symposium on Communications, Limassol, Cyprus, Mar. 3-5, 2010, 5 pp.
Davis et al., "A Simple and Efficient Method for Real-Time Computation and Transformation of Spherical Harmonic-Based Sound Fields," AES Convention 133, 20121001, AES, San Francisco, CA, Oct. 26-29, 2012, XP040574807, 10 pp.
Sen et al., "Differences and similarities in formats for scene based audio," ISO/IEC JTC1/SC29/WG11 MPEG2012/M26704, Oct. 2012, Shanghai, China, 7 pp.
Sen et al., "RM1-HOA Working Draft Text," MPEG Meeting; Jan. 2014; San Jose, CA; (Motion Picture Expert Group or ISO/IEC JTC1/SC29/WG11), No. M31827, XP030060280, 83 pp.
"Information technology—High efficiency coding and media delivery in heterogeneous environments—Part 3: 3D Audio," ISO/IEC JTC 1/SC 29N, Apr. 4, 2014, 337 pp.
"Information technology—High efficiency coding and media delivery in heterogeneous environments—Part 3: 3D Audio," ISO/IEC JTC 1/SC 29N, Jul. 25, 2005, 311 pp.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.
Mathews V.J., et al., "Multiplication-Free Vector Quantization Using L1 Distortion Measureand ITS Variants", Multidimensional Signal Processing, Audio and Electroacoustics, Glasgow, May 23-26, 1989, [International Conference on Acoustics, Speech & Signal Processing, ICASSP], New York, IEEE, US, May 23, 1989 (May 23, 1989), vol. 3, pp. 1747-1750, XP000089211.
Bosi et al, "ISO/IEC MPEG-2 Advanced Audio Coding," In 101st AES Convention, Los Angeles, Nov. 1996, 43 pp.
Geiser, et al., "Steganographic Packet Loss Concealment for Wireless VoIP," ITG Conference on Voice Communication (SprachKommunikation), Oct. 8, 2008, 4 pp.
Qinghua et al., "Interpolation of Head-Related Transfer Functions Using Spherical Fourier Expansion," Journal of Electronics (China), Jul. 2009, vol. 26, Issue 4, pp. 571-576.
"Information technology—High efficiency coding and media delivery in heterogeneous environments—Part 3: 3D audio," ISO/IEC JTC 1/SC 29 N ISO/IEC CD 23008-3, Apr. 4, 2014, XP055206371, 337 pp.
Johnston et al, "AT&T Perceptual Audio Coding (PAC)," In Collected Papers on Digital Audio Bit-Rate Reduction pp. 73-82, Feb. 13, 1996.
Lincoln: "An Experimental High Fidelity Perceptual Audio Coder", In Project in MUS420 Win97, Mar. 1998, 19 pp.
"Information technology—High efficiency coding and media delivery in heterogeneous environments—Part 3: 3D Audio," ISO/IEC JTC 1/SC 29 ISO/IEC DIS 23008-3, Jul. 25, 2014, 433 pp.
U.S. Appl. No. 15/247,244, filed by Nils Günther Peters, on Aug. 25, 2016.
U.S. Appl. No. 15/247,364, filed by Nils Günther Peters, on Aug. 25, 2016.
U.S. Appl. No. 15/290,181, filed by Nils Günther Peters, on Oct. 11, 2016.
U.S. Appl. No. 15/290,206, filed by Nils Günther Peters, on Oct. 11, 2016.
U.S. Appl. No. 15/290,214, filed by Nils Günther Peters, on Oct. 11, 2016.
Epain N., et al., "Blind Source Separation Using Independent Component Analysis in the Spherical Harmonic Domain." Proceedings of the 2nd International Symposium on Ambisonics and Spherical Acoustics, Paris, May 6-7, 2010, 6 pp.
Epain N., et al., "Objective Evaluation of a Three-Dimensional Sound Field Reproduction System", Proceedings of be 20th International Congress on Acoustics, Sydney, Australia, Aug. 23-27, 2010, pp. 1-7.
Hollerweger, "An Introduction to Higher Order Ambisonic," Oct. 2008, Accessed online [Jul. 8, 2013], 13 pp.
Malham D.G, "Higher Order Ambisonic Systems for the Spatialisation of Sound," Proceedings of the International Computer Music Conference, Dec. 31, 1999, pp. 484-487.
ISO/IEC 23009-1: "Information technology—Dynamic adaptive streaming over HTTP (DASH)—Part 1: Media presentation description and segment formats," Technologies de l' information—Diffusion en flux adaptatif dynamique sur HTTP (DASH)—Part 1: Description of the presentation and delivery of media formats,

(56) References Cited

OTHER PUBLICATIONS

ISO/IEC 23009-1 International Standard, First Edition, Apr. 1, 2012 (Apr. 1, 2012), pp. I-VI, 1-126, XP002712145, paragraph A.7-A.9 paragraph [OA.4].
Neuendorf M., et al., "Contribution to MPEG-H 3D Audio Version 1 ," ISO/IEC JTC1/SC29/WG11 MPEG2013/M31360, Oct. 2013, 34 pp.
Paila T., et al., "FLUTE—File Delivery over Unidirectional Transport; rfc6726.txt," Internet Engineering Task Force, IETF; Standard, Internet Society (ISOC) 4, Rue Des Falaises CH—1205 Geneva, Switzerland, Nov. 6, 2012 (Nov. 6, 2012), pp. 1-46, XP015086468, [retrieved on Nov. 6, 2012].
Pomberger H., et al., "Ambisonic Panning With Constant Energy Constraint," 8th German Annual Conference on Acoustics, in: DAGA 2012, pp. 1-2.
Wuebbolt O., et al., "Thoughts on MPEG-H 3D Audio Integration," Research & Innovation Hannover, Technicolor, Feb. 3, 2014, 9 pp.
Noisternig, et al., "A 3D Real Time Rendering Engine for Binaural Sound Reproduction", Proceedings of the 2003 International Conference on Auditory Display, Boston, MA, USA, Jul. 6-9, 2003, pp. 107-110.
Zotter, et al., "Energy-Preserving Ambisonic Decoding," Acta Acustica United With Acustica, European Acoustics Association, Stuttgart : Hirzel, vol. 98, No. 1, Jan. 2012, pp. 37-47.

* cited by examiner

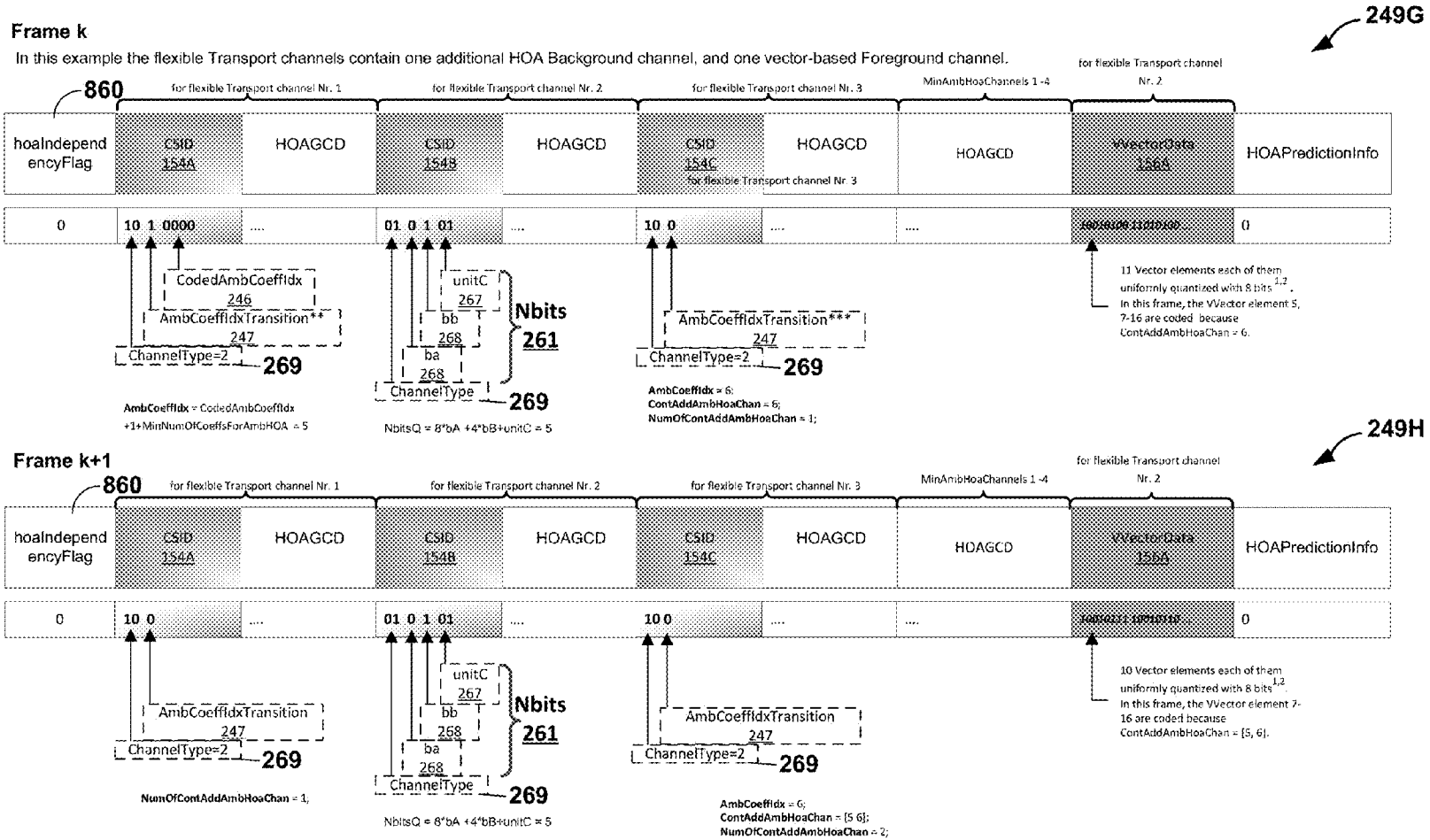

[1] Number and Indices of coded VectorData elements specified by the parameter CodedVecLength, MinNumOfCoeffsForAmbHOA, NumOfHoaCoeff
[2] Coding scheme signaled by NbitsQ = 5 in the ChannelSideInfo for flexible Transport channel Nr. 2
** For the flexible Transport channel Nr.1 the decoder's internal state is here assumed to be AmbCoeffIdxTransitionState = 2. Hence the CodedAmbCoeffIdx bitfield is signaled.
*** The flexible Transport Channel Nr. 3 has been defined in a previous frame to carry the additional HOA coefficient 6. Hence the CodedAmbCoeffIdx bitfield is not signaled.

FIG. 7G

TRANSITIONING OF AMBIENT HIGHER-ORDER AMBISONIC COEFFICIENTS

This application claims the benefit of the following U.S. Provisional applications:

U.S. Provisional Application No. 61/933,706, filed Jan. 30, 2014, entitled "COMPRESSION OF DECOMPOSED REPRESENTATIONS OF A SOUND FIELD;"

U.S. Provisional Application No. 61/933,714, filed Jan. 30, 2014, entitled "COMPRESSION OF DECOMPOSED REPRESENTATIONS OF A SOUND FIELD;"

U.S. Provisional Application No. 61/949,591, filed Mar. 7, 2014, entitled "IMMEDIATE PLAY-OUT FRAME FOR SPHERICAL HARMONIC COEFFICIENTS;"

U.S. Provisional Application No. 61/949,583, filed Mar. 7, 2014, entitled "FADE-IN/FADE-OUT OF DECOMPOSED REPRESENTATIONS OF A SOUND FIELD;"

U.S. Provisional Application No. 62/004,067, filed May 28, 2014, entitled "IMMEDIATE PLAY-OUT FRAME FOR SPHERICAL HARMONIC COEFFICIENTS AND FADE-IN/FADE-OUT OF DECOMPOSED REPRESENTATIONS OF A SOUND FIELD;" and U.S. Provisional Application No. 62/029,173, filed Jul. 25, 2014, entitled "IMMEDIATE PLAY-OUT FRAME FOR SPHERICAL HARMONIC COEFFICIENTS AND FADE-IN/FADE-OUT OF DECOMPOSED REPRESENTATIONS OF A SOUND FIELD,"

each of foregoing listed U.S. Provisional applications is incorporated by reference as if set forth in their respective entirety herein.

TECHNICAL FIELD

This disclosure relates to audio data and, more specifically, compression of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for compression of higher-order ambisonics audio data. Higher-order ambisonics audio data may comprise at least one spherical harmonic coefficient corresponding to a spherical harmonic basis function having an order greater than one.

In one aspect, a method of producing a bitstream of encoded audio data comprises determining, in an encoder, when an ambient higher-order ambisonic coefficient is in transition during a frame, the ambient higher-order ambisonic coefficient representative, at least in part, of an ambient component of a sound field. The method further comprises identifying, in the encoder, an element of a vector that is associated with the ambient higher-order ambisonic coefficient in transition, the vector representative, at least in part, of a spatial component of the sound field. The method also comprises generating, in the encoder, and based on the vector, a reduced vector to include the identified element of the vector for the frame, and specifying, in the encoder, the reduced vector and an indication of the transition of the ambient higher-order ambisonic coefficient during the frame, in the bitstream.

In another aspect, an audio encoding device is configured to produce a bitstream of encoded audio data. The audio encoding device comprises a memory configured to store a bitstream of encoded audio data, and one or more processors configured to determine when an ambient higher-order ambisonic coefficient is in transition during a frame. The ambient higher-order ambisonic coefficient being representative, at least in part, of an ambient component of a sound field. The one or more processors are further configured to identify an element of a vector that is associated with the ambient higher-order ambisonic coefficient in transition. The vector being representative, at least in part, of a spatial component of the sound field. The one or more processors also configured to generate, based on the vector, a reduced vector to include the identified element of the vector for the frame, and specify the reduced vector and an indication of the transition of the ambient higher-order ambisonic coefficient during the frame, in the bitstream.

In another aspect, an audio encoding device is configured to produce a bitstream of encoded audio data. The audio encoding device comprises means for determining when an ambient higher-order ambisonic coefficient is in transition during a frame of a bitstream representative of the encoded audio data, the ambient higher-order ambisonic coefficient representative, at least in part, of an ambient component of a sound field. The audio coding device further comprising means for identifying an element of a vector that is associated with the ambient higher-order ambisonic coefficient in transition, the vector representative, at least in part, of a spatial component of the sound field. The audio coding device also comprising means for generating, based on the vector, a reduced vector to include the identified element of the vector for the frame, and means for specifying the reduced vector and an indication of the transition of the ambient higher-order ambisonic coefficient during the frame, in the bitstream.

In another aspect, a non-transitory computer-readable storage medium has stored thereon instructions that when executed cause one or more processors of an audio encoding device to determine when an ambient higher-order ambisonic coefficient is in transition during a frame, the ambient higher-order ambisonic coefficient representative, at least in part, of an ambient component of a sound field. The instruction may further cause the one or more processors to identify an element of a vector that is associated with the ambient higher-order ambisonic coefficient in transition, the vector representative, at least in part, of a spatial component of the sound field. The instruction may also cause the one or more processors to generate, based on the vector, a reduced vector to include the identified element of the vector for the frame, and specify the reduced vector and an indication of the transition of the ambient higher-order ambisonic coefficient during the frame.

In another aspect, a method of decoding a bitstream of encoded audio data comprises obtaining, in a decoder and from a frame of the bitstream, a reduced vector representative, at least in part, of a spatial component of a sound field.

The method also comprises obtaining, in the decoder and from the frame, an indication of a transition of an ambient higher-order ambisonic coefficient representative, at least in part, of an ambient component of a sound field. The reduced vector includes a vector element associated with the ambient higher-order ambisonic coefficient in transition.

In another aspect, an audio decoding device is configured to decode a bitstream of encoded audio data. The audio decoding device comprises a memory configured to store a frame of a bitstream of encoded audio data, and one or more processors configured to obtain, from the frame, a reduced vector representative, at least in part, of a spatial component of a sound field. The one or more processors may further be configured to obtain, from the frame, an indication of a transition of an ambient higher-order ambisonic coefficient representative, at least in part, of an ambient component of a sound field. The reduced vector includes a vector element associated with the ambient higher-order ambisonic coefficient in transition.

In another aspect, an audio decoding device is configured to decode a bitstream of encoded audio data. The audio decoding device comprises means for storing a frame of a bitstream of encoded audio data, and means for obtaining, from the frame, a reduced vector representative, at least in part, of a spatial component of a sound field. The audio decoding device further comprises means for obtaining, from the frame, an indication of a transition of an ambient higher-order ambisonic coefficient representative, at least in part, of an ambient component of a sound field. The reduced vector includes a vector element associated with the ambient higher-order ambisonic coefficient in transition.

In another aspect, a non-transitory computer-readable storage medium has stored thereon instructions that when executed cause one or more processors of an audio decoding device to obtain, from a frame of bitstream of encoded audio data, a reduced vector, representative, at least in part, of a spatial component of a sound field. The instructions further causing the one or more processors to obtain, from the frame, an indication of a transition of an ambient higher-order ambisonic coefficient, representative, at least in part, of an ambient component of a sound field. The reduced vector includes a vector element associated with the ambient higher-order ambisonic coefficient in transition.

The details of one or more aspects of the techniques are set forth in the accompanying drawings and the description below. Other features, objects, and advantages of these techniques will be apparent from the description and drawings, and from the claims.

BRIEF DESCRIPTION OF DRAWINGS

FIG. 7A-7J are diagrams illustrating a portion of the bitstream or side channel information that may specify the compressed spatial components in more detail.

DETAILED DESCRIPTION

Figure 1:
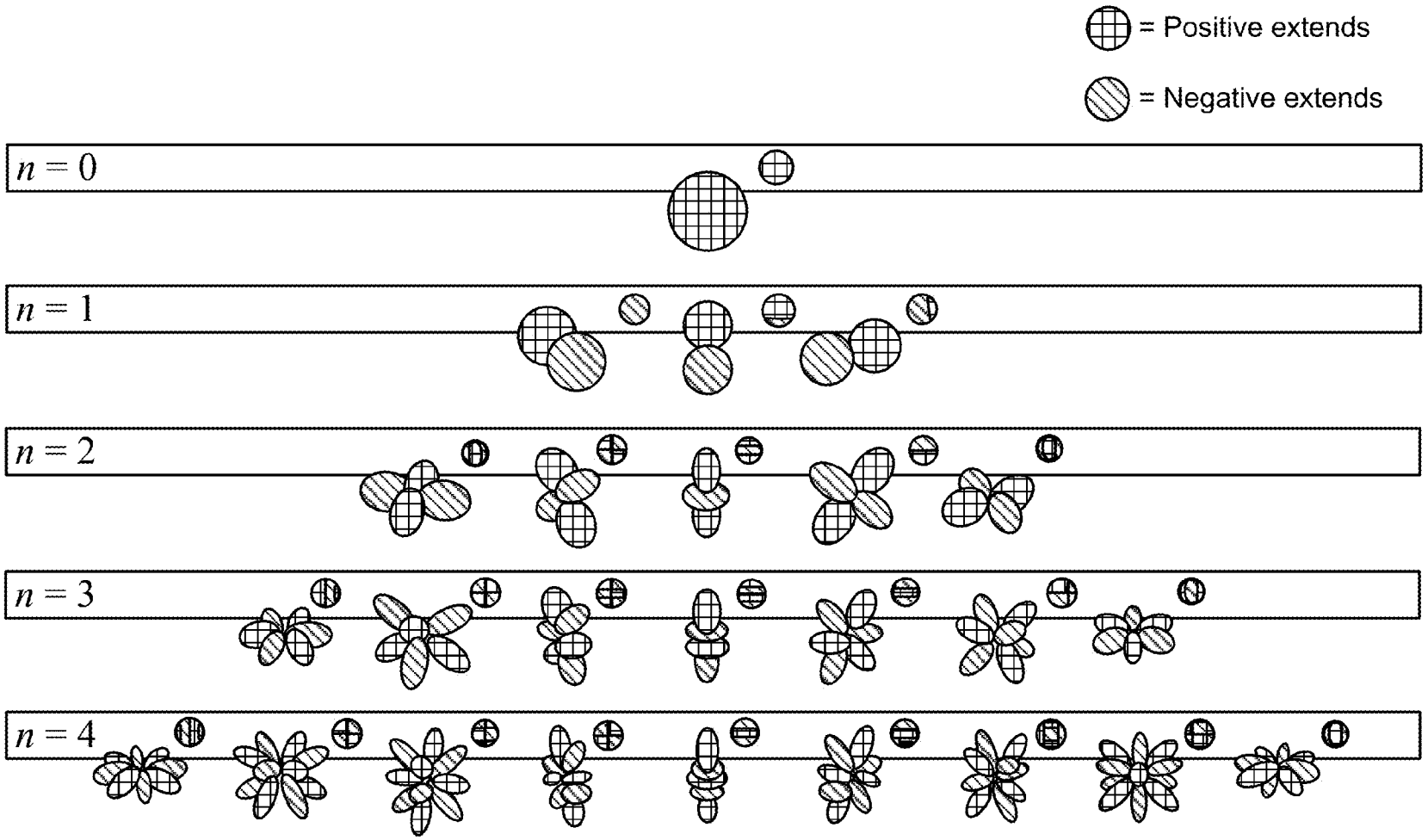
FIG. 1 is a diagram illustrating spherical harmonic basis functions of various orders and sub-orders.

The evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). The future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r,\theta_r,\varphi_r\}$ of the soundfield, at time t, can be represented uniquely by the SHC, $A_n^m(k)$. Here, $k=\omega/c$, c is the speed of sound (~343 m/s), $\{r_r,\theta_r,\varphi_r\}$ is a point of reference (or observation point), $j_n(\bullet)$ is the spherical Bessel function of order n, and $Y_n^m(\theta_r,\varphi_r)$ are the spherical harmonic basis functions of order n and suborder m. It can be recognized that the term in square brackets is a frequency-domain representation of the signal (i.e., $S(\omega,r_r,\theta_r,\varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^{(2)}(\bullet)$ is the spherical Hankel function (of the second kind) of order n, and $\{r_s,\theta_s,\varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r,\theta_r,\varphi_r\}$. The remaining figures are described below in the context of object-based and SHC-based audio coding.

Figure 2:
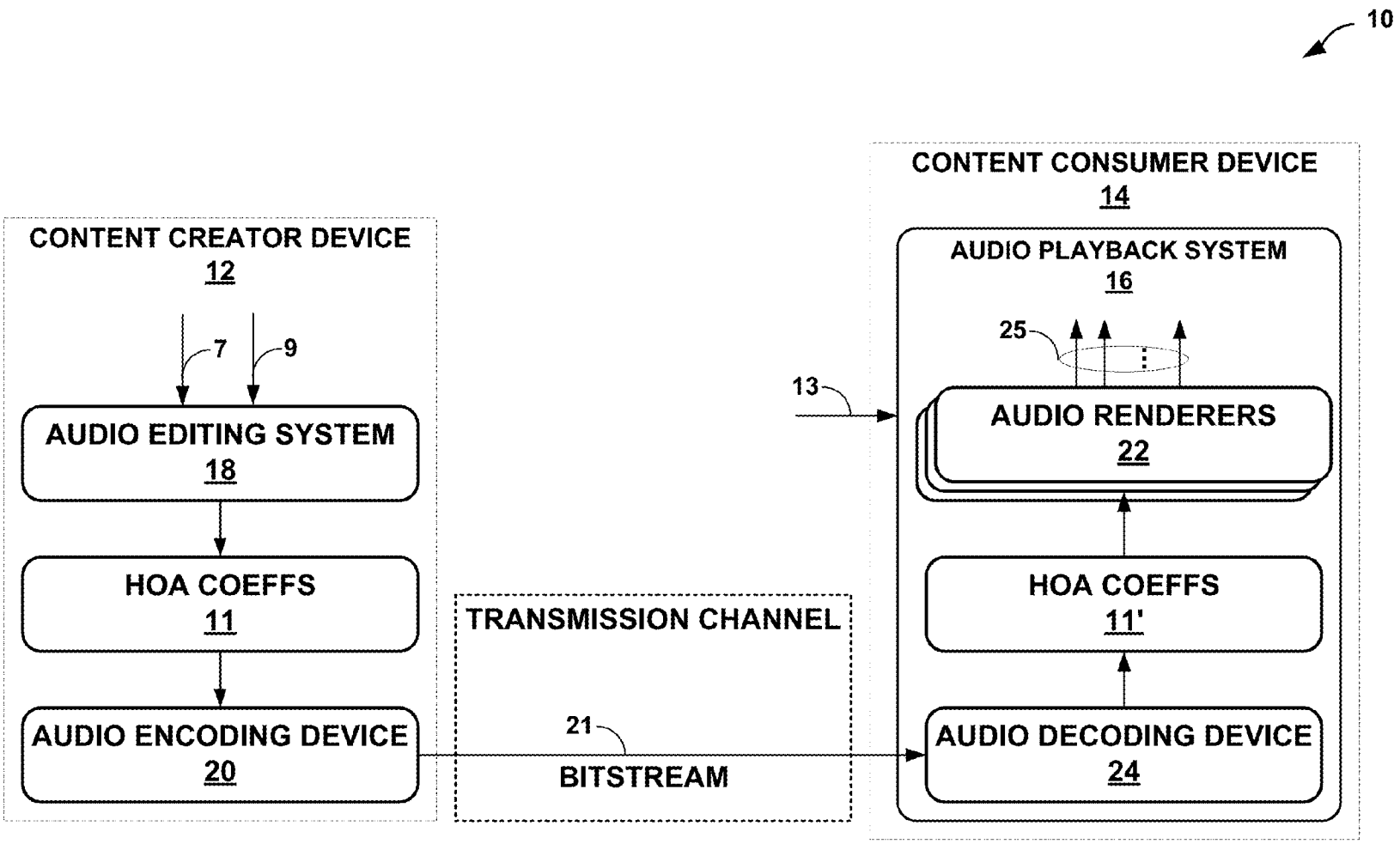
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The content creator device 12 may be operated by a movie studio or other entity that may generate multi-channel audio content for consumption by operators of a content consumers, such as the content consumer device 14. In some examples, the content creator device 12 may be operated by an individual user who would like to compress HOA coefficients 11. Often, the content creator generates audio content in conjunction with video content. The content consumer device 14 may be operated by an individual. The content consumer device 14 may include an audio playback system 16, which may refer to any form of audio playback system capable of rendering SHC for play back as multi-channel audio content.

The content creator device 12 includes an audio editing system 18. The content creator device 12 obtain live recordings 7 in various formats (including directly as HOA coefficients) and audio objects 9, which the content creator device 12 may edit using audio editing system 18. The content creator may, during the editing process, render HOA coefficients 11 from audio objects 9, listening to the rendered speaker feeds in an attempt to identify various aspects of the soundfield that require further editing. The content creator device 12 may then edit HOA coefficients 11 (potentially indirectly through manipulation of different ones of the audio objects 9 from which the source HOA coefficients may be derived in the manner described above). The content creator device 12 may employ the audio editing system 18 to generate the HOA coefficients 11. The audio editing system 18 represents any system capable of editing audio data and outputting the audio data as one or more source spherical harmonic coefficients.

When the editing process is complete, the content creator device 12 may generate a bitstream 21 based on the HOA coefficients 11. That is, the content creator device 12 includes an audio encoding device 20 that represents a device configured to encode or otherwise compress HOA coefficients 11 in accordance with various aspects of the techniques described in this disclosure to generate the bitstream 21. The audio encoding device 20 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

Although described in more detail below, the audio encoding device 20 may be configured to encode the HOA coefficients 11 based on a vector-based synthesis or a directional-based synthesis. To determine whether to perform the vector-based decomposition methodology or a directional-based decomposition methodology, the audio encoding device 20 may determine, based at least in part on the HOA coefficients 11, whether the HOA coefficients 11 were generated via a natural recording of a soundfield (e.g., live recording 7) or produced artificially (i.e., synthetically) from, as one example, audio objects 9, such as a PCM object. When the HOA coefficients 11 were generated from the audio objects 9, the audio encoding device 20 may encode the HOA coefficients 11 using the directional-based decomposition methodology. When the HOA coefficients 11 were captured live using, for example, an eigenmike, the audio encoding device 20 may encode the HOA coefficients 11 based on the vector-based decomposition methodology. The above distinction represents one example of where vector-based or directional-based decomposition methodology may be deployed. There may be other cases where either or both may be useful for natural recordings, artificially generated content or a mixture of the two (hybrid content). Furthermore, it is also possible to use both methodologies simultaneously for coding a single time-frame of HOA coefficients.

Assuming for purposes of illustration that the audio encoding device 20 determines that the HOA coefficients 11 were captured live or otherwise represent live recordings, such as the live recording 7, the audio encoding device 20 may be configured to encode the HOA coefficients 11 using a vector-based decomposition methodology involving application of a linear invertible transform (LIT). One example of the linear invertible transform is referred to as a "singular value decomposition" (or "SVD"). In this example, the audio encoding device 20 may apply SVD to the HOA coefficients 11 to determine a decomposed version of the HOA coefficients 11. The audio encoding device 20 may then analyze the decomposed version of the HOA coefficients 11 to identify various parameters, which may facilitate reordering of the decomposed version of the HOA coefficients 11. The audio encoding device 20 may then reorder the decomposed version of the HOA coefficients 11 based on the identified parameters, where such reordering, as described in further detail below, may improve coding efficiency given that the transformation may reorder the HOA coefficients across frames of the HOA coefficients (where a frame may include M samples of the HOA coefficients 11 and M is, in some examples, set to 1024). After reordering the decomposed version of the HOA coefficients 11, the audio encoding device 20 may select the decomposed version of the HOA coefficients 11 representative of foreground (or, in other words, distinct, predominant or salient) components of the soundfield. The audio encoding device 20 may specify the decomposed version of the HOA coefficients 11 representative of the foreground components as an audio object and associated directional information.

The audio encoding device 20 may also perform a soundfield analysis with respect to the HOA coefficients 11 in order, at least in part, to identify the HOA coefficients 11 representative of one or more background (or, in other words, ambient) components of the soundfield. The audio encoding device 20 may perform energy compensation with respect to the background components given that, in some examples, the background components may only include a subset of any given sample of the HOA coefficients 11 (e.g., such as the HOA coefficients 11 corresponding to zero and first order spherical basis functions and not the HOA coefficients 11 corresponding to second or higher-order spherical basis functions). When order-reduction is performed, in other words, the audio encoding device 20 may augment (e.g., add/subtract energy to/from) the remaining background HOA coefficients of the HOA coefficients 11 to compensate for the change in overall energy that results from performing the order reduction.

The audio encoding device 20 may next perform a form of psychoacoustic encoding (such as MPEG surround, MPEG-AAC, MPEG-USAC or other known forms of psychoacoustic encoding) with respect to each of the HOA coefficients 11 representative of background components and each of the foreground audio objects. The audio encoding device 20 may perform a form of interpolation with respect to the foreground directional information and then perform an order reduction with respect to the interpolated foreground directional information to generate order reduced foreground directional information. The audio encoding device 20 may further perform, in some examples, a quantization with respect to the order reduced foreground directional information, outputting coded foreground directional information. In some instances, the quantization may comprise a scalar/entropy quantization. The audio encoding device 20 may then form the bitstream 21 to include the encoded background components, the encoded foreground audio objects, and the quantized directional information. The audio encoding device 20 may then transmit or otherwise output the bitstream 21 to the content consumer device 14.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. That is, the audio decoding device 24 may dequantize the foreground directional information specified in the bitstream 21, while also performing psychoacoustic decoding with respect to the foreground audio objects specified in the bitstream 21 and the encoded HOA coefficients representative of background components. The audio decoding device 24 may further perform interpolation with respect to the decoded foreground directional information and then determine the HOA coefficients representative of the foreground components based on the decoded foreground audio objects and the interpolated foreground directional information. The audio decoding device 24 may then determine the HOA coefficients 11' based on the determined HOA coefficients representative of the foreground components and the decoded HOA coefficients representative of the background components.

The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers (which are not shown in the example of FIG. 2 for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (loudspeaker geometry wise) to that specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22.

Figure 3:
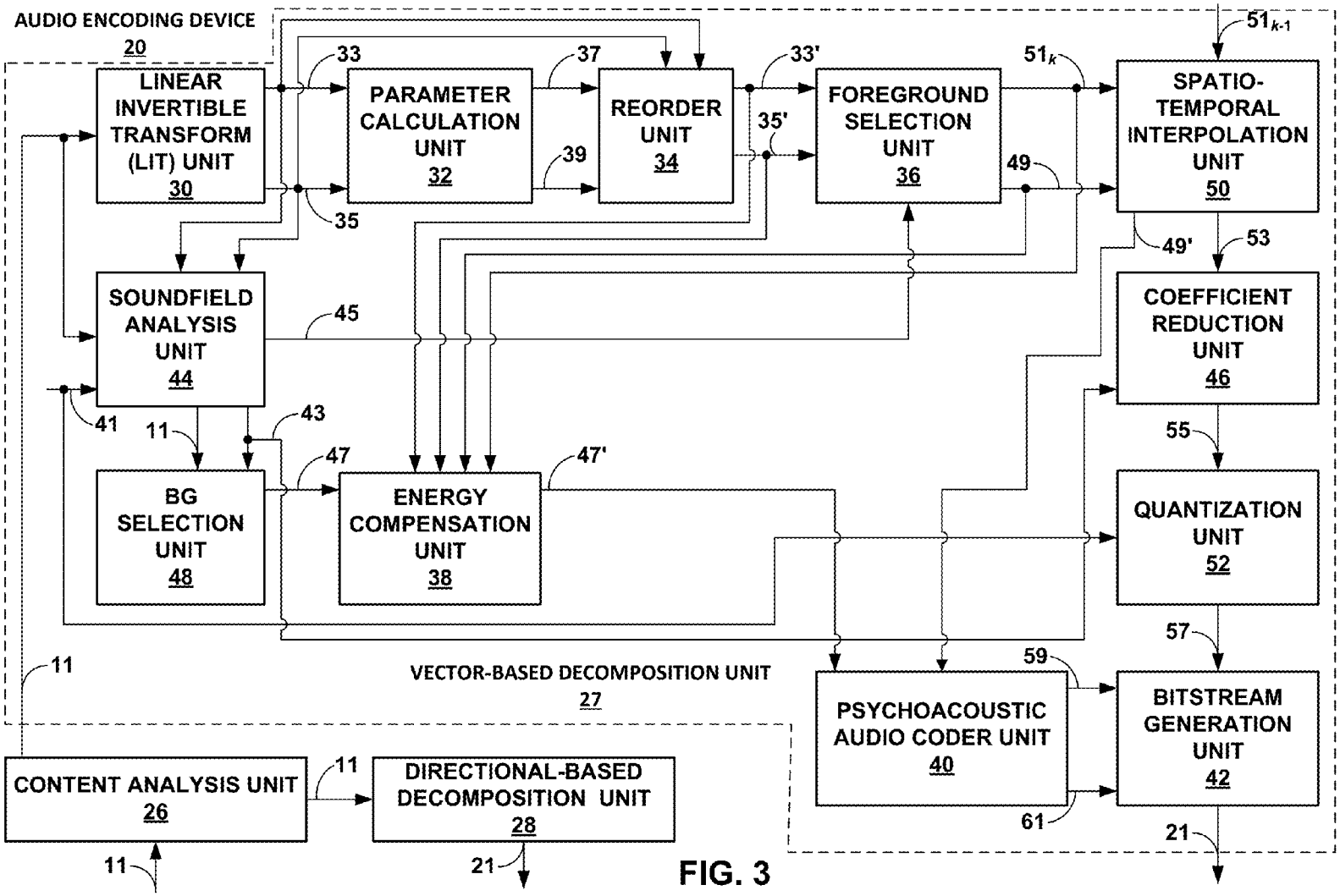
FIG. 3 is a block diagram illustrating, in more detail, one example of the audio encoding device shown in the example of FIG. 2 that may perform various aspects of the techniques described in this disclosure.

FIG. 3 is a block diagram illustrating, in more detail, one example of the audio encoding device 20 shown in the example of FIG. 2 that may perform various aspects of the techniques described in this disclosure. The audio encoding device 20 includes a content analysis unit 26, a vector-based decomposition unit 27 and a directional-based decomposition unit 28. Although described briefly below, more information regarding the audio encoding device 20 and the various aspects of compressing or otherwise encoding HOA coefficients is available in International Patent Application Publication No. WO 2014/194099, entitled "INTERPOLATION FOR DECOMPOSED REPRESENTATIONS OF A SOUND FIELD," filed 29 May 2014.

The content analysis unit 26 represents a unit configured to analyze the content of the HOA coefficients 11 to identify whether the HOA coefficients 11 represent content generated from a live recording or an audio object. The content analysis unit 26 may determine whether the HOA coefficients 11 were generated from a recording of an actual soundfield or from an artificial audio object. In some instances, when the framed HOA coefficients 11 were generated from a recording, the content analysis unit 26 passes the HOA coefficients 11 to the vector-based decomposition unit 27. In some instances, when the framed HOA coefficients 11 were generated from a synthetic audio object, the content analysis unit 26 passes the HOA coefficients 11 to the directional-based synthesis unit 28. The directional-based synthesis unit 28 may represent a unit configured to perform a directional-based synthesis of the HOA coefficients 11 to generate a directional-based bitstream 21.

As shown in the example of FIG. 3, the vector-based decomposition unit 27 may include a linear invertible transform (LIT) unit 30, a parameter calculation unit 32, a reorder unit 34, a foreground selection unit 36, an energy compensation unit 38, a psychoacoustic audio coder unit 40, a bitstream generation unit 42, a soundfield analysis unit 44, a coefficient reduction unit 46, a background (BG) selection unit 48, a spatio-temporal interpolation unit 50, and a quantization unit 52.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

That is, the LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set."

An alternative transformation may comprise a principal component analysis, which is often referred to as "PCA."

PCA refers to a mathematical procedure that employs an orthogonal transformation to convert a set of observations of possibly correlated variables into a set of linearly uncorrelated variables referred to as principal components. Linearly uncorrelated variables represent variables that do not have a linear statistical relationship (or dependence) to one another. The principal components may be described as having a small degree of statistical correlation to one another. In any event, the number of so-called principal components is less than or equal to the number of original variables. In some examples, the transformation is defined in such a way that the first principal component has the largest possible variance (or, in other words, accounts for as much of the variability in the data as possible), and each succeeding component in turn has the highest variance possible under the constraint that the successive component be orthogonal to (which may be restated as uncorrelated with) the preceding components. PCA may perform a form of order-reduction, which in terms of the HOA coefficients 11 may result in the compression of the HOA coefficients 11. Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multi-channel audio data.

In any event, assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 3, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

While described in this disclosure as being applied to multi-channel audio data comprising HOA coefficients 11, the techniques may be applied to any form of multi-channel audio data. In this way, the audio encoding device 20 may perform a singular value decomposition with respect to multi-channel audio data representative of at least a portion of soundfield to generate a U matrix representative of left-singular vectors of the multi-channel audio data, an S matrix representative of singular values of the multi-channel audio data and a V matrix representative of right-singular vectors of the multi-channel audio data, and representing the multi-channel audio data as a function of at least a portion of one or more of the U matrix, the S matrix and the V matrix.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In any event, the LIT unit 30 may perform a block-wise form of SVD with respect to each block (which may refer to a frame) of higher-order ambisonics (HOA) audio data (where the ambisonics audio data includes blocks or samples of the HOA coefficients 11 or any other form of multi-channel audio data). As noted above, a variable M may be used to denote the length of an audio frame in samples. For example, when an audio frame includes 1024 audio samples, M equals 1024. Although described with respect to the typical value for M, the techniques of the disclosure should not be limited to the typical value for M. The LIT unit 30 may therefore perform a block-wise SVD with respect to a block the HOA coefficients 11 having M-by-$(N+1)^2$ HOA coefficients, where N, again, denotes the order of the HOA audio data. The LIT unit 30 may generate, through performing the SVD, a V matrix, an S matrix, and a U matrix, where each of matrixes may represent the respective V, S and U matrixes described above. In this way, the linear invertible transform unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) width may instead be represented by individual $i^{th}$ vectors, $v^{(i)}(k)$, in the V matrix (each of length $(N+1)^2$). The individual elements of each of $v^{(i)}(k)$ vectors may represent an HOA coefficient describing the shape and direction of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with true energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document.

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. The power spectral density matrix may be denoted as PSD and obtained through matrix multiplication of the transpose of the hoaFrame to the hoaFrame, as outlined in the pseudo-code that follows below. The hoaFrame notation refers to a frame of the HOA coefficients 11.

The LIT unit 30 may, after applying the SVD (svd) to the PSD, may obtain an $S[k]^2$ matrix (S_squared) and a V[k] matrix. The $S[k]^2$ matrix may denote a squared S[k] matrix, whereupon the LIT unit 30 may apply a square root operation to the $S[k]^2$ matrix to obtain the S[k] matrix. The LIT unit 30 may, in some instances, perform quantization with respect to the V[k] matrix to obtain a quantized V[k] matrix (which may be denoted as V[k]' matrix). The LIT unit 30 may obtain the U[k] matrix by first multiplying the S[k] matrix by the quantized V[k]' matrix to obtain an SV[k]' matrix. The LIT unit 30 may next obtain the pseudo-inverse (pinv) of the SV[k]' matrix and then multiply the HOA coefficients 11 by the pseudo-inverse of the SV[k]' matrix to obtain the U[k] matrix. The foregoing may be represented by the following pseud-code:

```
PSD=hoaFrame'*hoaFrame;
[V, S_squared]=svd(PSD,'econ');
S=sqrt(S_squared);
U=hoaFrame*pinv(S*V');
```

By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients. That is, the above described PSD-type SVD may be potentially less computational demanding because the SVD is done on an F*F matrix (with F the number of HOA coefficients), compared to an M*F matrix with M is the frame length, i.e., 1024 or more samples. The complexity of an SVD may now, through application to the PSD rather than the HOA coefficients 11, be around $O(L^3)$ compared to $O(M*L^2)$ when applied to the HOA coefficients 11 (where O(*) denotes the big-O notation of computation complexity common to the computer-science arts).

The parameter calculation unit 32 represents a unit configured to calculate various parameters, such as a correlation parameter (R), directional properties parameters (θ, φ, r), and an energy property (e). Each of the parameters for the current frame may be denoted as R[k], θ[k], φ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], φ[k−1], r[k−1] and e[k−1], based on the previous frame of US[k−1] vector and V[k−1] vectors. The parameter calculation unit 32 may output the current parameters 37 and the previous parameters 39 to reorder unit 34.

The SVD decomposition does not guarantee that the audio signal/object represented by the p-th vector in US[k−1] vectors 33, which may be denoted as the US[k−1][p] vector (or, alternatively, as $X_{PS}^{(p)}(k-1)$), will be the same audio signal/object (progressed in time) represented by the p-th vector in the US[k] vectors 33, which may also be denoted as US[k][p] vectors 33 (or, alternatively as $X_{PS}^{(p)}(k)$). The parameters calculated by the parameter calculation unit 32 may be used by the reorder unit 34 to re-order the audio objects to represent their natural evaluation or continuity over time.

That is, the reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield (nBGa=(MinAmbHOAorder+1)$^2$), and indices (i) of additional BG HOA channels to send (which may collectively be denoted as background channel information 43 in the example of FIG. 3). The background channel information 42 may also be referred to as ambient channel information 43. Each of the channels that remains from numHOATransportChannels—nBGa, may either be an "additional background/ambient channel", an "active vector-based predominant channel", an "active directional based predominant signal" or "completely inactive". In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by (MinAmbHOAorder+1)$^2$+the number of times the index 10 (in the above example) appears as a channel type in the bitstream for that frame.

In any event, the soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of which of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1, hence the audio encoding device may only need to indicate one of the additional ambient HOA coefficient having an index of 5-25. The information could thus be sent using a 5 bits syntax element (for $4^{th}$ order content), which may be denoted as "CodedAmbCoeffIdx."

To illustrate, assume that the minAmbHOAorder is set to 1 and an additional ambient HOA coefficient with an index of six is sent via the bitstream 21 as one example. In this example, the minAmbHOAorder of 1 indicates that ambient HOA coefficients have an index of 1, 2, 3 and 4. The audio encoding device 20 may select the ambient HOA coefficients because the ambient HOA coefficients have an index less than or equal to $(\text{minAmbHOAorder}+1)^2$ or 4 in this example. The audio encoding device 20 may specify the ambient HOA coefficients associated with the indices of 1, 2, 3 and 4 in the bitstream 21. The audio encoding device 20 may also specify the additional ambient HOA coefficient with an index of 6 in the bitstream as an additionalAmbientHOAchannel with a ChannelType of 10. The audio encoding device 20 may specify the index using the CodedAmbCoeffIdx syntax element. As a practical matter, the CodedAmbCoeffIdx element may specify all of the indices from 1-25. However, because the minAmbHOAorder is set to one, the audio encoding device 20 may not specify any of the first four indices (as the first four indices are known to be specified in the bitstream 21 via the minAmbHOAorder syntax element). In any event, because the audio encoding device 20 specifies the five ambient HOA coefficients via the minAmbHOAorder (for the first four) and the CodedAmbCoeffIdx (for the additional ambient HOA coefficient), the audio encoding device 20 may not specify the corresponding V-vector elements associated with the ambient HOA coefficients having an index of 1, 2, 3, 4 and 6. As a result, the audio encoding device 20 may specify the V-vector with elements [5, 7:25].

In a second aspect, all of the foreground/predominant signals are vector-based signals. In this second aspect, the total number of foreground/predominant signals may be given by $\text{nFG}=\text{numHOATransportChannels}-[(\text{MinAmbHOAorder}+1)^2+\text{each of the additionalAmbientHOAchannel}]$.

The soundfield analysis unit 44 outputs the background channel information 43 and the HOA coefficients 11 to the background (BG) selection unit 36, the background channel information 43 to coefficient reduction unit 46 and the bitstream generation unit 42, and the nFG 45 to a foreground selection unit 36.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the bitstream generation unit 42 to be specified in the bitstream 21 so as to enable the audio decoding device, such as the audio decoding device 24 shown in the example of FIGS. 2 and 4, to parse the background HOA coefficients 47 from the bitstream 21. The background selection unit 48 may then output the ambient HOA coefficients 47 to the energy compensation unit 38. The ambient HOA coefficients 47 may have dimensions D: $M\times[(N_{BG}+1)^2+\text{nBGa}]$. The ambient HOA coefficients 47 may also be referred to as "ambient HOA coefficients 47," where each of the ambient HOA coefficients 47 corresponds to a separate ambient HOA channel 47 to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nfG}[k]$ 49, or $X_{PS}^{(1\ldots nFG)}(k)$ 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as $\overline{V}_{1,\ldots,nFG}[k]$) having dimensions D: $(N+1)^2\times\text{nFG}$.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to the psychoacoustic audio coder unit 40.

The spatio-temporal interpolation unit 50 may represent a unit configured to receive the foreground V[k] vectors $\mathbf{51}_k$ for the $k^{th}$ frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $51_k$ to recover reordered foreground HOA coefficients. The spatio-temporal interpolation unit 50 may then divide the reordered foreground HOA coefficients by the interpolated V[k] vectors to generate interpolated nFG signals 49'. The spatio-temporal interpolation unit 50 may also output the foreground V[k] vectors $51_k$ that were used to generate the interpolated foreground V[k] vectors so that an audio decoding device, such as the audio decoding device 24, may generate the interpolated foreground V[k] vectors and thereby recover the foreground V[k] vectors $51_k$. The foreground V[k] vectors $51_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder.

In operation, the spatio-temporal interpolation unit 50 may interpolate one or more sub-frames of a first audio frame from a first decomposition, e.g., foreground V[k] vectors $51_k$, of a portion of a first plurality of the HOA coefficients 11 included in the first frame and a second decomposition, e.g., foreground V[k] vectors $51_{k-1}$, of a portion of a second plurality of the HOA coefficients 11 included in a second frame to generate decomposed interpolated spherical harmonic coefficients for the one or more sub-frames.

In some examples, the first decomposition comprises the first foreground V[k] vectors $51_k$ representative of right-singular vectors of the portion of the HOA coefficients 11. Likewise, in some examples, the second decomposition comprises the second foreground V[k] vectors $51_k$ representative of right-singular vectors of the portion of the HOA coefficients 11.

In other words, spherical harmonics-based 3D audio may be a parametric representation of the 3D pressure field in terms of orthogonal basis functions on a sphere. The higher the order N of the representation, the potentially higher the spatial resolution, and often the larger the number of spherical harmonics (SH) coefficients (for a total of $(N+1)^2$ coefficients). For many applications, a bandwidth compression of the coefficients may be required for being able to transmit and store the coefficients efficiently. The techniques directed in this disclosure may provide a frame-based, dimensionality reduction process using Singular Value Decomposition (SVD). The SVD analysis may decompose each frame of coefficients into three matrices U, S and V. In some examples, the techniques may handle some of the vectors in US[k] matrix as foreground components of the underlying soundfield. However, when handled in this manner, the vectors (in US[k] matrix) are discontinuous from frame to frame—even though they represent the same distinct audio component. The discontinuities may lead to significant artifacts when the components are fed through transform-audio-coders.

In some respects, the spatio-temporal interpolation may rely on the observation that the V matrix can be interpreted as orthogonal spatial axes in the Spherical Harmonics domain. The U[k] matrix may represent a projection of the Spherical Harmonics (HOA) data in terms of the basis functions, where the discontinuity can be attributed to orthogonal spatial axis (V[k]) that change every frame—and are therefore discontinuous themselves. This is unlike some other decompositions, such as the Fourier Transform, where the basis functions are, in some examples, constant from frame to frame. In these terms, the SVD may be considered as a matching pursuit algorithm. The spatio-temporal interpolation unit 50 may perform the interpolation to potentially maintain the continuity between the basis functions (V[k]) from frame to frame—by interpolating between them.

As noted above, the interpolation may be performed with respect to samples. The case is generalized in the above description when the sub-frames comprise a single set of samples. In both the case of interpolation over samples and over sub-frames, the interpolation operation may take the form of the following equation:

$$\overline{v(l)}=w(l)v(k)+(1-w(l))v(k-1).$$

In the above equation, the interpolation may be performed with respect to the single V-vector v(k) from the single V-vector v(k−1), which in one aspect could represent V-vectors from adjacent frames k and k−1. In the above equation, l, represents the resolution over which the interpolation is being carried out, where l may indicate a integer sample and l=1, . . . , T (where T is the length of samples over which the interpolation is being carried out and over which the output interpolated vectors, $\overline{v(l)}$ are required and also indicates that the output of the process produces l of the vectors). Alternatively, l could indicate sub-frames consisting of multiple samples. When, for example, a frame is divided into four sub-frames, l may comprise values of 1, 2, 3 and 4, for each one of the sub-frames. The value of l may be signaled as a field termed "CodedSpatialInterpolationTime" through a bitstream—so that the interpolation operation may be replicated in the decoder. The w(l) may comprise values of the interpolation weights. When the interpolation is linear, w(l) may vary linearly and monotonically between 0 and 1, as a function of l. In other instances, w(l) may vary between 0 and 1 in a non-linear but monotonic fashion (such as a quarter cycle of a raised cosine) as a function of l. The function, w(l), may be indexed between a few different possibilities of functions and signaled in the bitstream as a field termed "SpatialInterpolationMethod" such that the identical interpolation operation may be replicated by the decoder. When w(l) has a value close to 0, the output, $\overline{v(l)}$, may be highly weighted or influenced by v(k−1). Whereas when w(l) has a value close to 1, it ensures that the output, $\overline{v(l)}$, is highly weighted or influenced by v(k−1).

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times nFG$.

The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. As described above, in some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional HOA channels (which may be denoted by the variable TotalOfAddAmbHOAChan) from the set of $[(N_{BG}+1)^2+1, (N+1)^2]$. The soundfield analysis unit 44 may analyze the HOA coefficients 11 to determine $BG_{TOT}$, which may identify not only the $(N_{BG}+1)^2$ but the TotalOfAddAmbHOAChan, which may collectively be referred to as the background channel information 43. The coefficient reduction unit 46 may then remove the coefficients corresponding to the $(N_{BG}+1)^2$ and the TotalOfAddAmbHOAChan from the remaining foreground V[k] vectors 53 to generate a smaller dimensional V[k] matrix 55 of size $((N+1)^2-(BG_{TOT})\times nFG$, which may also be referred to as the reduced foreground V[k] vectors 55.

The quantization unit 52 may represent a unit configured to perform any form of quantization to compress the reduced foreground V[k] vectors 55 to generate coded foreground V[k] vectors 57, outputting the coded foreground V[k] vectors 57 to the bitstream generation unit 42. In operation, the quantization unit 52 may represent a unit configured to compress a spatial component of the soundfield, i.e., one or more of the reduced foreground V[k] vectors 55 in this example. For purposes of example, the reduced foreground V[k] vectors 55 are assumed to include two row vectors having, as a result of the coefficient reduction, less than 25 elements each (which implies a fourth order HOA representation of the soundfield). Although described with respect to two row vectors, any number of vectors may be included in the reduced foreground V[k] vectors 55 up to $(n+1)^2$, where n denotes the order of the HOA representation of the soundfield. Moreover, although described below as performing a scalar and/or entropy quantization, the quantization unit 52 may perform any form of quantization that results in compression of the reduced foreground V[k] vectors 55.

The quantization unit 52 may receive the reduced foreground V[k] vectors 55 and perform a compression scheme to generate coded foreground V[k] vectors 57. The compression scheme may involve any conceivable compression scheme for compressing elements of a vector or data generally, and should not be limited to the example described below in more detail. The quantization unit 52 may perform, as an example, a compression scheme that includes one or more of transforming floating point representations of each element of the reduced foreground V[k] vectors 55 to integer representations of each element of the reduced foreground V[k] vectors 55, uniform quantization of the integer representations of the reduced foreground V[k] vectors 55 and categorization and coding of the quantized integer representations of the remaining foreground V[k] vectors 55.

In some examples, several of the one or more processes of the compression scheme may be dynamically controlled by parameters to achieve or nearly achieve, as one example, a target bitrate 41 for the resulting bitstream 21. Given that each of the reduced foreground V[k] vectors 55 are orthonormal to one another, each of the reduced foreground V[k] vectors 55 may be coded independently. In some examples, as described in more detail below, each element of each reduced foreground V[k] vectors 55 may be coded using the same coding mode (defined by various sub-modes).

As described in publication no. WO 2014/194099, the quantization unit 52 may perform scalar quantization and/or Huffman encoding to compress the reduced foreground V[k] vectors 55, outputting the coded foreground V[k] vectors 57, which may also be referred to as side channel information 57. The side channel information 57 may include syntax elements used to code the remaining foreground V[k] vectors 55.

As noted in publication no. WO 2014/194099, the quantization unit 52 may generate syntax elements for the side channel information 57. For example, the quantization unit 52 may specify a syntax element in a header of an access unit (which may include one or more frames) denoting which of the plurality of configuration modes was selected. Although described as being specified on a per access unit basis, quantization unit 52 may specify the syntax element on a per frame basis or any other periodic basis or non-periodic basis (such as once for the entire bitstream). In any event, the syntax element may comprise two bits indicating which of the three configuration modes were selected for specifying the non-zero set of coefficients of the reduced foreground V[k] vectors 55 to represent the directional aspects of the distinct component. The syntax element may be denoted as "codedVVecLength." In this manner, the quantization unit 52 may signal or otherwise specify in the bitstream which of the three configuration modes were used to specify the coded foreground V[k] vectors 57 in the bitstream.

For example, three configuration modes may be presented in the syntax table for VVecData (later referenced in this document). In that example, the configuration modes are as follows: (Mode 0), a complete V-vector length is transmitted in the VVecData field; (Mode 1), the elements of the V-vector associated with the minimum number of coefficients for the Ambient HOA coefficients and all the elements of the V-vector which included additional HOA channels that are not transmitted; and (Mode 2), the elements of the V-vector associated with the minimum number of coefficients for the Ambient HOA coefficients are not transmitted. The syntax table of VVecData illustrates the modes in connection with a switch and case statement. Although described with respect to three configuration modes, the techniques should not be limited to three configuration modes and may include any number of configuration modes, including a single configuration mode or a plurality of modes. Publication no. WO 2014/194099 provides a different example with four modes. The scalar/entropy quantization unit 53 may also specify the flag 63 as another syntax element in the side channel information 57.

Moreover, although described with respect to a form of scalar quantization, the quantization unit 52 may perform vector quantization or any other form of quantization. In some instances, the quantization unit 52 may switch between vector quantization and scalar quantization. During the above described scalar quantization, the quantization unit 52 may compute the difference between two successive V-vectors (successive as in frame-to-frame) and code the difference (or, in other words, residual). Vector quantization does not involve such difference coding (which may, in a sense, be a predictive form of coding in that scalar quantization predicts the current V-vector based on a previous V-vector and a signaled difference).

The psychoacoustic audio coder unit 40 included within the audio encoding device 20 may represent multiple instances of a psychoacoustic audio coder, each of which is used to encode a different audio object or HOA channel of each of the energy compensated ambient HOA coefficients 47' and the interpolated nFG signals 49' to generate encoded ambient HOA coefficients 59 and encoded nFG signals 61. The psychoacoustic audio coder unit 40 may output the encoded ambient HOA coefficients 59 and the encoded nFG signals 61 to the bitstream generation unit 42.

The bitstream generation unit 42 included within the audio encoding device 20 represents a unit that formats data to conform to a known format (which may refer to a format known by a decoding device), thereby generating the vector-based bitstream 21. The bitstream 21 may, in other words, represent encoded audio data, having been encoded in the manner described above. The bitstream generation unit 42 may represent a multiplexer in some examples, which may receive the coded foreground V[k] vectors 57, the encoded ambient HOA coefficients 59, the encoded nFG signals 61 and the background channel information 43. The bitstream generation unit 42 may then generate a bitstream 21 based on the coded foreground V[k] vectors 57, the encoded ambient HOA coefficients 59, the encoded nFG signals 61 and the background channel information 43. The bitstream 21 may include a primary or main bitstream and one or more side channel bitstreams.

Although not shown in the example of FIG. 3, the audio encoding device 20 may also include a bitstream output unit that switches the bitstream output from the audio encoding device 20 (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstreams 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a loss of energy for the aspects of the sound field represented by the addition or removal of the additional ambient HOA coefficients and the corresponding removal of coefficients from or addition of coefficients to the reduced foreground V[k] vectors 55.

To illustrate, assume that for a previous frame (denoted as "$F_{X-1}$"), the total number of ambient HOA coefficients ($BG_{TOT}$) includes ambient HOA coefficients associated with indices of 1, 2, 3, and 4 and additional ambient HOA coefficient 6. For a current frame (denoted as "$F_X$"), further assume that the total number of ambient HOA coefficients ($BG_{TOT}$) includes ambient HOA coefficients associated with indices of 1, 2, 3 and 4 and additional ambient HOA coefficient 5. The total number of ambient HOA coefficients ($BG_{TOT}$) of the previous frame ($F_{X-1}$) therefore differs from the total number of ambient HOA coefficients ($BG_{TOT}$) of the current frame ($F_X$) by replacing the additional ambient HOA coefficient associated with index 6 with the additional ambient HOA coefficient associated with index 5. The V-vector of the previous frame ($F_{X-1}$) includes any elements to which one of the total number of ambient HOA coefficients ($BG_{TOT}$) of the previous frame $F_{X-1}$ do not correspond. As such, the V-vector may include elements 5 and 7 through 25 for a fourth order representation of the sound field, which may be denoted as V[5, 7:25]. The V-vector of the current frame ($F_X$) includes any elements to which one of the total number of ambient HOA coefficient ($BG_{TOT}$) of the current frame ($F_X$) do not correspond, which may be denoted as V[6:25] for a fourth order representation of the soundfield.

In publication no. WO 2014/194099, the audio encoding device signals V[5, 7:25] for frame $F_{X-1}$ and V[6:25] for frame $F_X$. The audio encoding device may also specify that the additional ambient HOA coefficient associated with index 6 is to be faded-out of the reconstruction of the HOA coefficients 11' for previous frame ($F_{X-1}$), while the additional ambient HOA coefficient associated with index 5 is to be faded-in for the current frame ($F_X$) when reconstructing the HOA coefficients 11'. The transitioning of the additional ambient HOA coefficients associated with index 6 out of the reconstruction at the audio decoding device during the previous frame ($F_{X-1}$) may reduce the total energy given that the additional ambient HOA coefficient associated with index 6 represents some portion of the overall energy of the soundfield. The reduction of energy may manifest as an audible audio artifact.

Likewise, the introduction of the additional ambient HOA coefficient associated with index 5 may, when faded-in during the current frame ($F_X$), result in some loss of energy when reconstructing the HOA coefficients 11' at the audio decoding device. The loss in energy occurs because the additional ambient HOA coefficient associated with index 5 is faded-in using, as one example, a linear fade-in operation that attenuates additional ambient HOA coefficient associated with index 5 and thereby detracts from the overall energy. Again, the reduction in energy may manifest as an audio artifact.

In accordance with various aspects of the techniques described in this disclosure, the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the bitstream generation unit 42 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above.

To illustrate the foregoing with respect to the example of the previous and current frames ($F_{X-1}$ and $F_X$), the coefficient reduction unit 46 may be modified from that specified in publication no. WO 2014/194099 to signal redundant information in terms of the elements sent for the V-vector during previous and current frames ($F_{X-1}$ and $F_X$). The coefficient reduction unit 46 may specify the vector elements (V[5:25])

for the previous frame $F_{X-1}$ so that the audio decoding device 24 is able to fade-in element 6 of the V-vector while also fading out the ambient HOA coefficient associated with index 6. The coefficient reduction unit 46 may not specify any syntax elements indicating that the transition of the V-vector elements that are in transition as it is implicit from the coding mode of the V-vectors and the transition information specified for the ambient HOA coefficients. For the current frame ($F_X$), the coefficient reduction unit 46 may likewise specify the V-vector as V[5:25] given that the audio decoding device 24 may use the $5^{th}$ element of the V-vector in a fade-out operation to offset the fade-in of the ambient HOA coefficient associated with index 5. The fade operation is, in the above examples, complementary for the V-vector element to that of the ambient HOA coefficient so as to maintain a uniform energy level and avoid introduction of the audio artifacts. While described as complimentary or otherwise providing a uniform energy across transitions, the techniques may allow for any other forms of transitioning operations that are used to avoid or reduce introduction of audio artifacts due to changes in energy.

In another example, the coefficient reduction unit 46 may not alter how the V-vectors of the reduced foreground V[k] vectors 55 are generated. As such, the transition flag is signaled in the side channel information. In this example, the audio decoding device may utilize a previous or subsequent frame's V-vector that includes the coefficient corresponding to the ambient HOA coefficient that is in transition. This example may require additional functionality at the decoder (e.g., a look-ahead mechanism that looks ahead to subsequent frames so as to copy the coefficient of the V-vectors from the subsequent frame for use in the current frame when an ambient HOA coefficient is being transitioned into the $BG_{TOT}$).

In this respect, the techniques may enable the audio encoding device 20 to determine when an ambient higher-order ambisonic coefficient 47' describing an ambient component of a sound field is in transition in terms of being used to describe the ambient component of the sound field. When referring to the ambient component of the sound field being used or not, it should be understood that the audio encoding device 20 may select the ambient HOA coefficients 47 to be used in reconstructing the sound field at the audio decoding device 24. While the ambient HOA coefficient may represent some aspect of the background or, in other words, ambient component of the sound field, the audio encoding device 20 may determine that one or more of the ambient HOA coefficients 47 do not provide sufficient information relevant to the ambient component of the sound field such that bits are not to be used in specifying the one or more of the ambient HOA coefficient 47 in the bitstream 21. The audio encoding device 20 may identify some subset of a larger set of the ambient HOA coefficients 47 that are used to represent the ambient component or aspect of the soundfield for each frame to, as one example, achieve a target bitrate 41. In any event, the audio encoding device 20 may also identify, in the bitstream 21 that includes the ambient higher-order ambisonic coefficient 47, that the ambient higher-order ambisonic coefficient 47 is in transition.

In these and other examples, the audio encoding device 20 may, when determining when the ambient higher-order ambisonic coefficient 47' is in transition, determine that the ambient higher-order ambisonic coefficient 47' is not used to describe the ambient component of the sound field. When identifying that the ambient higher-order ambisonic coefficient 47' is in transition, the audio encoding device 20 may specify an AmbCoeffTransition flag indicating that the higher-order ambisonic coefficient is in transition.

In these and other examples, the audio encoding device 20 may, when determining when the ambient higher-order ambisonic coefficient 47' is in transition, determine that the ambient higher-order ambisonic coefficient 47' is not used to describe the ambient component of the sound field.

In response to determining that the ambient higher-order ambisonic coefficient 47' is not to be used, the audio encoding device 20 may generate a vector-based signal representative of one or more distinct components of the sound field that includes an element of a vector (e.g., the reduced foreground V[k] vectors 55 or, in other words, the reduced foreground vectors $\mathbf{55}_k$) corresponding to the ambient higher-order ambisonic coefficient 47'. The vector $\mathbf{55}_k$ may describe spatial aspects of a distinct component of the sound field. The vector $\mathbf{55}_k$ also may have been decomposed from higher-order ambisonic coefficients 11 descriptive of the soundfield in the manner described above.

In these and other examples, the audio encoding device 20 may, when determining when the ambient higher-order ambisonic coefficient 47' is in transition, determine that the ambient higher-order ambisonic coefficients 47' is used to describe the ambient component of the sound field.

In these and other examples, the audio encoding device 20 may, when determining when the ambient higher-order ambisonic coefficient 47' is in transition, determine that the ambient higher-order ambisonic coefficient 47' is used to describe the ambient component of the sound field. The audio encoding device 20 may, when identifying that the ambient higher-order ambisonic coefficient 47' is in transition, also specify a syntax element indicating that the higher-order ambisonic coefficient 47' is in transition.

In these and other examples, the audio encoding device 20 may, when determining when the ambient higher-order ambisonic coefficient 47' is in transition, determine that the ambient higher-order ambisonic coefficient 47' is used to describe the ambient component of the sound field. The audio encoding device 20 may, in response to determining that the ambient higher-order ambisonic coefficient 47' is to be used, generate a vector-based signal representative of one or more distinct components of the sound field that includes an element of a vector $\mathbf{55}_k$ corresponding to the ambient higher-order ambisonic coefficient 47'. The vector $\mathbf{55}_k$ may describe spatial aspects of a distinct component of the sound field and may have been decomposed from higher-order ambisonic coefficients descriptive of the sound field.

In some examples, the bitstream generation unit 42 generates the bitstreams 21 to include Immediate Play-out Frames (IPFs) to, e.g., compensate for decoder start-up delay. In some cases, the bitstream 21 may be employed in conjunction with Internet streaming standards such as Dynamic Adaptive Streaming over HTTP (DASH) or File Delivery over Unidirectional Transport (FLUTE). DASH is described in ISO/IEC 23009-1, "Information Technology—Dynamic adaptive streaming over HTTP (DASH)," April, 2012. FLUTE is described in IETF RFC 6726, "FLUTE—File Delivery over Unidirectional Transport," November, 2012. Internet streaming standards such as the aforementioned FLUTE and DASH compensate for frame loss/degradation and adapt to network transport link bandwidth by enabling instantaneous play-out at designated stream access points (SAPs) as well as switching play-out between representations of the stream that differ in bitrate and/or enabled tools at any SAP of the stream. In other words, the audio encoding device 20 may encode frames in such a manner as to switch from a first representation of content (e.g., specified at a first bitrate) to a second different representation of the content (e.g., specified at a second higher or lower bitrate). The audio decoding device 24 may receive the frame and independently decode the frame to switch from the first representation of the content to the second representation of the content. The audio decoding device 24 may continue to decode subsequent frame to obtain the second representation of the content.

In the instance of instantaneous play-out/switching, pre-roll for a stream frame has not been decoded in order to establish the requisite internal state to correctly decode the frame, the bitstream generation unit 42 may encode the bitstream 21 to include Immediate Play-out Frames (IPFs), as described below in more detail with respect to FIG. 7I.

Figure 4:
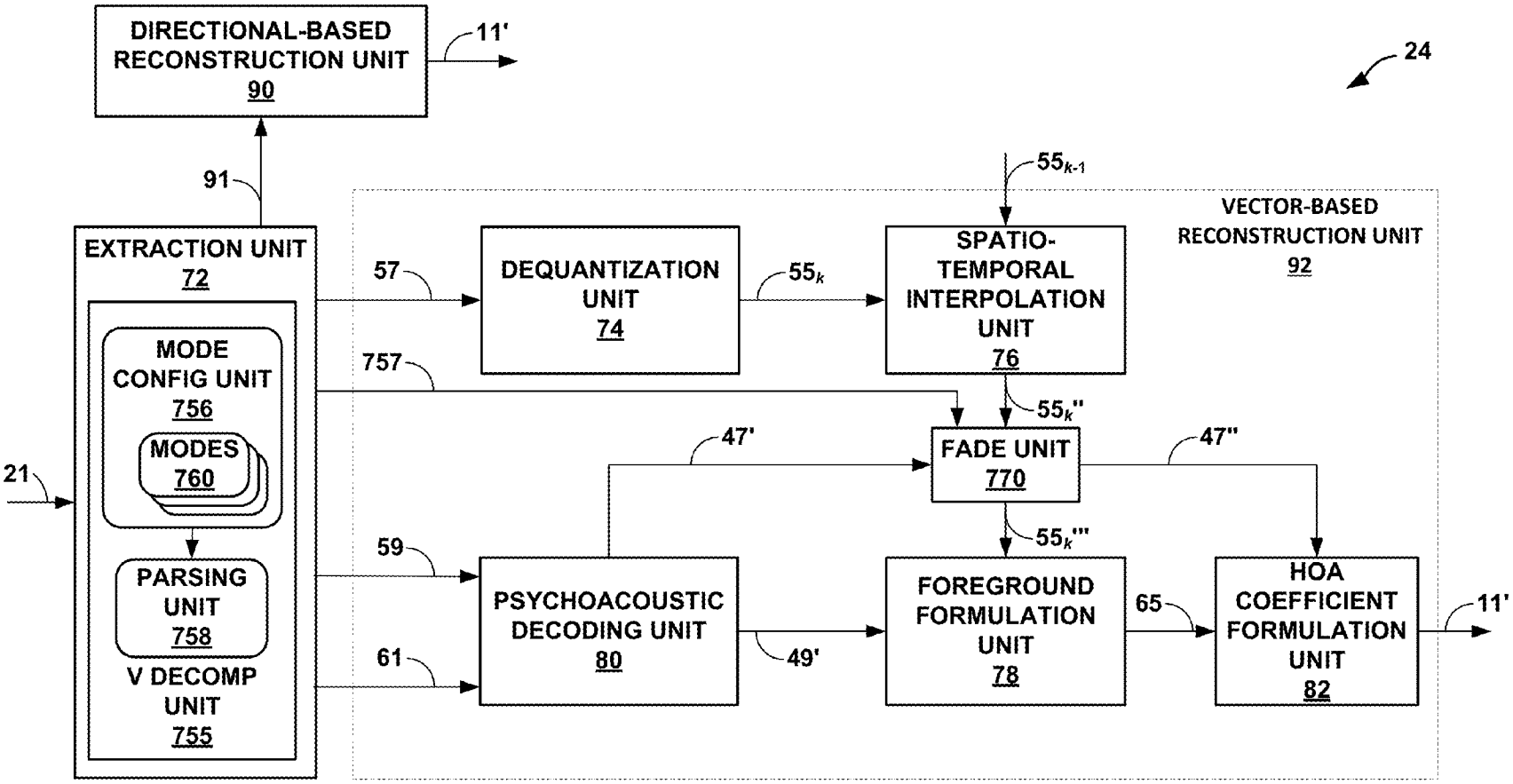
FIG. 4 is a block diagram illustrating the audio decoding device of FIG. 2 in more detail.

FIG. 4 is a block diagram illustrating the audio decoding device 24 of FIG. 2 in more detail. As shown in the example of FIG. 4 the audio decoding device 24 may include an extraction unit 72, a directionality-based reconstruction unit 90 and a vector-based reconstruction unit 92. Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May 2014.

The extraction unit 72 may represent a unit configured to receive the bitstream 21 and extract the various encoded versions (e.g., a directional-based encoded version or a vector-based encoded version) of the HOA coefficients 11. The extraction unit 72 may determine from the above noted syntax element (e.g., the ChannelType syntax element 269 shown in the examples of FIGS. 7D and 7E) whether the HOA coefficients 11 were encoded via the various versions. When a directional-based encoding was performed, the extraction unit 72 may extract the directional-based version of the HOA coefficients 11 and the syntax elements associated with the encoded version (which is denoted as directional-based information 91 in the example of FIG. 4), passing the directional based information 91 to the directional-based reconstruction unit 90. The directional-based reconstruction unit 90 may represent a unit configured to reconstruct the HOA coefficients in the form of HOA coefficients 11' based on the directional-based information 91. The bitstream and the arrangement of syntax elements within the bitstream is described below in more detail with respect to the example of FIGS. 7A-7J.

When the syntax element indicates that the HOA coefficients 11 were encoded using a vector-based synthesis, the extraction unit 72 may extract the coded foreground V[k] vectors 57, the encoded ambient HOA coefficients 59 and the encoded nFG signals 61. The extraction unit 72 may pass the coded foreground V[k] vectors 57 to the dequantization unit 74 and the encoded ambient HOA coefficients 59 along with the encoded nFG signals 61 to the psychoacoustic decoding unit 80.

To extract the coded foreground V[k] vectors 57, the encoded ambient HOA coefficients 59 and the encoded nFG signals 61, the extraction unit 72 may obtain the coded foreground V[k] vectors 57 (which may also be referred to as the side channel information 57). The side channel information 57 may include the syntax element denoted codedVVecLength. The extraction unit 72 may parse the codedVVecLength from the side channel information 57. The extraction unit 72 may be configured to operate in any one of the above described configuration modes based on the codedVVecLength syntax element.

The extraction unit 72 then operates in accordance with any one of configuration modes to parse a compressed form of the reduced foreground V[k] vectors $55_k$ from the side channel information 57. As noted above with respect to the bitstream generation unit 42 of the audio encoding device 20 shown in the example of FIG. 4, a flag or other syntax element may be specified in the bitstream indicative of a transition in ambient HOA coefficients 47 on a frame basis or possibly a multi-frame basis. The extraction unit 72 may parse the syntax element indicating whether an ambient HOA coefficient is in transition. As further shown in the example of FIG. 4, the extraction unit 72 may include a V decompression unit 755 (which is shown as "V decomp unit 755" in the example of FIG. 4). V decompression unit 755 receives the side channel information of the bitstream 21 and the syntax element denoted codedVVecLength. The extraction unit 72 may parse the codedVVecLength syntax element from the bitstream 21 (and, for example, from the access unit header included within the bitstream 21). The V decompression unit 755 includes a mode configuration unit 756 ("mode config unit 756") and a parsing unit 758 configurable to operate in accordance with any one of configuration modes 760.

The extraction unit 72 may provide the codedVVecLength syntax element to mode configuration unit 756. The extraction unit 42 may also extract a value for state variables usable by parsing unit 758.

The mode configuration unit 756 may select a parsing mode 760 based on the syntax element indicative of a transition of an ambient HOA coefficient. The parsing modes 760 may, in this example, specify certain values for configuring the parsing unit 758. The additional values may refer to values for variables denoted as "AmbCoeffTransitionMode" and "AmbCoeffWasFadedIn." The values maintain state with regard to the transition status of the AddAmbHoaInfoChannel, as specified in the following table:

Syntax of AddAmbHoaInfoChannel(i)

| Syntax | No. of bits | Mnemonic |
|---|---|---|
| HOAAddAmbInfoChannel(i) | | |
| { | | |
| if(IndependencyFlag){ | | |
| AmbCoeffWasFadedIn[i]; | 1 | Bslbf |
| AmbCoeffTransition; | 1 | Bslbf |
| AmbCoeffIdx[i] = CodedAmbCoeffIdx + 1 + MinNumOfCoeffsForAmbHOA; | AmbAsignmBits | Uimsbf |
| } | | |
| else { | | |
| if(AmbCoeffTransition) { | 1 | Bslbf |

-continued

| Syntax of AddAmbHoaInfoChannel(i) | | |
|---|---|---|
| Syntax | No. of bits | Mnemonic |
| if (AmbCoeffWasFadedIn[i] == 0) { | | |
| AmbCoeffTransitionMode[i] = 1; | | |
| AmbCoeffWasFadedIn[i] = 1; | | |
| AmbCoeffIdx[i] = CodedAmbCoeffIdx + 1 + MinNumOfCoeffsForAmbHOA; | AmbAsignmBits | Uimsbf |
| } | | |
| else { | | |
| AmbCoeffTransitionMode[i] = 2; | | |
| AmbCoeffWasFadedIn[i] = 0; | | |
| } | | |
| } | | |
| else { | | |
| AmbCoeffTransitionMode[i] = 0; | | |
| } | | |
| } | | |
| } | | |

NOTE:
The CodedAmbCoeffIdx of the preceding frame is used under the following conditions
if (AmbCoeffTransition && AmbCoeffWasFadedIn[i])
if (AmbCoeffTransition == 0)
The variable AmbCoeffWasFadedIn is a toggle and indicates if this additional HOA channel has been already faded-in or not. If AmbCoeffWasFadedIn == 1, it should be understood that the next transition is a fade-out in the above example.
AmbCoeffTransitionMode:
0: No transition (continuous Additional Ambient HOA Coefficient)
1: Fade-in of Additional Ambient HOA Coefficient
2: Fade-out of Additional Ambient HOA Coefficient In the foregoing AddAmbHoaInfoChannel Table, the mode configuration unit 756 may determine whether the IndependencyFlag value for an HOA frame is true. An IndependencyFlag with a value true indicates that the HOA frame is an Immediate Play-out Frame (IPF).

If the IndependencyFlag value for the HOA frame is false, the mode configuration unit 756 determines whether the AmbCoeffTransition flag is set to one. The AmbCoeffTransition flag may represent a bit indicative of a transition of an ambient higher-order ambisonic coefficient. While described as a bit, the AmbCoeffTransition flag may, in some examples, include one or more bits. The term "bit" as used herein should be understood to refer to one or more bits and should not be limited to only a single bit unless explicitly stated otherwise.

When the AmbCoeffTransition flag is set to one, the mode configuration unit 756 then determines whether another variable (or, in other words, syntax element), AmbCoeffWasFadedIn[i], is equal to zero. The AmbCoeffWasFadedIn [i] variable is an array of i elements, one for each of the HOAAddAmbInfoChannels, that indicates whether the ith HOAAddAmbInfoChannel was previously faded-in. When the ith HOAAddAmbInfoChannel was not previously faded-in (meaning that the ith HOAAddAmbInfoChannel is equal to zero), the mode configuration unit 756 may set the AmbCoeffTransitionMode for the ith HOAAddAmbInfoChannel to one while also setting the AmbCoeffWasFadedIn for the ith HOAAddAmbInfoChannel to one. When the ith HOAAddAmbInfoChannel was previously faded-in (meaning that the ith HOAAddAmbInfoChannel is not equal to zero), the mode configuration unit 756 may set the AmbCoeffTransitionMode for the ith HOAAddAmbInfoChannel to two and set the AmbCoeffWasFadedIn for the ith HOAAddAmbInfoChannel to zero.

The combination of the AmbCoeffWasFadedIn and the AmbCoeffTransitionMode syntax elements may represent transition state information. The transition state information may, given that each of the AmbCoeffWasFadedIn and the AmbCoeffTransitionMode syntax elements are each a single bit, define up to four states. The above exemplary syntax table indicates that the transition state information indicate one of three states. The three states may include a no transition state, a fade-in state and a fade-out state. Although described in this disclosure as including two bits to indicate one of three states, the transition state information may be a single bit when the transition state information indicates less than three states. Moreover, the transition state information may include more than two bits in examples where the transition state information indicates one of five or more states.

When the AmbCoeffTransition flag is equal to zero, the mode configuration unit 756 may set the AmbCoeffTransitionMode for the ith HOAAddAmbInfoChannel to zero. As noted in the foregoing Table, when the AmbCoeffTransitionMode is equal to the following values, the corresponding action indicated below may be performed:

0: No transition (continuous Additional Ambient HOA Coefficient);

1: Fade-in of Additional Ambient HOA Coefficient; and

2: Fade-out of Additional Ambient HOA Coefficient.

If the IndependencyFlag value for the HOA frame is true, the extraction unit 72 may extract transition information 757 for the Additional Ambient HOA Channel from an associated syntax structure within the bitstream 21. Because IPFs are by definition independently decodable, transition information 757 for the IPF may be provided in conjunction with the IPF in the bitstream, e.g., such as the state information 814 described above. Thus, the extraction unit 72 may extract the value for variable AmbCoeffWasFadedIn[i] for the ith HOAAddAmbInfoChannel for which the syntax structure is providing transition information 757. In this way, the mode configuration unit 756 may determine the modes 760 for the ith HOAAddAmbInfoChannel to be applied by audio decoding device 24 in the ith HOAAddAmbInfoChannel.

The foregoing syntax may, however, be modified slightly to replace the separate syntax elements of AmbCoeffWasFadedIn[i] and AmbCoeffTransition with a two bit AmbCoeffTransitionState[i] syntax element and a one bit AmbCoeffIdxTransition syntax element. The foregoing syntax table may therefore be replaced with the following syntax table:

Syntax of AddAmbHoaInfoChannel(i)

| Syntax | No. of bits | Mnemonic |
|---|---|---|
| HOAAddAmbInfoChannel(i) | | |
| { | | |
| if(hoaIndependencyFlag){ | | |
| AmbCoeffTransitionState[i]; | 2 | Uimsbf |
| AmbCoeffIdx[i] = CodedAmbCoeffIdx + 1 + MinNumOfCoeffsForAmbHOA; | AmbAsignmBits | Uimsbf |
| } | | |
| else { | | |
| if(AmbCoeffIdxTransition == 1) { | 1 | Bslbf |
| if (AmbCoeffTransitionState[i] > 1) { | | |
| AmbCoeffTransitionState[i] = 1; | | |
| AmbCoeffIdx[i] = CodedAmbCoeffIdx + 1 + MinNumOfCoeffsForAmbHOA; | AmbAsignmBits | Uimsbf |
| } | | |
| else { | | |
| AmbCoeffTransitionState[i] = 2; | | |
| } | | |
| } | | |
| else { | | |
| AmbCoeffTransitionState[i] = 0; | | |
| } | | |
| } | | |
| } | | |

NOTE:
The AmbCoeffIdx of the preceding frame is used under the following exemplary conditions
if (AmbCoeffIdxTransitionState == 0)
if (AmbCoeffIdxTransitionState == 2)
AmbCoeffTransitionState:
0: No transition (continuous Additional Ambient HOA Coefficient)
1: Fade-in of Additional Ambient HOA Coefficient
2: Fade-out of Additional Ambient HOA Coefficient
3: Initial value In the foregoing exemplary syntax table, the audio encoding device 20 explicitly signals the AmbCoeffTransitionState syntax element when the HOAIndependencyFlag syntax element is set to a value of one. When the AmbCoeffTransitionState syntax element is signaled, the audio encoding device 20 signals the current state of the corresponding ambient HOA coefficient. Otherwise, when the HOAIndependencyFlag syntax element is set to a value of zero, the audio encoding device 20 does not signal the AmbCoeffTransitionState but instead signals the AmbCoeffIdxTransition syntax element indicative of whether there is a transition in the corresponding ambient HOA coefficient.

When the HOAIndependencyFlag syntax element is set to a value of zero, the extraction unit 72 may maintain the AmbCoeffTransitionState for the corresponding one of the ambient HOA coefficients. The extraction unit 72 may update the AmbCoeffTransitionState syntax element based on the AmbCoeffIdxTransition. For example, when the AmbCoeffTransitionState syntax element is set to 0 (meaning, no transition) and the AmbCoeffIdxTransition syntax element is set to 0, the extraction unit 72 may determine that no change has occurred and therefore that no change to the AmbCoeffTransitionState syntax element is necessary. When the AmbCoeffTransitionState syntax element is set to 0 (meaning, no transition) and the AmbCoeffIdxTransition syntax element is set to 1, the extraction unit 72 may determine that the corresponding ambient HOA coefficient is to be faded-out and sets the AmbCoeffTransitionState syntax element to a value of 2. When the AmbCoeffTransitionState syntax element is set to 2 (meaning, the corresponding ambient HOA coefficient was faded-out) and the AmbCoeffIdxTransition syntax element is set to 1, the extraction unit 72 may determine that the corresponding ambient HOA coefficient is to be faded-in and sets the AmbCoeffTransitionState syntax element to a value of 1.

Similar to the the AmbCoeffTransition flag, the AmbCoeffIdxTransition syntax element may represent a bit indicative of a transition of an ambient higher-order ambisonic coefficient. While described as a bit, the AmbCoeffIdxTransition syntax element may, in some examples, include one or more bits. Again, the term "bit" as used herein should be understood to refer to one or more bits and should not be limited to only a single bit unless explicitly stated otherwise.

Moreover, the AmbCoeffTransitionState[i] syntax element may represent transition state information. The transition state information may, given that the AmbCoeffTransitionState[i] syntax element is two bits, indicate one of four states. The foregoing exemplary syntax table indicates that the transition state information indicate one of three states. The three states may include a no transition state, a fade-in state and a fade-out state. Again, although described in this disclosure as including two bits to indicate one of three states, the transition state information may be a single bit when the transition state information indicates less than three states. Moreover, the transition state information may include more than two bits in examples where the transition state information indicates one of five or more states.

The extraction unit 72 may also operate in accordance with the switch statement presented in the following pseudocode with the syntax presented in the following syntax table for VVectorData:

```
switch CodedVVecLength{
    case 0: //full vector length
        VVecLength = NumOfHoaCoeffs;
        for (m=0; m< VVecLength; ++m){
            VVecCoeffId[m] = m;
            }
    break;
    case 1: // minimal vector length
        VVecLength = NumOfHoaCoeffs -
        MinNumOfCoeffsForAmbHOA -
        NumOfContAddHoaChans;
        for (i=0; i< NumOfAdditionalCoders; ++i){
            if (AmbCoeffTransitionMode[i] == 0){
                ContAmbCoeffIdx[i] = AmbCoeffIdx[i];}
            else{ ContAmbCoeffIdx[i] = -1; }
        }
        for (m=0; m< VVecLength; ++m){
            if (ismember(m + MinNumOfCoeffsForAmbHOA + 1,
            ContAmbCoeffIdx) == 0){
                VVecCoeffId[m] = m +
                MinNumOfCoeffsForAmbHOA;
            }
        }
    break;
    case 2: // MinNumOfCoeffsForAmbHOA removed (the state in
    the RM1 ref software)
        VVecLength = NumOfHoaCoeffs -
        MinNumOfCoeffsForAmbHOA;
            for (m=0; m< VVecLength; ++m){
                VVecCoeffId[m] = m +
                MinNumOfCoeffsForAmbHOA;
            }
    break;
    }
```

Case 0 in the foregoing pseudo-code represents pseudo-code for retrieving all of the elements of the V-vector when the coding mode is selected. Case 1 represents pseudo-code for retrieving the V-vector after having been reduced in the manner described above. Case 1 occurs when both the $N_{BG}$ and additional ambient HOA coefficients are sent, which results in the corresponding elements of the V-vectors not being sent. Case 2 represents pseudo-code for recovering the V-vectors when the elements of the V-vector corresponding to the additional ambient HOA coefficients are sent (redundantly) but not the elements of the V-vector corresponding to $N_{BG}$ ambient HOA coefficients.

The audio encoding device 20 may specify the bitstream 21 when the audio decoding device 24 is configured to operate in accordance with Case 2. The audio encoding device 20 may signal Case 2 upon selecting to explicitly signal the V-vector elements in the bitstream 21 during a transition of an ambient HOA coefficient. The audio encoding device 20 may elect to explicitly send the redundant V-vector element so as to allow for fade-in and fade-out of the V-vector element based on the transition of the ambient HOA coefficient, as discussed in more detail below with respect to FIG. 8.

The audio encoding device 20 may select Case 1 when electing to configure the decoder 24 to perform a look ahead to retrieve the V-vector elements from a subsequent frame in time (or a look behind to retrieve the V-vector elements from a previous frame in time). In other words, the extraction unit 72 of the audio decoding device 24 may be configured to perform Case 1 when the audio encoding device 20 elects to not send the redundant V-vector element and instead may configure the extraction unit 72 of the audio decoding device 24 to perform the look-ahead or look-behind operations to re-use a V-vector element from a different frame. The audio decoding device 24 may then perform the fade-in/fade-out operation using the implicitly signaled V-vector element (which may refer to the re-used V-vector element from a previous or subsequent frame).

The mode configuration unit 756 may select one of the modes 760 that configures the appropriate way by which to parse the bitstream 21 so as to recover the coded foreground V[k] vectors 57. The mode configuration unit 756 may configure the parsing unit 758 with the selected one of modes 760, which may then parse the bitstream 21 to recover the coded foreground V[k] vector 57. Parsing unit 758 may then output the coded foreground V[k] vectors 57.

Syntax of VVectorData(i)

| Syntax | No. of bits | Mnemonic |
|---|---|---|
| VVectorData(i) | | |
| { | | |
| if (NbitsQ(k)[i] == 5){ | | |
| for (m=0; m< VVecLength; ++m){ | | |
| VVec[i][VVecCoeffId[m]](k) = (VecVal / 128.0) − 1.0; | 8 | uimsbf |
| } | | |
| } | | |
| elseif(NbitsQ(k)[i] >= 6){ | | |
| for (m=0; m< VVecLength; ++m){ | | |
| huffIdx = huffSelect(VVecCoeffId[m], PFlag[i], CbFlag[i]); | | |
| cid = huffDecode(NbitsQ[i], huffIdx, huffVal); | dynamic | huffDe-code |
| aVal[i][m] = 0.0; | | |
| if ( cid > 0 ) { | | |
| aVal[i][m] = sgn = (sgnVal * 2) − 1; | 1 | bslbf |
| if (cid > 1) { | | |
| aVal[i][m] = sgn * (2.0^(cid −1 ) + intAddVal); | cid − 1 | uimsbf |
| } | | |
| } | | |
| VVec[i][VVecCoeffId[m]](k) = aVal[i][m] *(2^(16 − NbitsQ(k)[i])*aVal[i][m])/2^15; | | |
| if (PFlag(k)[i] == 1) { | | |
| VVec[i][VVecCoeffId[m]](k)+= VVec[i][VVecCoeffId[m]](k−1) | | |
| } | | |
| } | | |

After the switch statement on CodedVVeclength, the decision of whether to perform uniform dequantization may be controlled by the NbitsQ syntax element (or, as denoted above, the nbits syntax element), which when equal to 5, a uniform 8 bit scalar dequantization is performed. In contrast, an NbitsQ value of 6 or greater may result in application of Huffman decoding. The cid value referred to above may be equal to the two least significant bits of the NbitsQ value. The prediction mode discussed above is denoted as the PFlag in the above syntax table, while the HT info bit is denoted as the CbFlag in the above syntax table. The remaining syntax specifies how the decoding occurs in a manner substantially similar to that described above.

The vector-based reconstruction unit 92 represents a unit configured to perform operations reciprocal to that described above with respect to the vector-based decomposition unit 27 as depicted in FIG. 3 so as to reconstruct the HOA coefficients 11'. The vector-based reconstruction unit 92 may include a dequantization unit 74, a spatio-temporal interpolation unit 76, a foreground formulation unit 78, a psychoacoustic decoding unit 80, a fade unit 770 and an HOA coefficient formulation unit 82.

The dequantization unit 74 may represent a unit configured to operate in a manner reciprocal to the quantization unit 52 shown in the example of FIG. 3, dequantizing the coded foreground V[k] vectors 57 to generate reduced foreground V[k] vectors $\mathbf{55}_k$. The dequantization unit 74 may, in some examples, perform a form of entropy decoding and scalar dequantization in a manner reciprocal to that described above with respect to the quantization unit 52. The dequantization unit 74 may forward the reduced foreground V[k] vectors $\mathbf{55}_k$ to the spatio-temporal interpolation unit 76.

The psychoacoustic decoding unit 80 may operate in a manner reciprocal to the psychoacoustic audio coder unit 40 shown in the example of FIG. 3 so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). The psychoacoustic decoding unit 80 may pass the energy compensated ambient HOA coefficients 47' to the fade unit 770 and the nFG signals 49' to the foreground formulation unit 78.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k$". The spatio-temporal interpolation unit 76 may forward the interpolated foreground V[k] vectors $\mathbf{55}_k$" to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47" or "ambient HOA coefficients 47') and the elements of the interpolated foreground V[k] vectors $\mathbf{55}_k$" are to be either faded-in or faded-out. In some examples, the fade unit 770 may operate opposite with respect to each of the ambient HOA coefficients 47' and the elements of the interpolated foreground V[k] vectors $\mathbf{55}_k$". That is, the fade unit 770 may perform a fade-in or fade-out, or both a fade-in or fade-out with respect to corresponding one of the ambient HOA coefficients 47', while performing a fade-in or fade-out or both a fade-in and a fade-out, with respect to the corresponding one of the elements of the interpolated foreground V[k] vectors $\mathbf{55}_k$". The fade unit 770 may output adjusted ambient HOA coefficients 47" to the HOA coefficient formulation unit 82 and adjusted foreground V[k] vectors $\mathbf{55}_k$'" to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $\mathbf{55}_k$".

In other words, the VVec element associated with an additionally transmitted HOA coefficient may not have to be transmitted. For the frames where an additional HOA coefficient is transitional (meaning either faded-in or faded-out), the VVec element is transmitted to prevent energy holes in the reconstructed HOA sound field.

In these and other examples, the audio decoding device 24 may, when determining when an ambient higher-order ambisonic coefficient (such as ambient higher-order ambisonic coefficient 47') is in transition, obtain an AmbCoeffTransition flag from a bitstream (such as the bitstream 21 in the example of FIG. 4) that also includes the ambient higher-order ambisonic coefficient 47'. The AmbCoeffTransition flag indicates that the higher-order ambisonic coefficient is in transition.

In these and other examples, the audio decoding device 24 may, when determining when the ambient higher-order ambisonic coefficient 47' is in transition, determine that the ambient higher-order ambisonic coefficient 47' is not used to describe the ambient component of the sound field. In response to determining that the ambient higher-order ambisonic coefficient 47' is not used, the audio decoding device 24 may obtain a vector-based signal representative of one or more distinct components of the sound field that includes an element of a vector corresponding to the ambient higher-order ambisonic coefficient 47'. The vector may refer to one of the reduced foreground V[k] vectors $\mathbf{55}_k$", and as such may be referred to as vector $\mathbf{55}_k$". The vector $\mathbf{55}_k$" may describe spatial aspects of a distinct component of the sound field and may have been decomposed from higher-order ambisonic coefficients 11 descriptive of the sound field. The audio decoding device 24 may further perform a fade-in operation with respect to the element of the vector $\mathbf{55}_k$" corresponding to the ambient higher-order ambisonic coefficient 47' to fade-in the element of the vector. The audio decoding device 24 may perform the fade-in operation to add in the element of the vector $\mathbf{55}_k$" by linearly increasing a gain of the element of the vector $\mathbf{55}_k$" during the frame, as described in more detail with respect to the example of FIG. 8.

In these and other examples, the audio decoding device 24 may, when determining when the ambient higher-order ambisonic coefficient 47' is in transition, determine that the ambient higher-order ambisonic coefficient 47' is not used to describe the ambient component of the sound field. In response to determining that the ambient higher-order ambisonic coefficients is not used, the audio decoding device 24 may obtain a vector-based signal representative of one or more distinct components of the sound field that includes an element of a vector $\mathbf{55}_k$" corresponding to the ambient higher-order ambisonic coefficient 47'. The vector $\mathbf{55}_k$" may, as noted above, describe spatial aspects of a distinct component of the sound field and having been decomposed from higher-order ambisonic coefficients 11 descriptive of the sound field. The audio decoding device 24 may also perform a fade-in operation with respect to the element of the vector $\mathbf{55}_k$" corresponding to the ambient higher-order ambisonic coefficient 47' to fade-in the element of the vector $\mathbf{55}_k$." The audio decoding device 24 may further perform a fade-out operation with respect to the ambient higher-order ambisonic coefficient 47' to fade-out the ambient higher-order ambisonic coefficient 47'.

In these and other examples, the audio decoding device 24 may, when determining when the ambient higher-order ambisonic coefficient 47' is in transition, determine that the ambient higher-order ambisonic coefficient is used to describe the ambient component of the sound field. In response to determining that the ambient higher-order ambisonic coefficient is to be used, the audio decoding device 24 may obtain a vector-based signal representative of one or more distinct components of the sound field that includes an element of a vector $\mathbf{55}_k$ corresponding to the ambient higher-order ambisonic coefficient 47'. Again, the vector $\mathbf{55}_k$" may describe spatial aspects of a distinct component of the sound field and having been decomposed from higher-order ambisonic coefficients 11 descriptive of the sound field. The audio decoding device 24 may perform a fade-out operation with respect to the element of the vector $55_k$" corresponding to the ambient higher-order ambisonic coefficient 47' to fade-out the element of the vector.

In these and other examples, the audio decoding device 24 may, when determining when the ambient higher-order ambisonic coefficient 47' is in transition, determine that the ambient higher-order ambisonic coefficient 47' is used to describe the ambient component of the sound field. In response to determining that the ambient higher-order ambisonic coefficient 47' is used, the audio decoding device 24 may obtain a vector-based signal representative of one or more distinct components of the sound field that includes an element of a vector $55_k$" corresponding to the ambient higher-order ambisonic coefficient. The vector $55_k$" may, again, describe spatial aspects of a distinct component of the sound field and having been decomposed from higher-order ambisonic coefficients descriptive of the sound field. The audio decoding device 24 may also perform a fade-out operation with respect to the element of the vector $55_k$" corresponding to the ambient higher-order ambisonic coefficient 47' to fade-out the element of the vector $55_k$. The audio decoding device 24 may further perform a fade-in operation with respect to the ambient higher-order ambisonic channel 47' to fade-in the ambient higher-order ambisonic channel 47'.

In these and other examples, the audio decoding device 24 may, when obtaining the vector-based signal that includes the element of the vector $55_k$" corresponding to the ambient higher-order ambisonic coefficient 47', determine the element of the vector $55_k$" from the current frame, a frame subsequent to the current frame, or a frame previous to the current frame in which the fade operation with respect to the element of the vector $55_k$" is performed.

In these and other examples, the audio decoding device 24 may obtain an audio object corresponding to the vector $55_k$", and generate a spatially adjusted audio object as a function of the audio object and the vector $55_k$". The audio object may refer to one of audio objects 49', which may also be referred to as the interpolated nFG signals 49'.

The foreground formulation unit 78 may represent a unit configured to perform matrix multiplication with respect to the adjusted foreground V[k] vectors $55_k$'" and the interpolated nFG signals 49' to generate the foreground HOA coefficients 65. The foreground formulation unit 78 may perform a matrix multiplication of the interpolated nFG signals 49' by the adjusted foreground V[k] vectors $55_k$'".

The HOA coefficient formulation unit 82 may represent a unit configured to combine the foreground HOA coefficients 65 to the adjusted ambient HOA coefficients 47" so as to obtain the HOA coefficients 11', where the prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

Figure 5A:
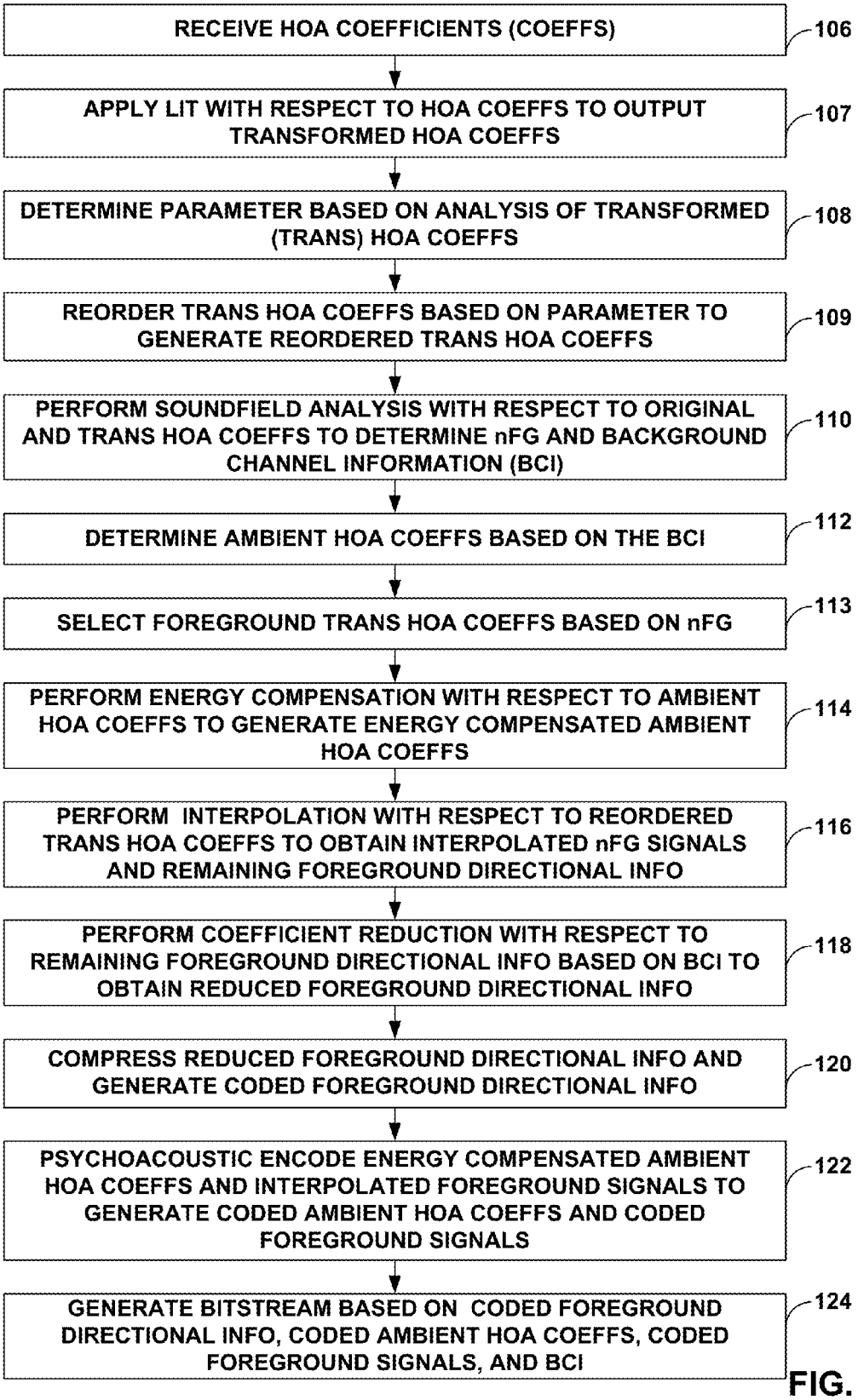
FIG. 5A is a flowchart illustrating exemplary operation of an audio encoding device in performing various aspects of the vector-based synthesis techniques described in this disclosure.

FIG. 5A is a flowchart illustrating exemplary operation of an audio encoding device, such as the audio encoding device 20 shown in the example of FIG. 3, in performing various aspects of the vector-based synthesis techniques described in this disclosure. Initially, the audio encoding device 20 receives the HOA coefficients 11 (106). The audio encoding device 20 may invoke the LIT unit 30, which may apply a LIT with respect to the HOA coefficients to output transformed HOA coefficients (e.g., in the case of SVD, the transformed HOA coefficients may comprise the US[k] vectors 33 and the V[k] vectors 35) (107).

The audio encoding device 20 may next invoke the parameter calculation unit 32 to perform the above described analysis with respect to any combination of the US[k] vectors 33, US[k−1] vectors 33, the V[k] and/or V[k−1] vectors 35 to identify various parameters in the manner described above. That is, the parameter calculation unit 32 may determine at least one parameter based on an analysis of the transformed HOA coefficients 33/35 (108).

The audio encoding device 20 may then invoke the reorder unit 34, which may reorder the transformed HOA coefficients (which, again in the context of SVD, may refer to the US[k] vectors 33 and the V[k] vectors 35) based on the parameter to generate reordered transformed HOA coefficients 33'/35' (or, in other words, the US[k] vectors 33' and the V[k] vectors 35'), as described above (109). The audio encoding device 20 may, during any of the foregoing operations or subsequent operations, also invoke the soundfield analysis unit 44. The soundfield analysis unit 44 may, as described above, perform a soundfield analysis with respect to the HOA coefficients 11 and/or the transformed HOA coefficients 33/35 to determine the total number of foreground channels (nFG) 45, the order of the background soundfield ($N_{BG}$) and the number (nBGa) and indices (i) of additional BG HOA channels to send (which may collectively be denoted as background channel information 43 in the example of FIG. 3) (109).

The audio encoding device 20 may also invoke the background selection unit 48. The background selection unit 48 may determine background or ambient HOA coefficients 47 based on the background channel information 43 (110). The audio encoding device 20 may further invoke the foreground selection unit 36, which may select the reordered US[k] vectors 33' and the reordered V[k] vectors 35' that represent foreground or distinct components of the soundfield based on nFG 45 (which may represent a one or more indices identifying the foreground vectors) (112).

The audio encoding device 20 may invoke the energy compensation unit 38. The energy compensation unit 38 may perform energy compensation with respect to the ambient HOA coefficients 47 to compensate for energy loss due to removal of various ones of the HOA coefficients by the background selection unit 48 (114) and thereby generate energy compensated ambient HOA coefficients 47'.

The audio encoding device 20 may also invoke the spatio-temporal interpolation unit 50. The spatio-temporal interpolation unit 50 may perform spatio-temporal interpolation with respect to the reordered transformed HOA coefficients 33'/35' to obtain the interpolated foreground signals 49' (which may also be referred to as the "interpolated nFG signals 49") and the remaining foreground directional information 53 (which may also be referred to as the "V[k] vectors 53") (116). The audio encoding device 20 may then invoke the coefficient reduction unit 46. The coefficient reduction unit 46 may perform coefficient reduction with respect to the remaining foreground V[k] vectors 53 based on the background channel information 43 to obtain reduced foreground directional information 55 (which may also be referred to as the reduced foreground V[k] vectors 55) (118).

The audio encoding device 20 may then invoke the quantization unit 52 to compress, in the manner described above, the reduced foreground V[k] vectors 55 and generate coded foreground V[k] vectors 57 (120).

The audio encoding device 20 may also invoke the psychoacoustic audio coder unit 40. The psychoacoustic audio coder unit 40 may psychoacoustic code each vector of the energy compensated ambient HOA coefficients 47' and the interpolated nFG signals 49' to generate encoded ambient HOA coefficients 59 and encoded nFG signals 61. The audio encoding device may then invoke the bitstream generation unit 42. The bitstream generation unit 42 may generate the bitstream 21 based on the coded foreground directional information 57, the coded ambient HOA coefficients 59, the coded nFG signals 61 and the background channel information 43.

Figure 5B:
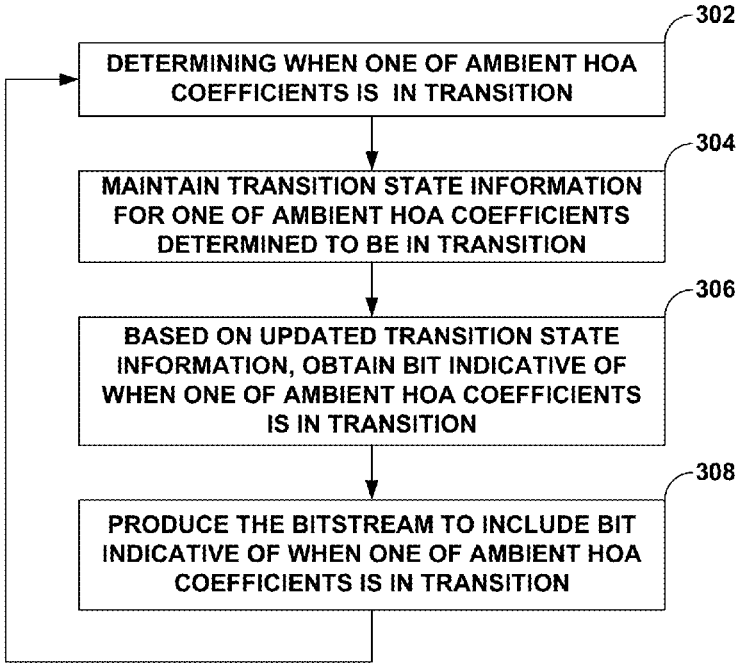
FIG. 5B is a flowchart illustrating exemplary operation of an audio encoding device in performing various aspects of the transition techniques described in this disclosure.

FIG. 5B is a flowchart illustrating exemplary operation of an audio encoding device in performing the transition techniques described in this disclosure. The audio encoding device 20 may represent one example of an audio encoding device configured to perform the transition techniques described in this disclosure. In particular, the bitstream generation unit 42 may maintain transition state information (as described in more detail below with respect to FIG. 8) for each ambient HOA coefficients (including the additional ambient HOA coefficients). The transition state information may indicate whether each of the ambient HOA coefficients are currently in one of three states. The three states may include a fade-in state, a no-change state and a fade-out state. Maintaining transition state information may enable the bitstream generation unit 42 to reduce bit overhead in that one or more syntax elements may be derived based on the maintained transition state information at the audio decoding device 24.

The bitstream generation unit 42 may further determine when one of the ambient HOA coefficient specified in one of the transport channels (such as that discussed below with respect to FIGS. 7D and 7E) is in transition (302). The bitstream generation unit 42 may determine when the HOA coefficient is in transition based on the nFG 45 and the background channel information 43. The bitstream generation unit 42 may update transition state information for the one of the HOA coefficients determined to be in transition (304). Based on the updated transition state information, the bitstream generation unit 42 may obtain a bit indicative of when the ambient HOA coefficient is in transition (306). The bitstream generation unit 42 may produce the bitstream 21 to include the bit indicative of when one of the HOA coefficients is in transition (308).

Although described as being performed by the bitstream generation unit 42, the foregoing techniques may be performed by any combination units 44, 48, 46 and 42. For example, the soundfield analysis unit 44 may maintain the transition state information for each of the ambient HOA coefficients based on the background channel information 43. The soundfield analysis unit 44 may obtain the bit indicative of the transition based on the transition state information and provide this bit to the bitstream generation unit 42. The bitstream generation unit 42 may then produce the bitstream 21 to include the bit indicative of the transition.

As another example, the background selection unit 48 may maintain the transition state information based on the background channel information 43 and obtain the bit indicative of the transition based on the transition state information. The bitstream generation unit 42 may obtain the bit indicative of the transition from the background selection unit 48 and produce the bitstream 21 to include the bit indicative of the transition.

As yet another example, the coefficient reduction unit 46 may maintain the transition state information based on the background channel information 43 and obtain the bit indicative of the transition based on the transition state information. The bitstream generation unit 42 may obtain the bit indicative of the transition from the coefficient reduction unit 46 and produce the bitstream 21 to include the bit indicative of the transition.

Figure 6A:
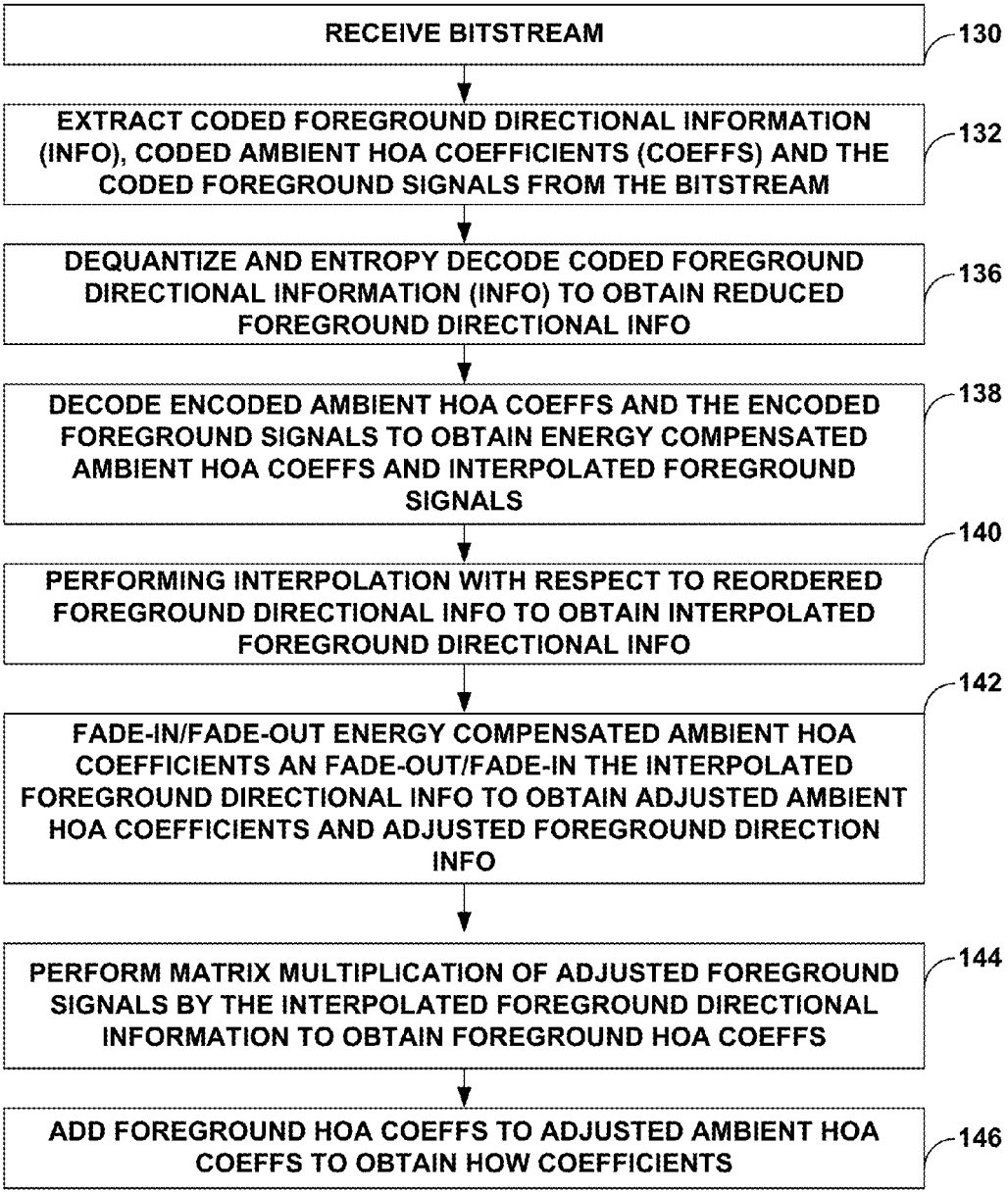
FIG. 6A is a flowchart illustrating exemplary operation of an audio decoding device in performing various aspects of the techniques described in this disclosure.

FIG. 6A is a flowchart illustrating exemplary operation of an audio decoding device, such as the audio decoding device 24 shown in FIG. 4, in performing various aspects of the techniques described in this disclosure. Initially, the audio decoding device 24 may receive the bitstream 21 (130). Upon receiving the bitstream, the audio decoding device 24 may invoke the extraction unit 72. Assuming for purposes of discussion that the bitstream 21 indicates that vector-based reconstruction is to be performed, the extraction unit 72 may parse the bitstream to retrieve the above noted information, passing the information to the vector-based reconstruction unit 92.

In other words, the extraction unit 72 may extract the coded foreground directional information 57 (which, again, may also be referred to as the coded foreground V[k] vectors 57), the coded ambient HOA coefficients 59 and the coded foreground signals (which may also be referred to as the coded foreground nFG signals 59 or the coded foreground audio objects 59) from the bitstream 21 in the manner described above (132).

The audio decoding device 24 may further invoke the dequantization unit 74. The dequantization unit 74 may entropy decode and dequantize the coded foreground directional information 57 to obtain reduced foreground directional information $\mathbf{55}_k$ (136). The audio decoding device 24 may also invoke the psychoacoustic decoding unit 80. The psychoacoustic audio decoding unit 80 may decode the encoded ambient HOA coefficients 59 and the encoded foreground signals 61 to obtain energy compensated ambient HOA coefficients 47' and the interpolated foreground signals 49' (138). The psychoacoustic decoding unit 80 may pass the energy compensated ambient HOA coefficients 47' to the fade unit 770 and the nFG signals 49' to the foreground formulation unit 78.

The audio decoding device 24 may next invoke the spatio-temporal interpolation unit 76. The spatio-temporal interpolation unit 76 may receive the reordered foreground directional information $\mathbf{55}_k'$ and perform the spatio-temporal interpolation with respect to the reduced foreground directional information $\mathbf{55}_k/\mathbf{55}_{k-1}$ to generate the interpolated foreground directional information $\mathbf{55}_k''$ (140). The spatio-temporal interpolation unit 76 may forward the interpolated foreground V[k] vectors $\mathbf{55}_k''$ to the fade unit 770.

The audio decoding device 24 may invoke the fade unit 770. The fade unit 770 may receive or otherwise obtain syntax elements (e.g., from the extraction unit 72) indicative of when the energy compensated ambient HOA coefficients 47' are in transition (e.g., the AmbCoeffTransition syntax element). The fade unit 770 may, based on the transition syntax elements and the maintained transition state information, fade-in or fade-out the energy compensated ambient HOA coefficients 47' outputting adjusted ambient HOA coefficients 47" to the HOA coefficient formulation unit 82. The fade unit 770 may also, based on the syntax elements and the maintained transition state information, and fade-out or fade-in the corresponding one or more elements of the interpolated foreground V[k] vectors $\mathbf{55}_k''$ outputting the adjusted foreground V[k] vectors $\mathbf{55}_k'''$ to the foreground formulation unit 78 (142).

The audio decoding device 24 may invoke the foreground formulation unit 78. The foreground formulation unit 78 may perform matrix multiplication the nFG signals 49' by the adjusted foreground directional information $\mathbf{55}_k'''$ to obtain the foreground HOA coefficients 65 (144). The audio decoding device 24 may also invoke the HOA coefficient formulation unit 82. The HOA coefficient formulation unit 82 may add the foreground HOA coefficients 65 to adjusted ambient HOA coefficients 47" so as to obtain the HOA coefficients 11' (146).

Figure 6B:
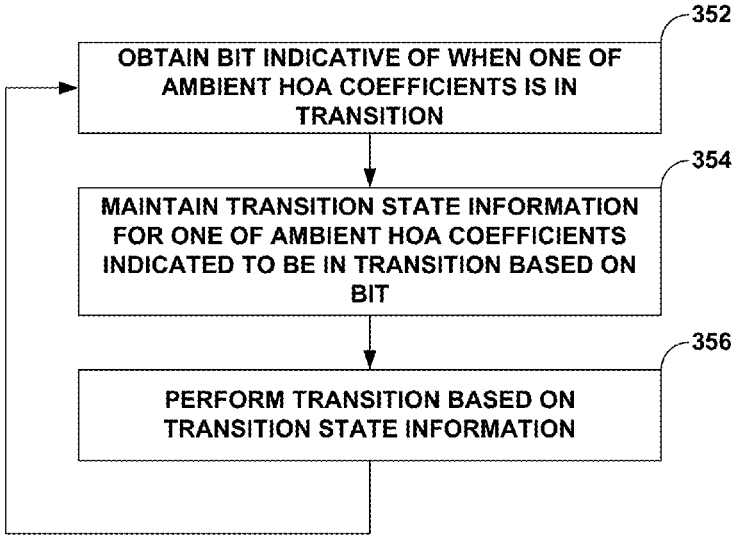
FIG. 6B is a flowchart illustrating exemplary operation of an audio decoding device in performing various aspects of the transition techniques described in this disclosure.

FIG. 6B is a flowchart illustrating exemplary operation of an audio decoding device in performing the transition techniques described in this disclosure. The audio decoding device 24 shown in the example of FIG. 4 may represent one example of an audio decoding device configured to perform the transition techniques described in this disclosure.

In particular, the fade unit 770 may obtain a bit (in the form of indication 757, where the indication 757 may represent an AmbCoeffTransition syntax element) indicative of when one of the ambient HOA coefficients 47' is in transition (352). The fade unit 770 may maintain the transition state information described below in more detail below with respect to the example of FIG. 8 based on the bit indicative of the transition (354). The transition state information may indicate whether each of the ambient HOA coefficients is currently in one of three states. The three states may include a fade-in state, a no-change state and a fade-out state.

The fade unit 770 may maintain the transition state information by, at least in part, updating the transition state information based on the indication 757 that one of the ambient HOA coefficients 47' is in transition. For example, the fade unit 770 may maintain transition state information for one of the ambient HOA coefficients 47' indicating that the one of the ambient HOA coefficients 47 is in a no-change transition state. Upon obtaining an indication that the one of the ambient HOA coefficients 47' is in transition, the fade unit 770 may update the transition state information for the one of the ambient HOA coefficients 47' to indicate that the one of the ambient HOA coefficients 47' is to be faded-out. As another example, the fade unit 770 may maintain transition state information for one of the ambient HOA coefficients 47 indicating that the one of the ambient HOA coefficients 47' has been faded-out. Upon obtaining an indication that the one of the ambient HOA coefficients 47' is in transition, the fade unit 770 may update the transition state information for the one of the ambient HOA coefficients 47' to indicate that the one of the ambient HOA coefficients 47' is to be faded-in. The fade unit 770 may then perform the transition based on the updated transition state information in the manner described above with respect to FIG. 4 and below in more detail with respect to FIG. 8 (356).

Figure 7A:
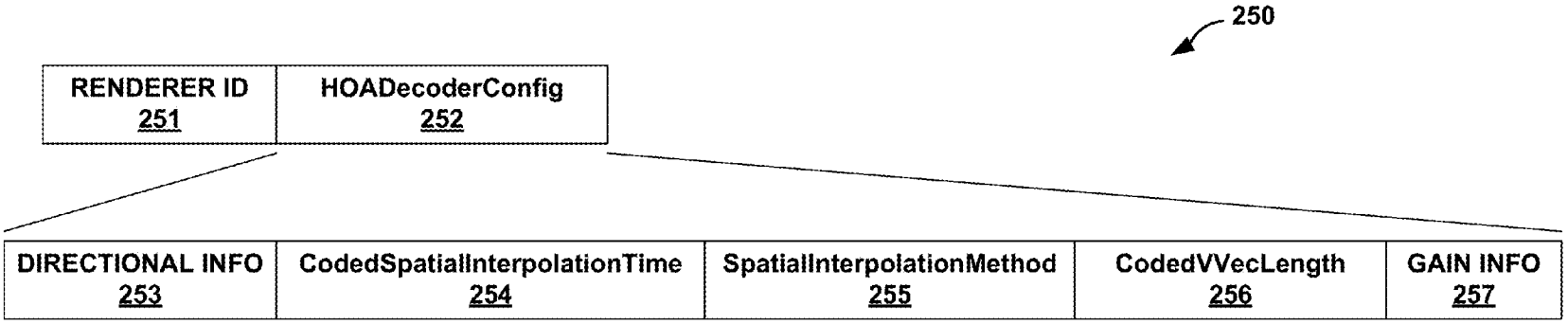

FIGS. 7A-7J are diagrams illustrating portions of the bitstream or side channel information that may specify the compressed spatial components in more detail. In the example of FIG. 7A, a portion 250 includes a renderer identifier ("renderer ID") field 251 and an HOADecoderConfig field 252 (which may also be referred to as an HOAConfig field 252). The renderer ID field 251 may represent a field that stores an ID of the renderer that has been used for the mixing of the HOA content. The HOADecoderConfig field 252 may represent a field configured to store information to initialize the HOA spatial decoder, such as audio decoding device 24 shown in the example of FIG. 4.

The HOADecoderConfig field 252 further includes a directional information ("direction info") field 253, a CodedSpatialInterpolationTime field 254, a SpatialInterpolationMethod field 255, a CodedVVecLength field 256 and a gain info field 257. The directional information field 253 may represent a field that stores information for configuring the directional-based synthesis decoder. The CodedSpatialInterpolationTime field 254 may represent a field that stores a time of the spatio-temporal interpolation of the vector-based signals. The SpatialInterpolationMethod field 255 may represent a field that stores an indication of the interpolation type applied during the spatio-temporal interpolation of the vector-based signals. The CodedVVecLength field 256 may represent a field that stores a length of the transmitted data vector used to synthesize the vector-based signals. The gain info field 257 represents a field that stores information indicative of a gain correction applied to the signals.

Figure 7B:
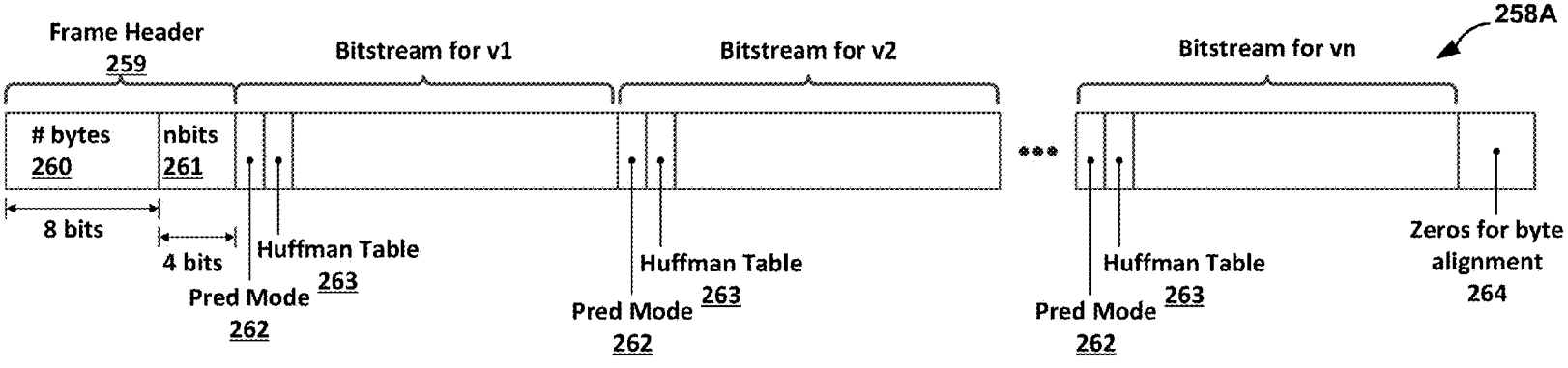

In the example of FIG. 7B, the portion 258A represents a portion of the side-information channel, where the portion 258A includes a frame header 259 that includes a number of bytes field 260 and an nbits field 261. The number of bytes field 260 may represent a field to express the number of bytes included in the frame for specifying spatial components v1 through vn including the zeros for byte alignment field 264. The nbits field 261 represents a field that may specify the nbits value identified for use in decompressing the spatial components v1-vn.

As further shown in the example of FIG. 7B, the portion 258A may include sub-bitstreams for v1-vn, each of which includes a prediction mode field 262, a Huffman Table information field 263 and a corresponding one of the compressed spatial components v1-vn. The prediction mode field 262 may represent a field to store an indication of whether prediction was performed with respect to the corresponding one of the compressed spatial components v1-vn. The Huffman table information field 263 represents a field to indicate, at least in part, which Huffman table is to be used to decode various aspects of the corresponding one of the compressed spatial components v1-vn.

In this respect, the techniques may enable audio encoding device 20 to obtain a bitstream comprising a compressed version of a spatial component of a soundfield, the spatial component generated by performing a vector-based synthesis with respect to a plurality of spherical harmonic coefficients.

Figure 7C:
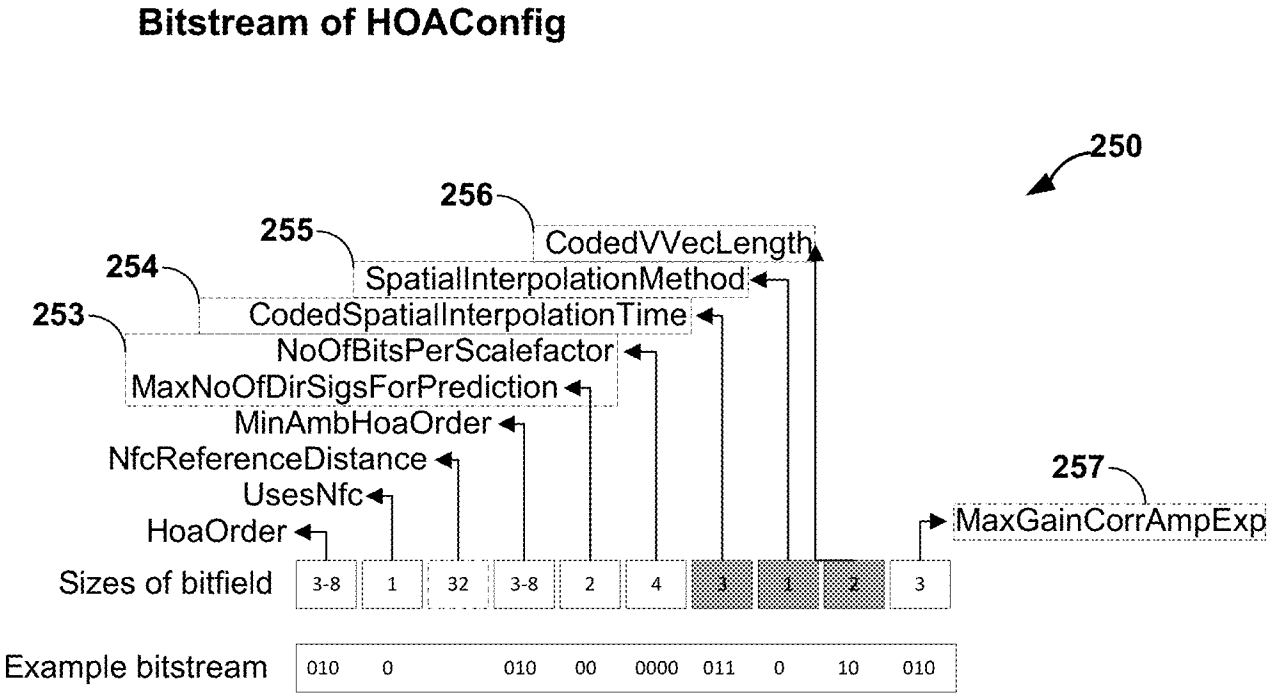
Figure 7D:
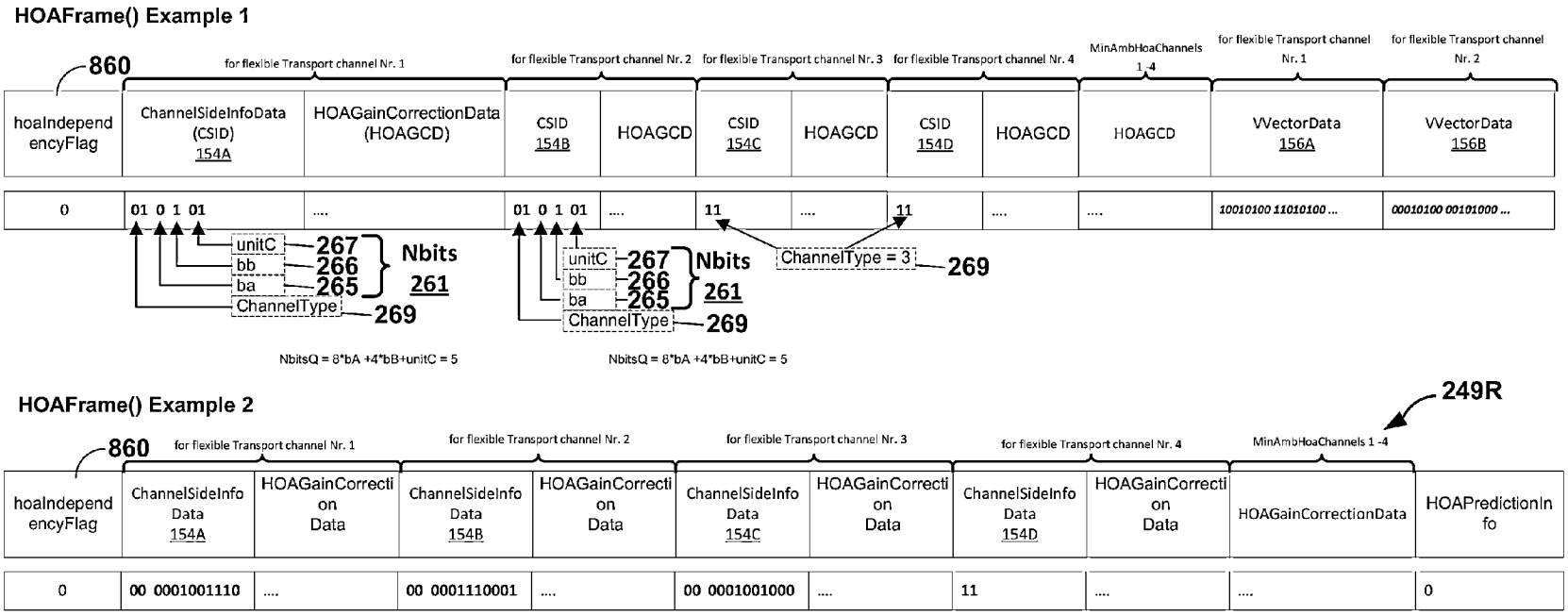

FIG. 7C is a diagram illustrating a portion 250 of the bitstream 21. The portion 250 shown in the example of FIG. 7C, includes an HOAOrder field (which was not shown in the example of FIG. 7A for ease of illustration purposes), a MinAmbHOAorder field (which again was not shown in the example of FIG. 7A for ease of illustration purposes), the direction info field 253, the CodedSpatialInterpolationTime field 254, the SpatialInterpolationMethod field 255, the CodedVVecLength field 256 and the gain info field 257. As shown in the example of FIG. 7C, the CodedSpatialInterpolationTime field 254 may comprise a three bit field, the SpatialInterpolationMethod field 255 may comprise a one bit field, and the CodedVVecLength field 256 may comprise two bit field. FIG. 7D is a diagram illustrating example frames 249Q and 249R specified in accordance with various aspects of the techniques described in this disclosure. As shown in the example of FIG. 7D, frame 249Q includes ChannelSideInfoData (CSID) fields 154A-154D, HOAGainCorrectionData (HOAGCD) fields, VVectorData fields 156A and 156B and HOAPredictionInfo fields. The CSID field 154A includes a unitC syntax element ("unitC") 267, a bb syntax element ("bb") 266 and a ba syntax element ("ba") 265 along with a ChannelType syntax element ("ChannelType") 269, each of which are set to the corresponding values 01, 1, 0 and 01 shown in the example of FIG. 7D. The CSID field 154B includes the unitC 267, bb 266 and ba 265 along with the ChannelType 269, each of which are set to the corresponding values 01, 1, 0 and 01 shown in the example of FIG. 7D. Each of the CSID fields 154C and 154D includes the ChannelType field 269 having a value of 3 ($11_2$). Each of the CSID fields 154A-154D corresponds to the respective one of the transport channels 1, 2, 3 and 4. In effect, each CSID field 154A-154D indicates whether a corresponding payload are direction-based signals (when the corresponding ChannelType is equal to zero), vector-based signals (when the corresponding ChannelType is equal to one), an additional Ambient HOA coefficient (when the corresponding ChannelType is equal to two), or empty (when the ChannelType is equal to three).

In the example of FIG. 7D, the frame 249Q includes two vector-based signals (given the ChannelType 269 equal to 1 in the CSID fields 154A and 154B) and two empty (given the ChannelType 269 equal to 3 in the CSID fields 154C and 154D). Given the forgoing HOAconfig portion 250, the audio decoding device 24 may determine that all 16 V-vector elements are encoded. Hence, the VVectorData 156A and 156B each includes all 16 vector elements, each of them uniformly quantized with 8 bits. The number and indices of coded VVectorData elements are specified by the parameter CodedVVecLength=0. Moreover, the coding scheme is signaled by NbitsQ=5 in the CSID field for the corresponding transport channel.

Frames 249Q and 249R also include an HOA independency flag ("hoaIndependencyFlag") 860. The HOA independency flag 860 represents a field that specifies whether the frame is an immediate playout frame. When the value of the field 860 is set to one, the frames 249Q and/or 249R may be independently decodable without reference to other frames (meaning, no prediction may be required to decode the frame). When the value of the field 860 is set to zero, the frames 249Q and/or 249R may not be independently decodable (meaning, that prediction of various values described above may be predicted from other frames). Moreover, as shown in the example of FIG. 7D, the frame 249Q does not include an HOAPredictionInfo field. Accordingly, the HOAPredictionInfo field may represent an optional field in the bitstream.

Figure 7E:
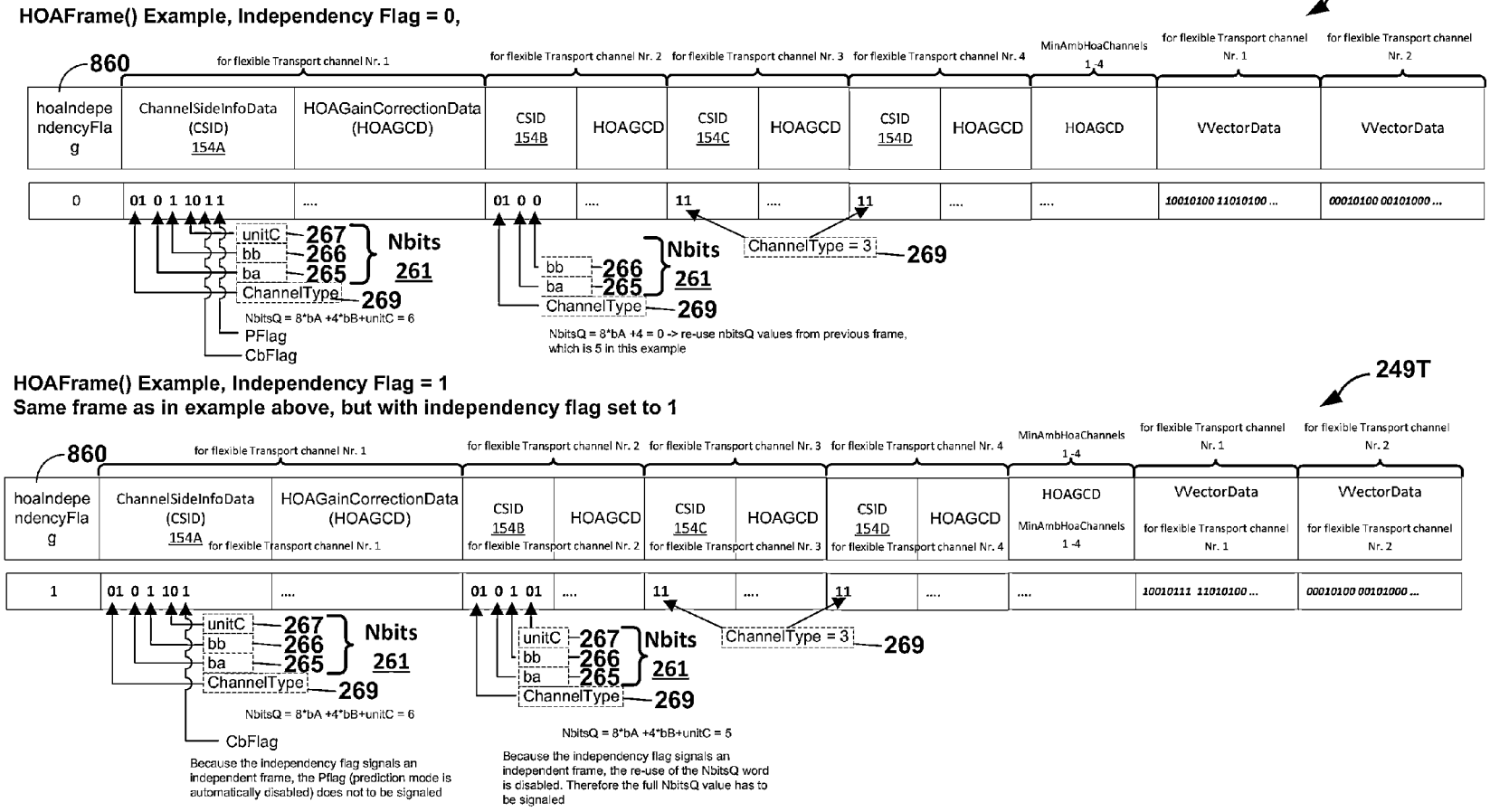

FIG. 7E is a diagram illustrating example frames 249S and 249T specified in accordance with various aspects of the techniques described in this disclosure. Frame 249S may be similar to frame 249Q, except that frame 249S may represent an example where the HOA independency flag 860 is set zero and prediction occurs with respect to the unitC portion of the Nbits syntax element for transport number 2 is re-used from the previous frame (which is assumed to be 5 in the example of FIG. 7E. Frame 249T may also be similar to frame 249Q, except that frame 249T has a value of one for the HOA independency flag 860. In this example, it is assumed that the unitC portion of the Nbits Q value could have been re-used from the previous frame as in the example of frame 249S. However, because the HOA independency flag (which may also be denoted as a syntax element) is set to one, the audio encoding device 20 specifies the entire Nbits syntax element 261 for the second transport channel so that frame 249S may be independently decoded without reference to previous values (e.g., the unitC portion of the Nbits field 261 from the previous frame).

Also, because the HOA independency flag is set to one (meaning the frame 249T is to be independently decodable without reference to previous frames), the audio encoding device 20 may not signal the prediction flag used for scalar quantization as no prediction is allowed for independently decodable frames (which may represent another way to refer to the "immediate playout frames" discussed in this disclosure). When the HOA independency flag syntax element 860 is set to one in other words, the audio encoding device 20 need not signal the prediction flag as the audio decoding device 24 may determine, based on the value of the HOA independency flag syntax element 860, that prediction for scalar quantization purposes has been disabled.

Figure 7F:
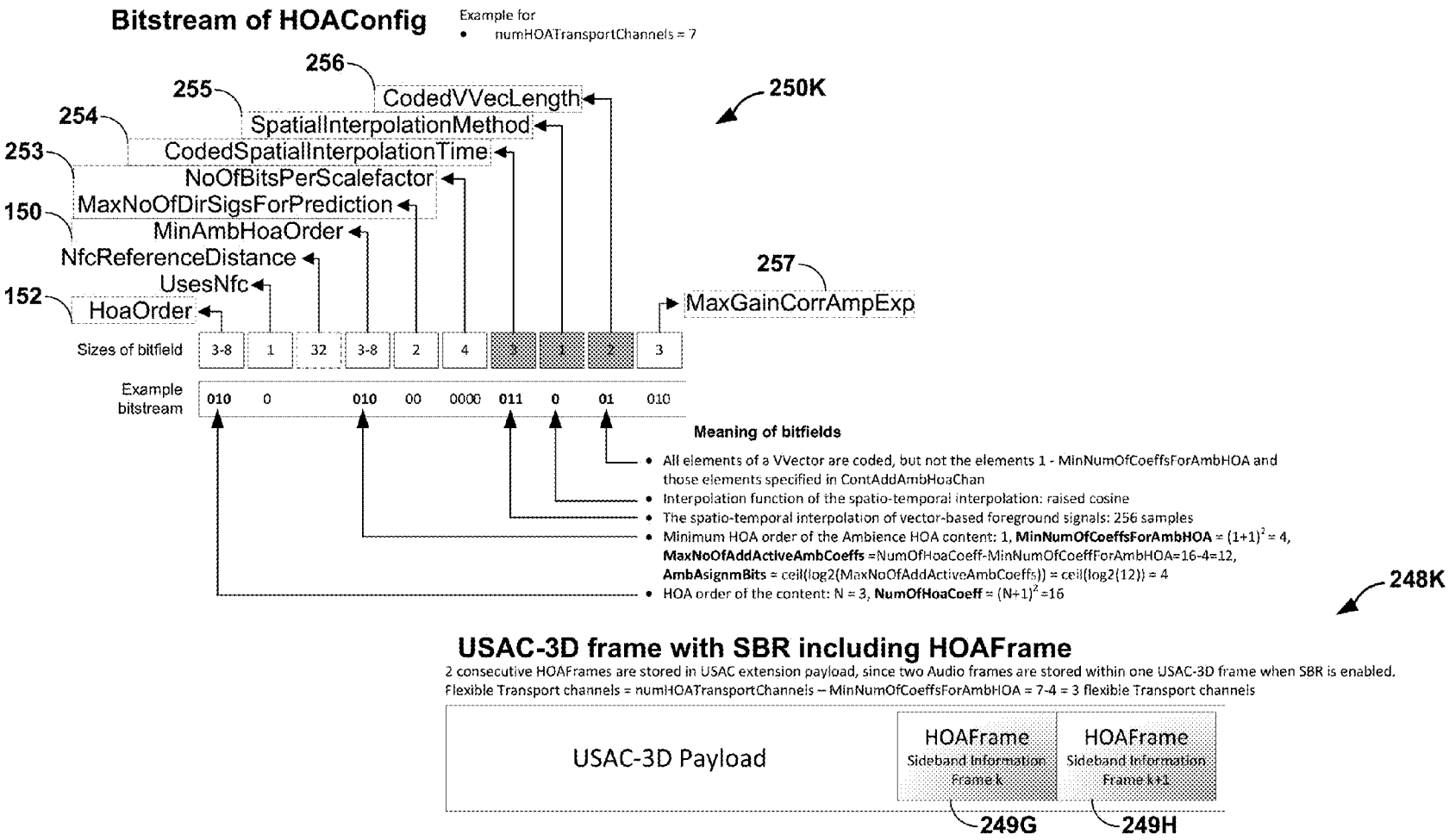

FIG. 7F is a diagram illustrating a second example bitstream 248K and accompanying HOA config portion 250K having been generated to correspond with case 1 in the above pseudo-code. In the example of FIG. 7F, the HOAconfig portions 250K includes a CodedVVecLength syntax element 256 set to indicate that all elements of a V-vector are coded, except for the elements 1 through a MinNumOfCoeffsForAmbHOA syntax elements and the elements specified in a ContAddAmbHoaChan syntax element (assumed to be one in this example). The HOAconfig portion 250K also includes a SpatialInterpolationMethod syntax element 255 set to indicate that the interpolation function of the spatio-temporal interpolation is a raised cosine. The HOAconfig portion 250K moreover includes a CodedSpatialInterpolationTime 254 set to indicate an interpolated sample duration of 256.

The HOAconfig portion 250K further includes a MinAmbHOAorder syntax element 150 set to indicate that the MinimumHOA order of the ambient HOA content is one, where the audio decoding device 24 may derive a MinNumofCoeffsForAmbHOA syntax element to be equal to $(1+1)^2$ or four. The audio decoding device 24 may also derive a MaxNoOfAddActiveAmbCoeffs syntax element as set to a difference between the NumOfHoaCoeff syntax element and the MinNumOfCoeffsForAmbHOA, which is assumed in this example to equal 16-4 or 12. The audio decoding device 24 may also derive an AmbAsignmBits syntax element as set to ceil(log 2(MaxNoOfAddActiveAmbCoeffs))=ceil(log 2(12))=4. The HOAconfig portion 250K includes an HoaOrder syntax element 152 set to indicate the HOA order of the content to be equal to three (or, in other words, N=3), where the audio decoding device 24 may derive a NumOfHoaCoeffs to be equal to $(N+1)^2$ or 16.

As further shown in the example of FIG. 7F, the portion 248K includes a USAC-3D audio frame in which two HOA frames 249G and 249H are stored in a USAC extension payload given that two audio frames are stored within one USAC-3D frame when spectral band replication (SBR) is enabled. The audio decoding device 24 may derive a number of flexible transport channels as a function of a numHOATransportChannels syntax element and a MinNumOfCoeffsForAmbHOA syntax element. In the following examples, it is assumed that the numHOATransportChannels syntax element is equal to 7 and the MinNumOfCoeffsForAmbHOA syntax element is equal to four, where number of flexible transport channels is equal to the numHOATransportChannels syntax element minus the MinNumOfCoeffsForAmbHOA syntax element (or three).

FIG. 7G is a diagram illustrating the frames 249G and 249H in more detail. As shown in the example of FIG. 7G, the frame 249G includes CSID fields 154A-154C and VVectorData fields 156. The CSID field 154 includes the CodedAmbCoeffIdx 246, the AmbCoeffIdxTransition 247 (where the double asterisk () indicates that, for flexible transport channel Nr. 1, the decoder's internal state is here assumed to be AmbCoeffIdxTransitionState=2, which results in the CodedAmbCoeffIdx bitfield is signaled or otherwise specified in the bitstream), and the ChannelType 269 (which is equal to two, signaling that the corresponding payload is an additional ambient HOA coefficient). The audio decoding device 24 may derive the AmbCoeffIdx as equal to the CodedAmbCoeffIdx+1+MinNumOfCoeffsForAmbHOA or 5 in this example. The CSID field 154B includes unitC 267, bb 266 and ba265 along with the ChannelType 269**, each of which are set to the corresponding values 01, 1, 0 and 01 shown in the example of FIG.

10K(ii). The CSID field 154C includes the ChannelType field 269 having a value of 3.

In the example of FIG. 7G, the frame 249G includes a single vector-based signal (given the ChannelType 269 equal to 1 in the CSID fields 154B) and an empty (given the ChannelType 269 equal to 3 in the CSID fields 154C). Given the forgoing HOAconfig portion 250K, the audio decoding device 24 may determine that 11 V-vector elements are encoded (where 12 is derived as $(HOAOrder+1)^2-(MinNumOfCoeffsForAmbHOA)-(ContAddAmbHoaChan)=16-4-1=11$). Hence, the VVectorData 156 includes all 11 vector elements, each of them uniformly quantized with 8 bits. As noted by the footnote 1, the number and indices of coded VVectorData elements are specified by the parameter CodedVVecLength=0. Moreover, as noted by the footnote 2, the coding scheme is signaled by NbitsQ=5 in the CSID field for the corresponding transport channel.

In the frame 249H, the CSID field 154 includes an AmbCoeffIdxTransition 247 indicating that no transition has occurred and therefore the CodedAmbCoeffIdx 246 may be implied from the previous frame and need not be signaled or otherwise specified again. The CSID field 154B and 154C of the frame 249H are the same as that for the frame 249G and thus, like the frame 249G, the frame 249H includes a single VVectorData field 156, which includes 10 vector elements, each of them uniformly quantized with 8 bits. The audio encoding device 20 only specifies 10 vector elements because the ambient HOA coefficient specified in transport channel number one is no longer in transition and as a result the number of ContAddAmbHoaChan is equal to two. Accordingly, the audio encoding device 20 determines that the number of V-vector elements to specify are $(HOAOrder+1)^2-(MinNumOfCoeffsForAmbHOA)-(ContAddAmbHoaChan)=16-4-2=10$.

While the example of FIGS. 7F and 7G represent the bitstream 21 constructed in accordance with one of the coded modes for the V-vector, various other examples of the bitstream 21 may be constructed in accordance with the other coding modes for the V-vector. The additional examples are discussed in more detail with respect to the above noted publication no. WO 2014/194099.

Figure 7H:
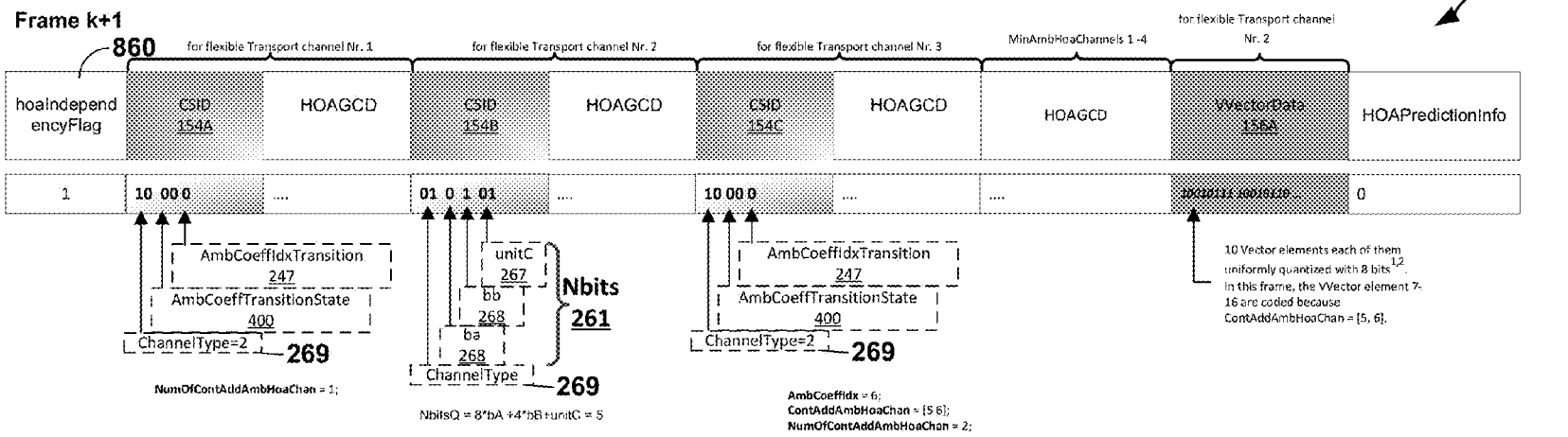

FIG. 7H is a diagram illustrating alternative example of the frame 249H where the hoaIndependencyFlag is set to one in accordance with various aspects of the techniques described in this disclosure. The alternative frame of 249H is denoted as the frame 249H'. When the HOAIndependencyFlag syntax element 860 is set to one, the frame 249H' may represent an immediate playout frame (IPF) as discussed in more detail below. As a result, the audio encoding device 20 may specify additional syntax elements in CSID FIELD 154A and 154C. The additional syntax elements may provide state information maintained by the audio decoding device 24 based on past syntax elements. However, in the context of the IPF 249H', the audio decoding device 24 may not have the state information. As a result, the audio encoding device 20 specifies the AmbCoeffTransitionState syntax element 400 in the CSID FIELD 154A and 154C to allow the audio decoding device 24 to understand the current transition being signaled by AmbCoeffIdxTransition syntax element 247 of each of CSID FIELD 154A and 154C.

Figure 7I:
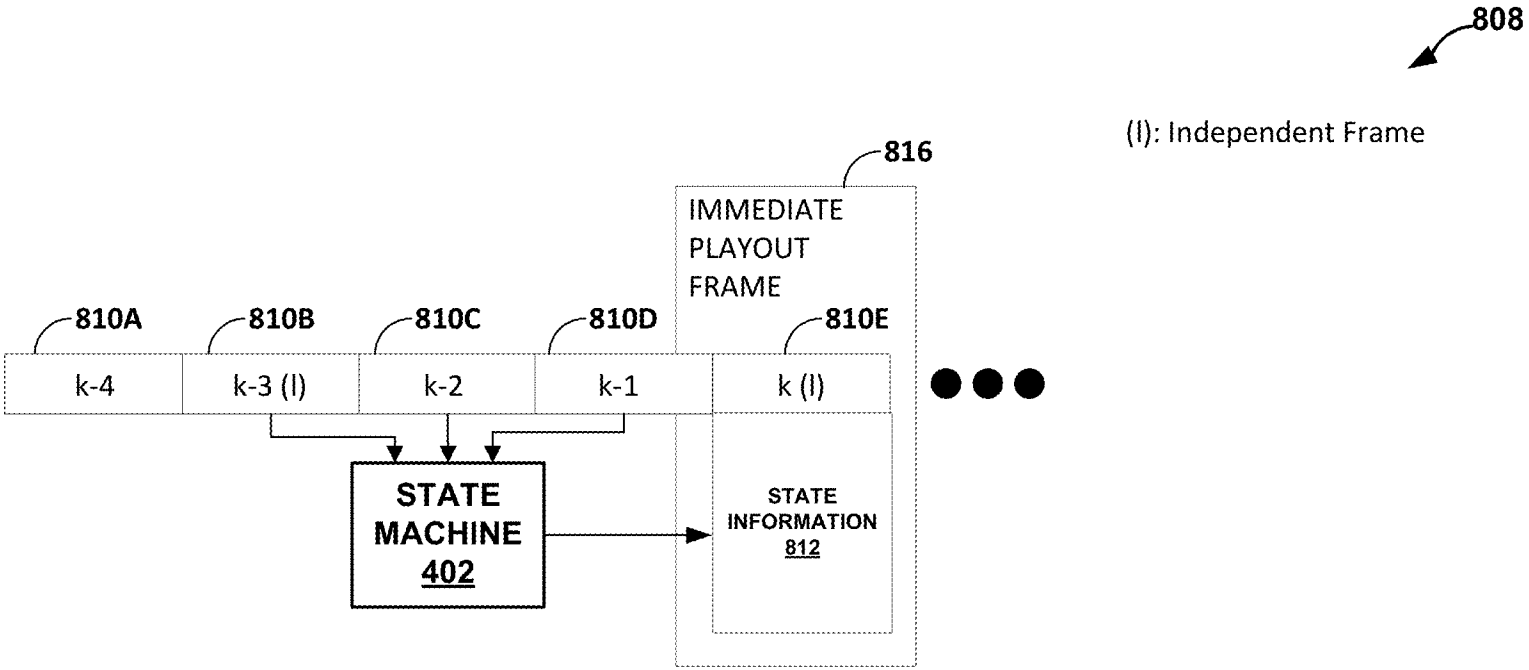

FIG. 7I is a diagram illustrating example frames for one or more channels of at least one bitstream in accordance with techniques described herein. Bitstream 808 includes frames 810A-810E that may each include one or more channels, and the bitstream 808 may represent any combination of bitstreams 21 modified according to techniques described herein in order to include IPFs. Frames 810A-810E may be included within respective access units and may alternatively be referred to as "access units 810A-810E."

In the illustrated example, an Immediate Play-out Frame (IPF) 816 includes independent frame 810E as well as state information from previous frames 810B, 810C, and 810D represented in the IPF 816 as state information 812. That is, the state information 812 may include state maintained by a state machine 402 from processing previous frames 810B, 810C, and 810D represented in the IPF 816. The state information 812 may be encoded within the IPF 816 using a payload extension within the bitstream 808. The state information 812 may compensate the decoder start-up delay to internally configure the decoder state to enable correct decoding of the independent frame 810E. The state information 812 may for this reason be alternatively and collectively referred to as "pre-roll" for independent frame 810E. In various examples, more or fewer frames may be used by the decoder to compensate the decoder start-up delay, which determines the amount of the state information 812 for a frame. The independent frame 810E is independent in that the frames 810E is independently decodable. As a result, frame 810E may be referred to as "independently decodable frame 810." Independent frame 810E may as a result constitute a stream access point for the bitstream 808.

The state information 812 may further include the HOAconfig syntax elements that may be sent at the beginning of the bitstream 808. The state information 812 may, for example, describe the bitstream 808 bitrate or other information usable for bitstream switching or bitrate adaption. Another example of what a portion of the state information 814 may include is the HOAConfig syntax elements shown in the example of FIG. 7C. In this respect, the IPF 816 may represent a stateless frame, which may not in a manner of speaker have any memory of the past. The independent frame 810E may, in other words, represent a stateless frame, which may be decoded regardless of any previous state (as the state is provided in terms of the state information 812).

The audio encoding device 20 may, upon selecting frame 810E to be an independent frame, perform a process of transitioning the frame 810E from a dependently decodable frame to an independently decodable frame. The process may involve specifying state information 812 that includes the transition state information in the frame, the state information enabling the bitstream of the encoded audio data of the frame to be decoded and played without reference to previous frames of the bitstream.

A decoder, such as the decoder 24, may randomly access bitstream 808 at IPF 816 and, upon decoding the state information 812 to initialize the decoder states and buffers (e.g. of the decoder-side state machine 402), decode independent frame 810E to output compressed version of the HOA coefficients. Examples of the state information 812 may include the syntax elements specified in the following table:

| Syntax Element affected by the hoaIndependencyFlag | Syntax described in Standard | Purpose |
|---|---|---|
| NbitsQ | Syntax of ChannelSideInfoData | Quantization of V-vector |
| PFlag | Syntax of ChannelSideInfoData | Huffman coding of V-vector |

-continued

| Syntax Element affected by the hoaIndependencyFlag | Syntax described in Standard | Purpose |
|---|---|---|
| AmbCoeffTransitionState | Syntax of AddAmbHoaInfoChannel | Signaling of additional HOA |
| GainCorrPrevAmpExp | Syntax of HOAGainCorrectionData | Automatic Gain Compensation module |

The decoder 24 may parse the foregoing syntax elements from the state information 812 to obtain one or more of quantization state information in the form of NbitsQ syntax element, prediction state information in the form the PFlag syntax element, and transition state information in the form of the AmbCoeffTransitionState syntax element. The decoder 24 may configure the state machine 402 with the parsed state information 812 to enable the frame 810E to be independently decoded. The decoder 24 may continue regular decoding of frames, after the decoding of the independent frame 810E.

In accordance with techniques described herein, the audio encoding device 20, may be configured to generate the independent frame 810E of IPF 816 differently from other frames 810 to permit immediate play-out at independent frame 810E and/or switching between audio representations of the same content that differ in bitrate and/or enabled tools at independent frame 810E. More specifically, the bitstream generation unit 42 may maintain the state information 812 using the state machine 402. The bitstream generation unit 42 may generate the independent frame 810E to include state information 812 used to configure the state machine 402 for one or more ambient HOA coefficients. The bitstream generation unit 42 may further or alternatively generate the independent frame 810E to differently encode quantization and/or prediction information in order to, e.g., reduce a frame size relative to the other, non-IPF frames of the bitstream 808. Again, the bitstream generation unit 42 may maintain the quantization state in the form of the state machine 402. In addition, the bitstream generation unit 42 may encode each frame of the frames 810A-810E to include a flag or other syntax element that indicates whether the frame is an IPF. The syntax element may be referred to elsewhere in this disclosure as an IndependencyFlag or an HOAIndependencyFlag.

In this respect, various aspects of the techniques may enable, as one example, the bitstream generation unit 42 of the audio encoding device 20 to specify, in a bitstream (such as the bitstream 21) that includes a higher-order ambisonic coefficient (such as one of the ambient higher-order ambisonic coefficients 47', transition information 757 (as part of the state information 812 for example) for an independent frame (such as the independent frame 810E in the example of FIG. 7I) for the higher-order ambisonic coefficient 47'. The independent frame 810E may include additional reference information (which may refer to the state information 812) to enable the independent frame to be decoded and immediately played without reference to previous frames (e.g., the frames 810A-810D) of the higher-order ambisonic coefficient 47'. While described as being immediately or instantaneously played, the term immediately or instantaneously refers to nearly immediately, subsequently or nearly instantaneously played and is not intended to refer to literal definitions of "immediately" or "instantaneously." Moreover, use of the terms is for purposes of adopting language used throughout various standards, both current and emerging.

In these and other instances, the transition information 757 specifies whether the higher-order ambisonic coefficient 47' is faded-out. As noted above, the transition information 757 may identify whether the higher-order ambisonic coefficient 47' is being faded-out or faded-in and as such whether the higher-order ambisonic coefficient 47' is used to represent various aspects of the soundfield. In some instances, the bitstream generation unit 42 specifies the transition information 757 as various syntax elements. In these and other instances, the transition information 757 comprises an AmbCoeffWasFadedIn flag or an AmbCoeffTransitionState syntax element for the higher-order ambisonic coefficient 47' to specify whether the higher-order ambisonic coefficient 47' is to be faded-out for a transition. In these and other instances, the transition information specifies that the higher-order ambisonic coefficient 47' is in transition.

In these and other instances, the transition information 757 comprises an AmbCoeffIdxTransition flag to specify that the higher-order ambisonic coefficient 47' is in transition.

In these and other instances, the bitstream generation unit 42 may further be configured to generate a vector-based signal representative of one or more distinct components of the sound field that includes an element of a vector (such as one of the reduced foreground V[k] vectors 55) corresponding to the higher-order ambisonic coefficient 47'. The vector 55 may describe spatial aspects of a distinct component of the sound field and may have been decomposed from higher-order ambisonic coefficients 11 descriptive of the sound field, wherein the frame comprises the vector-based signal.

In these and other examples, the bitstream generation unit 42 may further be configured to output the frame via a streaming protocol.

Various aspects of the techniques may also, in some example, enable the bitstream generation unit 42 to specify, in a bitstream 21 that includes a higher-order ambisonic coefficient 47', whether a frame for the higher-order ambisonic coefficient 47' is an independent frame (e.g., by specifying the HOAIndependencyFlag syntax element) that includes additional reference information (e.g., the state information 812) to enable the frame to be decoded and immediately played without reference to previous frames 810A-810D of the higher-order ambisonic coefficient 47'. The bitstream generation unit 42 may also specify, in the bitstream 21 and only when the frame is not an independent frame, prediction information (e.g., Pflag syntax element) for the frame for decoding the frame with reference to a previous frame of the higher-order ambisonic coefficient 47'.

In these and other examples, the bitstream generation unit 42 is further configured to specify, in the bitstream 21 and when the frame is an independent frame, quantization information (e.g., the NbitsQ syntax element) the for the frame sufficient to enable the frame to be decoded and immediately played without reference to quantization information for previous frames of the higher-order ambisonic coefficient 47'. The bitstream generation unit 42 may also specify, in the bitstream 21 and if the frame is not an independent frame, quantization information for the frame that is insufficient to enable the frame to be decoded and immediately played without reference to quantization information for previous frames of the higher-order ambisonic coefficient 47'.

In these and other examples, the quantization information for the frame includes an Nbits syntax element for the frame sufficient to enable the frame to be decoded and immediately played without reference to quantization information for previous frames of the higher-order ambisonic channel.

In these and other examples, the bitstream generation unit 42 is further configured to generate a vector-based signal representative of one or more distinct components of the sound field that includes an element of a vector (such as the vector 55) corresponding to the higher-order ambisonic coefficient 47', the vector describing spatial aspects of a distinct component of the sound field and having been decomposed from higher-order ambisonic coefficients 11 descriptive of the sound field. The frame, in this example, comprises the vector-based signal.

In these and other examples, the bitstream generation unit 42 is further configured to output the frame via a streaming protocol.

Various aspects of the techniques may also, in some example, enable the bitstream generation unit 42 to specify, in a bitstream 21 that includes a higher-order ambisonic coefficient 47', that a frame for the higher-order ambisonic coefficient 47' is an independent frame that includes additional reference information to enable the frame to be decoded and immediately played without reference to previous frames of the higher-order ambisonic coefficient 47'.

In these and other examples, the bitstream generation unit 42 is configured to, when specifying that the frame for the higher-order ambisonic coefficient 47' is an independent frame 810E, signal, in the bitstream 21, an IndependencyFlag syntax element that indicates the frame is an independent frame 810E.

Moreover, various aspects of the techniques may enable the audio decoding device 24 to be configured to obtain, using a bitstream 21 that includes a higher-order ambisonic coefficient 47, transition information (such as the transition information 757 shown in the example of FIG. 4) for an independent frame for the higher-order ambisonic coefficient 47'. The independent frame may include state information 812 to enable the independent frame to be decoded and played without reference to previous frames of the higher-order ambisonic coefficient 47'.

In these and other instances, the transition information 757 specifies whether the higher-order ambisonic coefficient 47' is to be faded-out for a transition.

In these and other instances, the transition information 757 comprises an AmbCoeffWasFadedIn flag for the higher-order ambisonic channel to specify whether the higher-order ambisonic coefficient 47' is to be faded-out for a transition.

In these and other instances, the audio decoding device 24 may be configured to determine the transition information 757 specifies the higher-order ambisonic coefficient 47' is to be faded-out for a transition. The audio decoding device 24 may also be configured to, in response to determining the transition information 757 specifies the higher-order ambisonic coefficient 47' is to be faded-out for a transition, perform a fade-out operation with respect to the higher-order ambisonic coefficient 47'.

In these and other instances, the transition information 757 specifies that the higher-order ambisonic coefficient 47' is in transition.

In these and other instances, the transition information 757 comprises an AmbCoeffTransition flag to specify that the higher-order ambisonic coefficient 47' is in transition.

In these and other instances, the audio decoding device 24 may be configured to obtain a vector-based signal representative of one or more distinct components of the sound field that includes an element of a vector $\mathbf{55}_k$" corresponding to the higher-order ambisonic coefficient 47'. The vector 55*k*" may, as noted above, describe spatial aspects of a distinct component of the sound field and may have been decomposed from higher-order ambisonic coefficients 11 descriptive of the sound field. The audio decoding device 24 may also be configured to determine that the transition information 757 specifies that the higher-order ambisonic coefficient 47' is to be faded-out. The audio decoding device 24 may also be configured to, in response to determining the transition information 757 specifies that the higher-order ambisonic coefficient 47 is to be faded-out for a transition, perform a fade-out operation with respect to the element of the vector $\mathbf{55}_k$" corresponding to the higher-order ambisonic channel 47 to fade-out the element of the vector $\mathbf{55}_k$" using the frame or a subsequent frame for the higher-order ambisonic coefficient 47'.

In these and other instances, the audio decoding device 24 may be configured to output the frame via a streaming protocol.

Various aspects of the techniques may also enable the audio decoding device 24 to be configured to determine, using a bitstream 21 that includes a higher-order ambisonic coefficient 47', whether a frame for the higher-order ambisonic coefficient 47' is an independent frame that includes additional reference information (e.g., the state information 812) to enable the frame to be decoded and played without reference to previous frames 810A-810D of the higher-order ambisonic coefficient 47'. The audio decoding device 24 may also be configured to obtain, from the bitstream 21 and only in response to determining the frame is not an independent frame, prediction information (e.g., from the state information 812) for the frame for decoding the frame with reference to a previous frame for the higher-order ambisonic coefficient 47'.

In these and other instances, the audio decoding device 24 may be configured to obtain a vector-based signal representative of one or more distinct components of the sound field that includes an element of a vector $\mathbf{55}_k$" corresponding to the higher-order ambisonic coefficient 47'. The vector $\mathbf{55}_k$" may describe spatial aspects of a distinct component of the sound field and may have been decomposed from higher-order ambisonic coefficients 11 descriptive of the sound field. The audio decoding device 24 may also be configured to decode the vector-based signal using the prediction information.

In these and other instances, the audio decoding device 24 may be configured to obtain, using the bitstream 21 and if the frame is an independent frame, quantization information (e.g., from the state information 812) for the frame sufficient to enable the frame to be decoded and played without reference to quantization information for previous frames. The audio decoding device 24 may also be configured to obtain, using the bitstream 21 and if the frame is not an independent frame, quantization information for the frame that is insufficient to enable the frame to be decoded and played without reference to quantization information for previous frames. The audio decoding device 24 may also be configured to decode the frame using the quantization information.

In these and other instances, the quantization information for the frame includes an Nbits syntax element for the frame sufficient to enable the frame to be decoded and played without reference to quantization information for previous frames.

In these and other instances, the audio decoding device 24 may be configured to output the frame via a streaming protocol.

Various aspects of the techniques may further enable the audio decoding device 24 to be configured to determine, using a bitstream 21 that includes a higher-order ambisonic coefficient 47', that a frame for the higher-order ambisonic coefficient 47' is an independent frame that includes additional reference information (e.g., the state information 812) to enable the frame to be decoded and played without reference to previous frames.

In these and other instances, when determining that the frame for the higher-order ambisonic channel is an independent frame, the audio decoding device 24 may obtain, using the bitstream 21, an IndependencyFlag syntax element that indicates the frame is an independent frame.

Figure 7J:
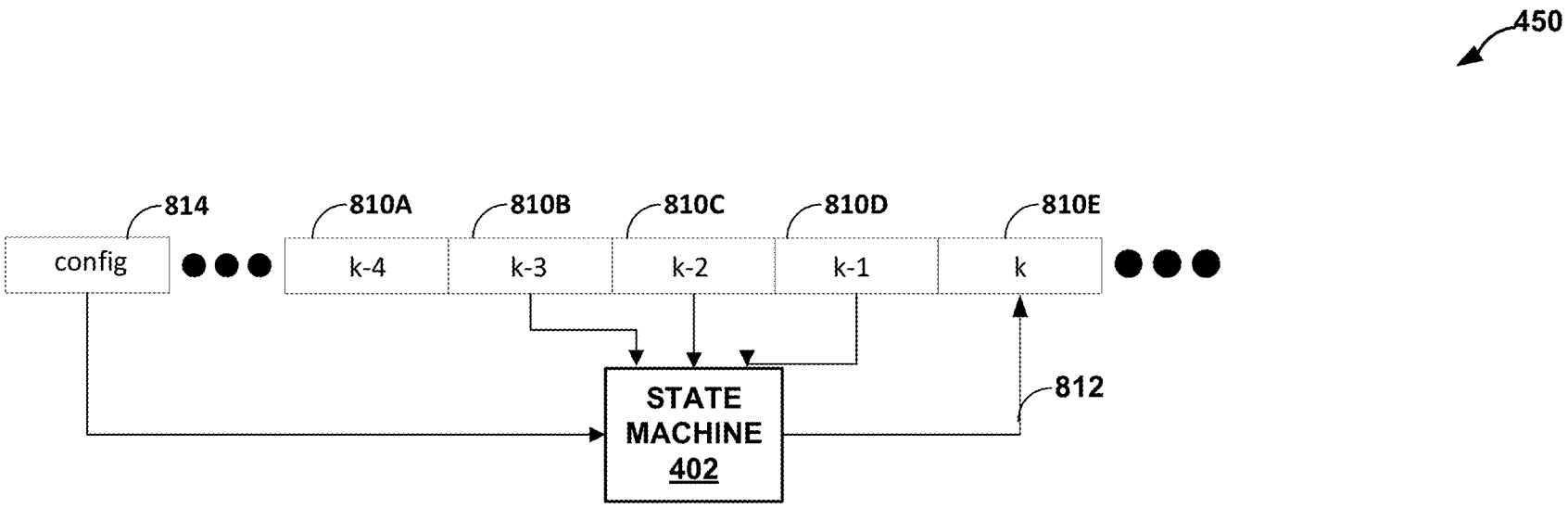

FIG. 7J is a diagram illustrating example frames for one or more channels of at least one bitstream in accordance with techniques described herein. The bitstream 450 includes frames 810A-810H that may each include one or more channels. The bitstream 450 may represent any combination of bitstreams 21 shown in the examples of FIGS. 7A-7H. The bitstream 450 may be substantially similar to the bitstream 808 except that the bitstream 450 does not include IPFs. As a result, the audio decoding device 24 maintains state information, updating the state information to determine how to decode the current frame k. The audio decoding device 24 may utilize state information from config 814, and frames 810B-810D. The difference between frame 810E and the IPF 816 is that the frame 810E does not include the foregoing state information while the IFP 816 includes the foregoing state information.

In other words, the audio encoding device 20 may include, within the bitstream generation unit 42 for example, the state machine 402 that maintains state information for encoding each of frames 810A-810E in that the bitstream generation unit 42 may specify syntax elements for each of frames 810A-810E based on the state machine 402.

The audio decoding device 24 may likewise include, within the bitstream extraction unit 72 for example, a similar state machine 402 that outputs syntax elements (some of which are not explicitly specified in the bitstream 21) based on the state machine 402. The state machine 402 of the audio decoding device 24 may operate in a manner similar to that of the state machine 402 of the audio encoding device 20. As such, the state machine 402 of the audio decoding device 24 may maintain state information, updating the state information based on the config 814 and, in the example of FIG. 7J the decoding of the frames 810B-810D. Based on the state information, the bitstream extraction unit 72 may extract the frame 810E based on the state information maintained by the state machine 402. The state information may provide a number of implicit syntax elements that the audio encoding device 20 may utilize when decoding the various transport channels of the frame 810E.

Figure 8:
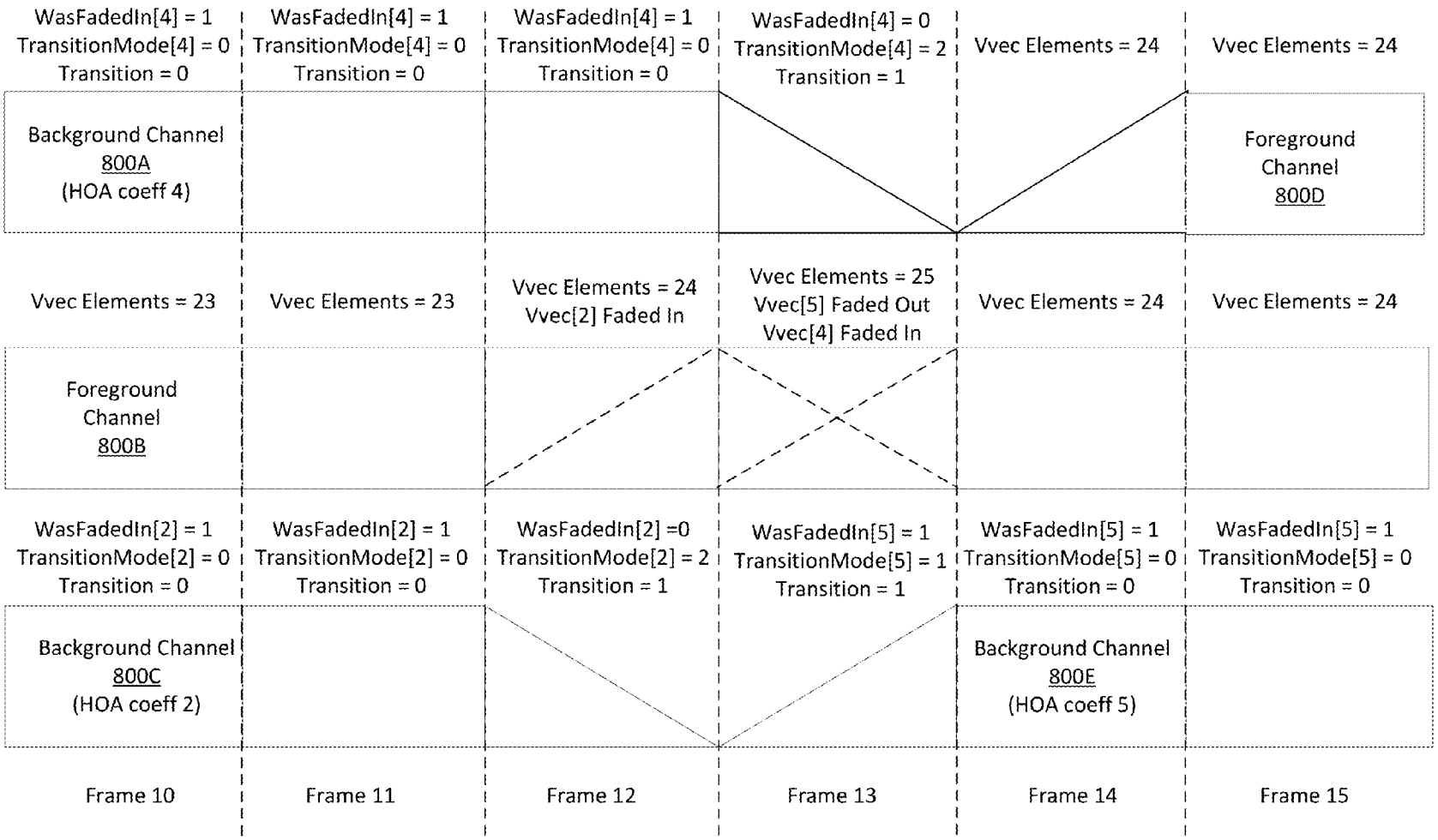
FIG. 8 is a diagram illustrating audio channels to which an audio decoding device may apply the techniques described in this disclosure.

FIG. 8 is a diagram illustrating audio channels 800A-800E to which an audio decoding device, such as the audio decoding device 24 shown in the example of FIG. 4, may apply the techniques described in this disclosure. As shown in the example of FIG. 8, the background channel 800A represents ambient HOA coefficients that are the fourth of the $(n+1)^2$ possible HOA coefficients. The foreground channels 800B and 800D represent a first V-vector and a second V-vector, respectively. The background channel 800C represents ambient HOA coefficients that are the second of the $(n+1)^2$ possible HOA coefficients. The background channel 800E represents ambient HOA coefficients that are the fifth of the $(n+1)^2$ possible HOA coefficients.

As further shown in the example of FIG. 8, the ambient HOA coefficient 4 in the background channel 800A undergoes a period of transition (fades out) during frame 13 while the elements of a vector in the foreground channel 800D fade in during frame 14 to replace the ambient HOA coefficient 4 in the background channel 800A during decoding of the bitstream. Reference to the term "replacing" in the context of one of channels 800A-800E replacing another one of channels 800A-800E refers to the example where the audio encoding device 20 generates the bitstream 21 to have flexible transport channels.

To illustrate, each of the three rows in FIG. 8 may represent a transport channel. Each of the transport channels may be referred to as a background channel or a foreground channel depending on the type of encoded audio data the transport channel is currently specifying. For example, when the transport channel is specifying one of the minimum ambient HOA coefficients or an additional ambient HOA coefficient, the transport channel may be referred to as a background channel. When the transport channel is specifying a V-vector, the transport channel may be referred to as a foreground channel. The transport channel may therefore refer to both background and foreground channels. The foreground channel 800D may, in this respect, be described as replacing the background channel 800A at frame 14 of the first transport channel. The background channel 800E may also be described as replacing the background channel 800C at frame 13 in the third transport channel. Although described with respect to three transport channels, the bitstream 21 may include any number of transport channels, including zero transport channels to two, three or even more transport channels. The techniques therefore should not be limited in this respect.

In any event, the example of FIG. 8 also generally shows the elements of the vector of the foreground channel 800B change in frames 12, 13 and 14 as described in more detail below, and the vector length changes during the frames. The ambient HOA coefficient 2 in the background channel 800C undergoes a transition during frame 12. The ambient HOA coefficient 5 background channel 800E undergoing a transition (fades in) during frame 13 to replace the ambient HOA coefficient 2 in background channel 800C during decoding of the bitstream.

During the above described periods of transition, the audio encoding device 20 may specify the AmbCoeffTransition flag 757 in the bitstream with a value of one for each of channels 800A, 800C, 800D and 800E to indicate that each of the respective ambient channels 800A, 800C and 800E are transitioning in respective frames 13, 12 and 13. Given the previous state of the AmbCoeffTransitionMode, the audio encoding device 20 may therefore provide the AmbCoeffTransition flag 757 to the audio decoding device 24 so as to indicate that the respective coefficient is either transitioning out (or, on other words, fading out) of the bitstream or transitioning into (or, in other words, fading into) the bitstream.

The audio decoding device 24 may then operate as discussed above to identify the channels 800 in the bitstream and perform either the fade-in or fade-out operation as discussed below in more detail.

Moreover, as a result of the fade-in and fade-out of the various ambient channels 800A, 800C and 800E, in certain vector quantization, the audio encoder device 20 may specify the V-vector in the foreground channels 800B and 800D using a reduced number of elements as described above with respect to the audio encoding device 20 shown in the example of FIG. 3. The audio decoding device 24 may operate with respect to four different reconstruction modes, one of which may involve the reduction of the V-vector elements when energy from that element has been incorporated into the underlying ambient HOA coefficient. The foregoing may be generally represented by the following pseudo-code:

```
%% filling buffer from audio frame
fgVecBuf(:,transportChannelsWithDistinctComponents) =
audioFrame(:,transportChannelsWithDistinctComponents);
%% 1. Reconstructing newly introduced distinct components (if any)
if ~isempty(newTransportChannelsWithDistinctComponents)
    fgVecInterpBuf =
    fgVecBuf(1:lengthInterp,newTransportChannelsWithDistinctComponents) *
    vBuf(newTransportChannelsWithDistinctComponents,:);
end
%% 2. reconstructing continuous distinct components (if any) and apply spatio-
temporal interpolation
if ~isempty(commonTransportChannelsWithDistinctComponents)
    for uiChanIdx =
        transportChannelsWithDistinctComponents(
        commonTransportChannelsWithDistinctComponents)
        oldHOA = fgVecBuf(1:lengthInterp,uiChanIdx) *
        vBuf_prevFrame(uiChanIdx,:);
        newHOA = fgVecBuf(1:lengthInterp,uiChanIdx) * vBuf(uiChanIdx,:);
        fgVecInterpBuf = fgVecInterpBuf + (oldHOA.*crossfadeOut) +
        (newHOA.*crossfadeIn);
    end
end
reconstructedHoaFrame(startIdx:startIdx+lengthInterp−1,:) = fgVecInterpBuf;
reconstructedHoaFrame(startIdx+lengthInterp:stopIdx,:) =
fgVecBuf(lengthInterp+1:end,transportChannelsWithDistinctComponents)*vBuf(transport
ChannelsWithDistinctComponents,:);
% check if there are transitional ambient HOA coefficients present in the frame,
applying fade-in/fade-out
if ~isempty(transportChannelsWithFadeInHoa)
    for uiTransitionalChannel =
    AmbCoeffIdx(transportChannelsWithFadeInHoa)
        reconstructedHoaFrame(:,uiTransitionalChannel) =
        reconstructedHoaFrame(:,uiTransitionalChannel) .*
        fadeOutWindowWhenHoaChannelFadeIn;
    end
end
if ~isempty(transportChannelsWithFadeOutHoa)
    for uiTransitionalChannel =
    AmbCoeffIdx(transportChannelsWithFadeOutHoa)
        reconstructedHoaFrame(:,uiTransitionalChannel) =
        reconstructedHoaFrame(:,uiTransitionalChannel) .*=
        fadeInWindowWhenHoaChannelFadeOut;
    end
end
%% 3. adding default ambient HOA coefficients
reconstructedHoaFrame(:,1:decompressionState.MinNoOfCoeffsForAmbientHOA) =
audioFrame(:, NoOfAdditionalPerceptualCoders+1:end);
%% 4. adding frame-dependent ambient HOA coefficients
reconstructedHoaFrame(:,addAmbHoaChannels) =
reconstructedHoaFrame(:,addAmbHoaChannels) +
audioFrame(:,transportChannelsWithAddAmbientHoa);
```

The foregoing pseudo-code has four different sections or reconstruction modes of operation, denoted by comments (which begin with percentage sign ("%")) followed by the number 1-4. The first section for the first reconstruction mode provides pseudo-code for reconstructing newly introduced distinct components when present. The second section for the second reconstruction mode provides pseudo-code for reconstructing continuous distinct components when present and applying spatio-temporal interpolation. In section two of the pseudo-code, there are crossfade-in and crossfade-out operations performed on the foreground V-vector interpolation buffer (fgVecInterpBuf) to fade-in new HOA coefficients and fade-out old HOA coefficients consistent with various aspects of the techniques described in this disclosure. The third section for the third reconstruction mode provides pseudo-code for adding default ambient HOA coefficients. The fourth section for the fourth reconstruction mode provides pseudo-code for adding frame-dependent HOA coefficients consistent with various aspects of the techniques described in this disclosure.

In other words, to reduce the number of transmitted V-vector elements, only the elements of the HOA soundfield that are not encoded as ambient HOA coefficients may be transmitted. In some instances, the overall number or the actual HOA coefficients of the ambient components may be dynamic to account for changes in the encoded sound field. However, for the times a background channel including the ambient HOA coefficients is faded-in or faded-out, there may be a noticeable artifact due to the change in energy.

For example, referring to FIG. 8, in frame 10 and 11 there are two background channels 800A and 800C and one foreground channel 800B. In frames 10 and 11, the V-vector specified in the foreground channel 800B may not include the upmixing coefficients for the ambient HOA coefficients 47' specified in the background channels 800A and 800C because the ambient HOA coefficients 47' specified in the background channels 800A and 800C may be directly encoded. In frame 12, the ambient HOA coefficient 47' specified in background channel 800C is, in this example, being faded-out. In other words, the audio decoding device 24 may fade-out the ambient HOA coefficient 47' specified in the background channel 800C using any type of fade, such as the linear fade-in shown in FIG. 8. That is, although shown as a linear fade-in, the audio decoding device 24 may perform any form of fade-in operations, including non-linear fade-in operations (e.g., an exponential fade-in operation). In frame 13, the ambient HOA coefficient 47' specified in the background channel 800A is, in this example, being faded-out and the ambient HOA coefficient 47' specified in the background channel 800E is, in this example, being faded-in. The bitstream 21 may signal the events when an ambient HOA coefficient 47' specified in a background channel is faded-out or faded-in, as described above. The audio decoding device 24 may similarly perform any form of fade-out operation including the linear fade-in operation shown in the example of FIG. 8 and non-linear fade-out operations.

In the example of FIG. 8, the audio encoding device 20 may maintain state information indicating a transition state for each ambient HOA coefficient specified in one of the three transport channels shown in FIG. 8 and described above. For background channel 800A, the audio encoding device 20 may maintain the AmbCoeffWasFadedIn[i] ("WasFadedIn[i]") syntax element (which may also be denoted as a state element), the AmbCoeffTransitionMode[i] ("TransitionMode[i]") syntax element (which may also be denoted as a state element) and an AmbCoeffTransition ("Transition") syntax element. The WasFadedIn[i] and the TransitionMode[i] state elements may indicate a given state of the ambient HOA coefficient specified in the channel 800A. There are three transition states, as outlined above in the HOAAddAmbInfoChannel(i) syntax table. The first transition state is no transition, which is represented by the AmbCoeffTransitionMode[i] state element being set to zero (0). The second transition state is fade-in of an additional ambient HOA coefficient, which is represented by the AmbCoeffTransitionMode[i] state element being set to one (1). The third transition state is fade-out of the additional ambient HOA coefficient, which is represented by the AmbCoeffTransitionMode[i] state element being set to two (2). The audio encoding device 20 uses the WasFadedIn[i] state element to update the TransitionMode[i] state element again as outlined above in the HOAAddAmbInfoChannel(i) syntax table.

The audio decoding device 24 may likewise maintain the AmbCoeffWasFadedIn[i] ("WasFadedIn[i]") syntax element (which may also be denoted as a state element), the AmbCoeffTransitionMode[i] ("TransitionMode[i]") syntax element (which may also be denoted as a state element) and an AmbCoeffTransition ("Transition") syntax element. Again, the WasFadedIn[i] and the TransitionMode[i] state elements may indicate a given state of the ambient HOA coefficient specified in the channel 800A. The state machine 402 (as depicted in FIG. 7J) at the audio decoding device 24 may likewise be configured to one of the three transition states, as outlined above in the example HOAAddAmbInfoChannel (i) syntax tables. Again, the first transition state is no transition, which is represented by the AmbCoeffTransition-Mode[i] state element being set to zero (0). The second transition state is fade-in of an additional ambient HOA coefficient, which is represented by the AmbCoeffTransitionMode[i] state element being set to one (1). The third transition state is fade-out of the additional ambient HOA coefficient, which is represented by the AmbCoeffTransitionMode[i] state element being set to two (2). The audio decoding device 24 uses the WasFadedIn[i] state element to update the TransitionMode[i] state element again as outlined above in the HOAAddAmbInfoChannel(i) syntax table.

Referring back to background channel 800A, the audio encoding device 20 may maintain state information (e.g., the state information 812 shown in the example of FIG. 7J), at frame 10, indicating that the WasFadedIn[i] state element is set to one and the TransitionMode[i] state element is set to zero, where i denotes the index assigned to the ambient HOA coefficient. The audio encoding device 20 may maintain the state information 812 for the purposes of determining the syntax elements (AmbCoeffTransition and, for immediate playout frames, WasFadedIn[i] or the alternative AmbCoeffIdxTransition and, for immediate playout frames, AmbCoeffTransitionState[i]) that are sent in order to allow the audio decoding device 24 to perform the fade-in or fade-out operations with respect to the ambient HOA coefficients and the elements of the V-vector of the foreground channels. Although described as maintaining the state information 812 for the purposes of generating and specifying the appropriate syntax elements, the techniques may also be performed by the audio encoding device 20 to actually transition the elements, thereby potentially removing an additional operation from being performed at the audio decoding device 24 and facilitate more efficient decoding (in terms of power efficiency, processor cycles, etc.).

The audio encoding device 20 may then determine whether the same HOA coeff 4 was specified in the previous frame 9 (not shown in the example of FIG. 8). When specified, the audio encoding device 20 may specify the Transition syntax element in the bitstream 21 with a zero value. The audio encoding device 20 may also maintain state information 812 for channel 800C that is the same as that specified for channel 800A. As a result of specifying two ambient HOA coefficients 47' having an index 2 and 4 via channels 800C and 800A, the audio encoding device 20 may specify a V-vector ("Vvec") having a total of 23 elements (for order N=4, which is $(4+1)^2-2$ or 25−2 to determine the 23 elements). The audio encoding device 20 may specify elements [1, 3, 5:25], omitting the elements that correspond to the ambient HOA coefficients 47' having an index of 2 and 4. Given that no transitions occur until frame 12, the audio encoding device 20 maintains the same state information for channels 800A and 800C during frame 11.

The audio decoding device 24 may similarly maintain state information (e.g., the state information 812 shown in the example of FIG. 7J), at frame 10, indicating that the WasFadedIn[i] state element is set to one and the TransitionMode[i] state element is set to zero. The audio decoding device 24 may maintain the state information 812 for the purposes of understating the proper transition based on the syntax elements (AmbCoeffTransition) that are sent in the bitstream 21. In other words, the audio decoding device 24 may invoke the state machine 402 to update the state information 812 based on the syntax elements specified in the bitstream 21. The state machine 812 may transition from one of the three transition states noted above to another one of the three states based on the syntax elements as described in more detail above with respect to the example HOAAddAmbInfoChannel(i) syntax tables. In other words, depending on the value of the AmbCoeffTransition syntax element signaled in the bitstream and the state information 812, the state machine 402 of the audio decoding device 24 may switch between the no-transition, fade-out and fade-in states, as described below with respect to the example frames 12, 13 and 14.

The audio decoding device 24 may therefore obtain the ambient HOA coefficients 47' having an index of 4 via the background channel 800A at frames 10 and 11. The audio decoding device 24 may also obtain the ambient HOA coefficient 47' having an index of 2 via the background channel 800C at frames 10 and 11. The audio decoding device 24 may obtain, during frame 10 and for each of the ambient HOA coefficients 47' having an index of 2 and 4, an indication indicative of whether the ambient HOA coefficients 47' having an index of 2 and 4 are in transition during frame 10. The state machine 402 of the audio decoding device 24 may further maintain the state information 812 for the ambient HOA coefficient 47' having an index of 2 in the form of the WasFadedIn[2] and the TransitionMode[2] state elements. The state machine 402 of the audio decoding device 24 may further maintain the state information 812 for the ambient HOA coefficient 47' having an index of 4 in the form of the WasFadedIn[4] and the TransitionMode[4] state elements. Given that state information for the ambient HOA coefficients 47' having the index of 2 and 4 indicate that the coefficients 47' are in a no-transition state and based on the Transition indication indicating that the ambient HOA coefficients 47' having an index of 2 and 4 are not in transition during either of frames 10 or 11, the audio decoding device 24 may determine that the reduced vector $\mathbf{55}_k$" specified in the foreground channel 800B includes vector elements [1, 3, 5:23] and omits the elements that correspond to ambient HOA coefficients 47' having an index of 2 and 4 for both of frames 10 and 11. The audio decoding device 24 may then obtain the reduced vector $\mathbf{55}_k$" from the bitstream 21 for frames 10 and 11 by, as one example, correctly parsing the 23 elements of the reduced vector $\mathbf{55}_k$".

At frame 12, the audio encoding device 20 determines that the ambient HOA coefficient having an index of 2 carried by channel 800C is to be faded-out. As such, the audio encoding device 20 may specify a transition syntax element in the bitstream 21 for channel 800C with a value of one (indicating the transition). The audio encoding device 20 may update the internal state elements WasFadedIn[2] and TransitionMode[2] for channel 800C to be zero and two, respectively. As a result of the change in state from no transition to fade-out, the audio encoding device 20 may add a V-vector element to the V-vector specified in foreground channel 800B corresponding to the ambient HOA coefficient 47' having an index of 2.

The audio decoding device 24 may invoke the state machine 402 to update the state information 812 for channel 800C. The state machine 402 may update the internal state elements WasFadedIn[2] and TransitionMode[2] for channel 800C to be zero and two, respectively. Based on the updated state information 812, the audio decoding device 24 may determine that the ambient HOA coefficient 47' having an index of 2 is faded-out during frame 12. The audio decoding device 24 may further determine that the reduced vector $\mathbf{55}_k$" for frame 12 includes an additional element corresponding to the ambient HOA coefficients 47' having an index of 2. The audio decoding device 24 may then increment the number of vector elements for the reduced vector $\mathbf{55}_k$" specified in the foreground channel 800B to reflect the additional vector element (which is denoted in the example of FIG. 8 as Vvec elements being equal to 24 at frame 12). The audio decoding device 24 may then obtain the reduced vector $\mathbf{55}_k$" specified via the foreground channel 800B based on the updated number of vector elements. The audio decoding device 24, after obtaining the reduced vector $\mathbf{55}_k$" may fade-in the additional V-vec element 2 (denoted as "V-vec[2]") during frame 12. In frame 13, the audio encoding device 20 indicates two transitions, one for signaling that HOA coefficient 4 is being transitioned or faded-out and another to indicate that HOA coefficient 5 is being transitioned or faded-in to channel 800C. While the channel does not actually change, for purposes of denoting the change in what the channel is specifying, the channel may be denoted as channel 800E after the transition.

In other words, the audio encoding device 20 and the audio decoding device 24 may maintain the state information on a per transport channel basis. As such, background channel 800A and foreground channel 800D are carried by the same one of the three transport channels, while background channels 800C and 800E are also carried by the same one of the three transport channels. In any event, the audio encoding device 20 may maintain transition state information for background channel 800E indicating that the ambient HOA coefficients 47' having an index of 5 and specified via background channel 800E is faded-in (e.g., WasFadedIn[5]=1) and that the transition mode is to fade-in (e.g., TransitionMode[5]=1). The audio encoding device 20 may also maintain transition state information for channel 800A indicating that ambient HOA coefficient having an index of 4 is no longer faded-in (e.g., WasFadedIn[4]=0) and that the transition mode is fade-out (e.g., TransitionMode[4]=2).

The audio decoding device 24 may again maintain state information 812 similar to that described above with respect to the audio encoding device 20 and, based on the updated state information, fade-out the ambient HOA coefficient 47' having an index of 4, while fading in the ambient HOA coefficient 47' having an index of 5. In other words, the audio decoding device 24 may obtain the Transition syntax element for channel 800A during frame 13 indicating that the ambient HOA coefficient 47' having an index 4 is in transition. The audio decoding device 24 may invoke the state machine 402 to process the Transition syntax element to update the WasFadedIn[4] and TransitionMode[4] syntax elements to indicate that the ambient HOA coefficient 47' having an index of 4 is no longer faded-in (e.g., WasFadedIn[4]=0) and that the transition mode is fade-out (e.g., TransitionMode[4]=2).

The audio decoding device 24 may also obtain the Transition syntax element for channel 800C during frame 13 indicating that the ambient HOA coefficient 47' having an index 5 is in transition. The audio decoding device 24 may invoke the state machine 402 to process the Transition syntax element to update the WasFadedIn[5] and TransitionMode[5] syntax elements to indicate that the ambient HOA coefficient 47' having an index of 4 is faded-in during frame 13 (e.g., WasFadedIn[5]=1) and that the transition mode is fade-in (e.g., TransitionMode[5]=1). The audio decoding device 24 may perform a fade-out operation with respect to the ambient HOA coefficient 47' having an index of 4 and a fade-in operation with respect to the ambient HOA coefficient 47' having an index of 5.

The audio decoding device 24 may however utilize a full V-vector (assuming again a fourth order representation) having 25 elements so that the Vvec[4] can be faded-in and the Vvec[5] can be faded-out. The audio encoding device 20 may therefore provide a V-vec in foreground channel 800B having 25 elements.

Given that there are three transport channels, two of which are undergoing a transition with the remaining one of the three transport channels being the foreground channel 800B, the audio decoding device 24 may determine that the reduced vector $\mathbf{55}_k$" may, in the example situation, include all 24 of the vector elements. As a result, the audio decoding device 24 may obtain the reduced vector $\mathbf{55}_k$" from the bitstream 21 having all 25 vector elements. The audio decoding device 24 may then fade-in during frame 13 the vector element of the reduced vector $\mathbf{55}_k$" associated with the ambient HOA coefficient 47' having an index of 4 to compensate for the energy loss. The audio decoding device 24 may then fade-out during frame 13 the vector element of the reduced vector $55_k''$ associated with the ambient HOA coefficient 47' having an index of 5 to compensate for the energy gain.

At frame 14, the audio encoding device 20 may provide another V-vector that replaces background channel 800A in the transport channel, which may be specified in foreground channel 800D. Given that there are no transitions of ambient HOA coefficients, the audio encoding device 20 may specify the V-vectors in the foreground channel 800D and 800B with 24 elements, given that the element corresponding to the ambient HOA coefficient 47' having an index of 5 need not be sent (as a result of sending the ambient HOA coefficient 47' having an index of 5 in background channel 800E). The frame 14 may, in this respect, be denoted a subsequent frame to frame 13. In the frame 14, the ambient HOA coefficient 47' is specified in background channel 800E and is not in transition. As a result, the audio encoding device 20 may remove the V-vector element corresponding to the ambient HOA coefficients 47' specified in the background channel 800E from the reduced vector $55_k''$ specified in the foreground channel 800B, thereby generating an updated reduced V-vector (having 24 elements instead of the 25 elements in the previous frame).

The audio decoding device 24 may, during frame 14, invoke the state machine 402 to update the state information 812 to indicate that the ambient HOA coefficient 47' having an index of 5 and specified via the background channel 800E is not in transition ("TransitionMode[5]=0") and was previously faded-in ("WasFadedIn[5]=1"). As a result, the audio decoding device 24 may determine that the reduced vectors $55_k''$ specified in the foreground channel 800D and 800B have 24 vector elements (as the vector element associated with the ambient HOA coefficient 47' having an index of 5 is not specified). The audio decoding device 24 may however fade-in all of the vector elements of the reduced vector $55_k''$ specified in the foreground channel 800D during frame 14 as the elements were not previously specified in the bitstream in the preceding frame.

At frame 15, the audio encoding device 20 and the audio decoding device 24 maintain the same state as at frame 14 given, again, that no transitions have occurred.

In this respect, the techniques may enable the audio encoding device 20 to be configured to determine when an ambient higher-order ambisonic coefficient 47' (as specified for example in background channel 800C) is in transition during a frame of a bitstream 21 (as first shown in FIGS. 3 and 4 and later elaborated upon in FIG. 8) representative of the encoded audio data (which may refer to any combination of the ambient HOA coefficients, the foreground audio objects and corresponding V-vectors), the ambient higher-order ambisonic coefficient representative 47', at least in part, of an ambient component of a sound field. The audio encoding device 20 may also be configured to identify an element of a vector (such as one of the remaining foreground V[k] vectors 53) that is associated with the ambient higher-order ambisonic coefficient 47' in transition. The vector 53 may be representative, at least in part, of a spatial component of the sound field. The audio encoding device 20 may further be configured to generate, based on the vector 53, a reduced vector 55 to include the identified element of the vector for the frame. To illustrate, consider the foreground channel 800B at frame 12, where the audio encoding device 20 generates the reduced vector 55 to include the V-vector element corresponding to the ambient HOA coefficient 2 specified in the background channel 800C at frame 12, which is denoted as Vvec[2] in the example of FIG. 8. The audio encoding device 20 may also be configured to produce the bitstream 21 to include a bit indicative of the reduced vector and a bit (e.g., an indication 757 as depicted in FIG. 4) indicative of the transition of the ambient higher-order ambisonic coefficient 47' during the frame.

In these and other instances, the audio encoding device 20 may be configured to maintain transition state information based on the ambient higher-order ambisonic coefficient in transition. For example, the audio encoding device 20 may include the state machine 402 shown in the example of FIG. 7I that maintains the transition state information and any other state information 812. The audio encoding device 20 may further be configured to obtain the indication 757 of the transition based on the transition state information.

In these and other instances, the transition state information indicates one of a no transition state, a fade-in state and a fade-out state.

In these and other instances, the audio encoding device 20 may be configured to produce the bitstream 21 to additionally include a bit indicative of the state information 812 that includes the transition state information in the frame. The bit indicative of the state information 812 may enable the frame to be decoded without reference to previous frames of the bitstream 21.

In these and other instances, the state information 812 includes quantization information.

In these and other instances, the frame is output via a streaming protocol.

In these and other instances, the bit 757 indicative of the transition specifies whether the higher-order ambisonic coefficient is to be faded-out by a decoder, such as the audio decoding device 24, during the frame.

In these and other instances, the bit indicative of the transition specifies whether the higher-order ambisonic coefficient is to be faded-in by a decoder, such as the audio decoding device 24, during the frame.

In these and other instances, the audio encoding device 20 may be configured to update the reduced vector 55 by removing a second element of the vector 53 associated with the ambient higher-order ambisonic coefficient 47' not being in transition during a subsequent frame. To illustrate, consider frame 14 where the audio encoding device 20 updates the reduced vector 55 of the frame 13 to remove the element of the reduced vector 55 of the frame 13 associated with the ambient HOA coefficient having an index of five (where the element is denoted as "Vvec[5]"). The audio encoding device 20 may further be configured to produce the bitstream 21 to include, during the subsequent frame 14, a bit indicative of the updated reduced vector and a bit indicating that the ambient higher-order ambisonic coefficient 47' having an index of 5 is not in transition.

In these and other instances, the audio encoding device 20 may be configured to perform the independent aspects of the techniques described in more detail above in conjunction with the transition aspects of the techniques described above.

Moreover, the transition aspects of the techniques may enable the audio decoding device 24 to be configured to obtain, from a frame (e.g., frames 10-15 in FIG. 8) of a bitstream 21 representative of the encoded audio data, a bit indicative of a reduced vector. The encoded audio data may include an encoded version of the HOA coefficients 11 or a derivation thereof, meaning as one example the encoded ambient HOA coefficients 59, the encoded nFG signals 61, the coded foreground V[k] vectors 57 and any accompanying syntax elements or bits indicative of each of the foregoing thereof. The reduced vector may represent, at least in part, a spatial component of a sound field. The reduced vector may refer to one of the reduced foreground V[k] vectors $55_k$" described above with respect to the example of FIG. 4. The audio decoding device 24 may further be configured to obtain, from the frame, a bit 757 (shown in FIG. 4 and represented in the example of FIG. 8 as the "Transition" flag) indicative of a transition of an ambient higher-order ambisonic coefficient 47' (as specified, for example, in channel 800C). The ambient higher-order ambisonic coefficient 47' may represent, at least in part, an ambient component of a sound field. The reduced vector may include a vector element associated with the ambient higher-order ambisonic coefficient in transition, such as in the example of frame 13 where the foreground channel 800B includes the V-vector element 5 associated with the background channel 800E. The reduced vector may refer to one of the reduced foreground V[k] vectors $55_k$" and as such may be denoted as reduced vector $55_k$".

In these and other instances, the audio decoding device 24 may further be configured to obtain the bit indicative of the reduced vector $55_k$" in accordance with the above described Mode 2 of a plurality of modes (e.g., Mode 0, Mode 1 and Mode 2). Mode 2 may indicate that the reduced vector includes the vector element associated with the ambient higher-order ambisonic coefficient in transition.

In these and other instances, the plurality of modes further includes the above described Mode 1. Mode 1 may, as described above, indicate that the vector element associated with the ambient higher-order ambisonic coefficient is not included in the reduced vector.

In these and other instances, the audio decoding device 24 may further be configured to maintain transition state information based on the bit 757 indicative of the transition of the ambient higher-order ambisonic coefficient. The bitstream extraction unit 72 of the audio decoding device 24 may include the state machine 402 to maintain state information 812 that includes the transition state information. The audio decoding device 24 may also be configured to determine whether to perform a fade-in operation or a fade-out operation with respect to the ambient higher-order ambisonic coefficient 47' of channel 800C based on the transition state information. The audio decoding device 24 may be configured to invoke fade unit 770 to perform the fade-in operation or the fade-out operation, with respect to the ambient higher-order ambisonic coefficient 47', based on the determination of whether to fade-in or fade-out the ambient higher-order ambisonic coefficient.

In these and other instances, the transition state information indicates one of a no transition state, a fade-in state and a fade-out state.

In these and other instances, the audio decoding device 24 may further be configured to obtain the transition state information from a bit indicative of state information 812. The state information 812 may enable the frame to be decoded without reference to previous frames of the bitstream.

In these and other instances, the audio decoding device 24 may further be configured to dequantize the reduced vector $55_k$" based on quantization information included in the bit indicative of the state information 812.

In these and other instances, the frame is output via a streaming protocol.

In these and other instances, the indication 757 of the transition specifies whether the higher-order ambisonic coefficient 47' is faded-out during the frame.

In these and other instances, the indication 757 of the transition specifies whether the higher-order ambisonic coefficient is faded-in during the frame.

In these and other instances, the audio decoding device 24 may further be configured to obtain, during a subsequent frame (e.g., frame 14) of the bitstream 21, a bit indicative of a second reduced vector (which may refer to the same vector as that specified for frame 13 in the foreground channel 800C only updated to reflect the change in elements from the frame 13 to the frame 14 and hence may be referred to as an updated reduced vector), a bit indicative of the ambient higher-order ambisonic coefficient 47' specified in the background channel 800E at frame 14, and a bit 757 indicating 757 that the ambient higher-order ambisonic coefficient 47' is not in transition. In this instance, the second reduced vector for the subsequent frame 14 does not include an element associated with the ambient higher-order ambisonic coefficient 47' for the reasons noted above.

In these and other instances, the indication 757 of the transition indicates that the ambient higher-order ambisonic coefficient 47' is to be faded-out (such as ambient HOA coefficient 2 of the background channel 800C in frame 12). In this instance, the audio decoding device 24 may be configured to perform a fade-out operation with respect to the ambient higher-order ambisonic coefficient 47' during the frame 12. The audio decoding device 24 may be configured to perform the complimentary operation with respect to the corresponding element of the reduced vector $55_k$" specified in the foreground channel 800B at frame 12. In other words, the audio decoding device 24 may be configured to perform a fade-in operation with respect to the vector element during the frame 12 to compensate for energy change occurring as a result of the fade-out of the ambient higher-order ambisonic coefficient 47'.

In these and other instances, the indication 757 of the transition indicates that the ambient higher-order ambisonic coefficient 47' is to be faded-out (such as ambient HOA coefficient 4 of the background channel 800A in frame 13). In this instance, the audio decoding device 24 may be configured to perform a fade-out operation with respect to the ambient higher-order ambisonic coefficient 47' during the frame 12. The audio decoding device 24 may be configured to perform the complimentary operation with respect to the corresponding element of the reduced vector $55_k$" specified in the foreground channel 800B at frame 13. In other words, the audio decoding device 24 may be configured to perform a fade-in operation with respect to the vector element (Vvec[4]) during the frame 13 to compensate for energy changing occurring as a result of the fade-out of the ambient higher-order ambisonic coefficient 47'.

In these and other instances, the indication 757 of the transition indicates that the ambient higher-order ambisonic coefficient 47' is to be faded-in (such as ambient HOA coefficient 5 specified in the background channel 800E at frame 13). In this instance, the audio decoding device 24 may be configured to perform a fade-in operation with respect to the ambient higher-order ambisonic coefficient 47' during the frame 13. The audio decoding device 24 may be configured to perform the complimentary operation with respect to the corresponding element of the reduced vector $55_k$" specified in the foreground channel 800B at frame 13. In other words, the audio decoding device 24 may be configured to perform a fade-out operation with respect to the vector element during the frame 13 to compensate for energy change occurring as a result of the fade-in of the ambient higher-order ambisonic coefficient 47'.

In these and other instances, the audio decoding device 24 may, similar to the audio encoding device 20, be configured to perform the independent aspects of the techniques described in more detail above in conjunction with the transition aspects of the techniques described above.

Figure 9:
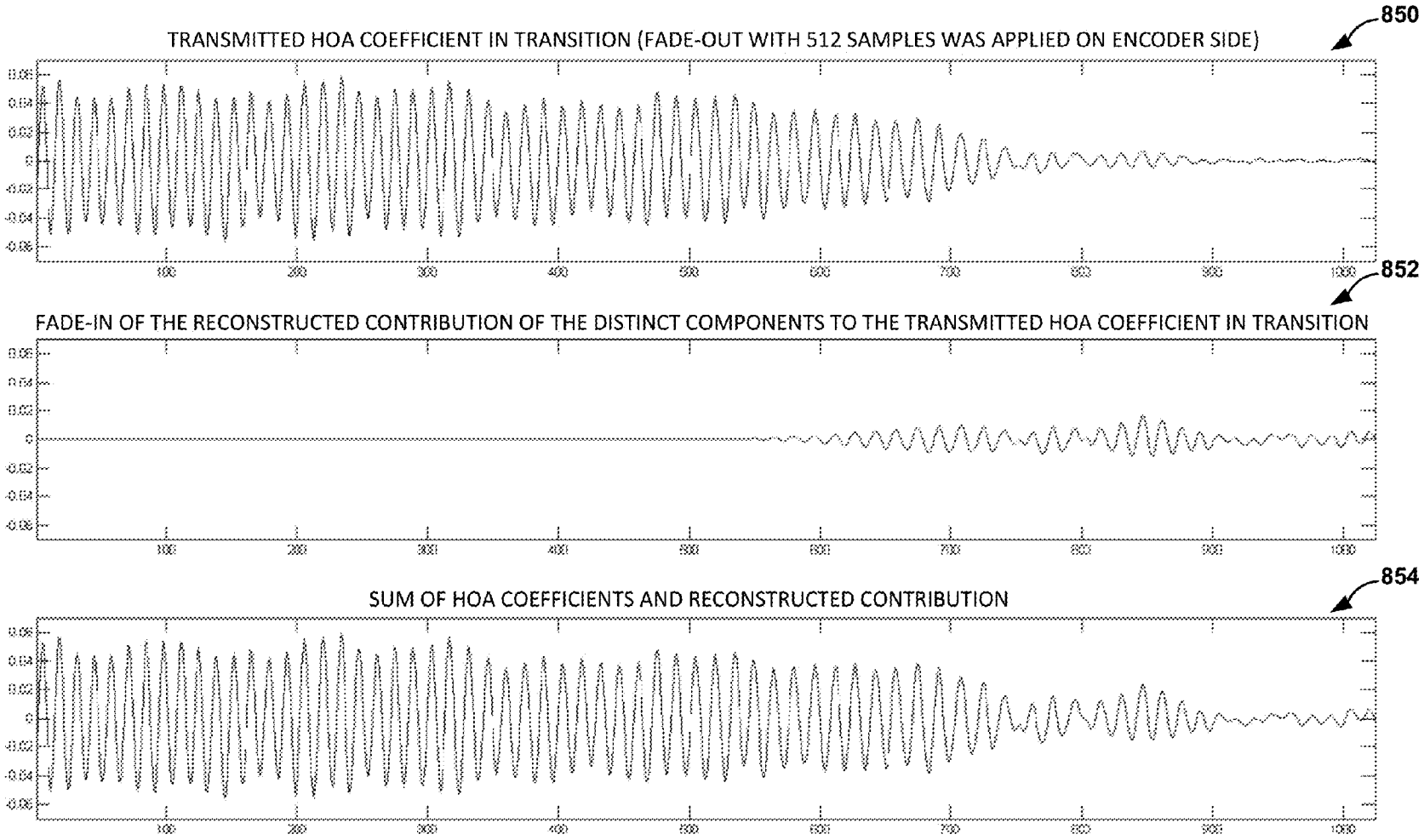
FIG. 9 is a diagram illustrating fade-out of an additional ambient HOA coefficient, fade-in of a corresponding reconstructed contribution of the distinct components, and a sum of the HOA coefficients and the reconstructed contribution.

FIG. 9 is a diagram illustrating fade-out of an additional ambient HOA coefficient, fade-in of a corresponding reconstructed contribution of the distinct components, and a sum of the HOA coefficients and the reconstructed contribution. Three graphs 850, 852 and 854 are shown in the example of FIG. 9. The graph 850 illustrates an additional ambient HOA coefficient being faded-out over 512 samples. The graph 852 shows the reconstructed audio object (having been reconstructed using a faded-in coefficients for the V-vector as described above). The graph 854 shows the sum of the HOA coefficients and the reconstructed contribution, where no artifacts are introduced in this example (where the artifacts might refer to "holes" in the sound field due to a loss of energy).

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 3.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 3.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

The invention claimed is:

1. A method of decoding, by an audio decoding device, a bitstream of encoded audio data, the method comprising:

obtaining, by the audio decoding device and from a frame of the bitstream, a bit indicative of a reduced vector, the reduced vector representative, at least in part, of a spatial component of a sound field;

obtaining, from the frame, a bit indicative of a transition of an ambient higher-order ambisonic coefficient, the ambient higher-order ambisonic coefficient representative, at least in part, of an ambient component of the sound field, wherein the reduced vector includes a vector element associated with the ambient higher-order ambisonic coefficient in transition;

performing a fade-out operation with respect to the ambient higher-order ambisonic coefficient during the frame; and performing a fade-in operation with respect to the vector element during the frame to compensate for energy change occurring as a result of the fade-out of the ambient higher-order ambisonic coefficient.

2. The method of claim 1, wherein obtaining the bit indicative of the reduced vector comprises obtaining a bit indicative of the reduced vector in accordance with a first mode of a plurality of modes, the first mode indicating that the reduced vector includes the vector element associated with the ambient higher-order ambisonic coefficient in transition.

3. The method of claim 2, wherein the plurality of modes further includes a second mode indicating that the vector element associated with the ambient higher-order ambisonic coefficient is not included in the reduced vector.

4. The method of claim 1, further comprising:

maintaining transition state information based on the bit indicative of the transition of the ambient higher-order ambisonic coefficient; and determining that the fade-out operation is to be performed with respect to the ambient higher-order ambisonic coefficient based on the transition state information.

5. The method of claim 4, wherein the transition state information indicates one of a no transition state, a fade-in state or a fade-out state.

6. The method of claim 4, further comprising obtaining the transition state information from a bit indicative of state information, the bit indicative of the state information enabling the bitstream of the encoded audio data of the frame to be decoded without reference to previous frames of the bitstream.

7. The method of claim 6, further comprising dequantizing the reduced vector based on quantization information included in the bit indicative of the state information.

8. The method of claim 6, further comprising decoding the frame to switch from a first representation of content to a second representation of the content, wherein the second representation is different than the first representation.

9. The method of claim 1, wherein the bit indicative of the transition indicates whether the ambient higher-order ambisonic coefficient is faded-out during the frame.

10. The method of claim 1, wherein the indication of the transition indicates whether the ambient higher-order ambisonic coefficient is faded-in during the frame.

11. The method of claim 1, further comprising:

obtaining, during a subsequent frame, a bit indicative of a second reduced vector, a bit indicative of the ambient higher-order ambisonic coefficient, and a bit indicating that the ambient higher-order ambisonic coefficient is not in transition, wherein the second reduced vector for the subsequent frame does not include an element associated with the ambient higher-order ambisonic coefficient for the subsequent frame.

12. The method of claim 1, further comprising:

rendering, based on the reduced vector, one or more speaker feeds; and outputting the one or more speaker feeds to one or more speakers.

13. The method of claim 1, wherein performing the fade-in operation comprises performing the fade-in operation with respect to the vector element during the frame to compensate for energy change occurring as a result of the fade-out of the ambient higher-order ambisonic coefficient.

14. An audio decoding device configured to decode a bitstream of encoded audio data, the audio decoding device comprising:

a memory configured to store a frame of the bitstream of encoded audio data; and one or more processors coupled to the memory, and configured to:

obtain, from the frame, a bit indicative of a reduced vector, the reduced vector representative, at least in part, of a spatial component of a sound field;

obtain, from the frame, an indication of a transition of an ambient higher-order ambisonic coefficient, the ambient high-order ambisonic coefficient representative, at least in part, of an ambient component of the sound field, wherein the reduced vector includes a vector element associated with the ambient higher-order ambisonic coefficient in transition;

perform a fade-out operation with respect to the ambient higher-order ambisonic coefficient during the frame; and perform a fade-in operation with respect to the vector element during the frame to compensate for energy change occurring as a result of the fade-out of the ambient higher-order ambisonic coefficient.

15. The audio decoding device of claim 14, wherein the one or more processors are configured to obtain the bit indicative of the reduced vector in accordance with a first mode of a plurality of modes, the first mode indicating that the reduced vector includes the vector element associated with the ambient higher-order ambisonic coefficient in transition.

16. The audio decoding device of claim 15, wherein the plurality of modes further includes a second mode indicating that the vector element associated with the ambient higher-order ambisonic coefficient is not included in the reduced vector.

17. The audio decoding device of claim 14, wherein the one or more processors are further configured to:

maintain transition state information based on the bit indicative of the transition of the ambient higher-order ambisonic coefficient;

determine that the fade-out operation is to be performed with respect to the ambient higher-order ambisonic coefficient based on the transition state information.

18. The audio decoding device of claim 17, wherein the transition state information indicates one of a no transition state, a fade-in state and a fade-out state.

19. The audio decoding device of claim 17, wherein the one or more processors are further configured to obtain the transition state information from a bit indicative of state information, the bit indicative of state information enabling the bitstream of the encoded audio data of the frame to be decoded without reference to previous frames of the bitstream.

20. The audio decoding device of claim 19, wherein the one or more processors are further configured to dequantize the reduced vector based on quantization information included in the bit indicative of the state information.

21. The audio decoding device of claim 19, wherein the one or more processors are further configured to decode the frame to switch from a first representation of content to a second representation of the content, wherein the second representation is different than the first representation.

22. The audio decoding device of claim 14, wherein the bit indicative of the transition indicates whether the ambient higher-order ambisonic coefficient is faded-out during the frame.

23. The audio decoding device of claim 14, wherein the bit indicative of the transition indicates whether the ambient higher-order ambisonic coefficient is faded-in during the frame.

24. The audio decoding device of claim 14, wherein the one or more processors are further configured to obtain, during a subsequent frame, a bit indicative of a second reduced vector, a bit indicative of the ambient higher-order ambisonic coefficient, and a bit indicating that the ambient higher-order ambisonic coefficient is not in transition, wherein the second reduced vector for the subsequent frame does not include an element associated with the ambient higher-order ambisonic coefficient for the subsequent frame.

25. The audio decoding device of claim 14, wherein the one or more processors are further configured to:

render, based on the reduced vector, one or more speaker feeds; and output the one or more speaker feeds to one or more speakers.

26. The audio decoding device of claim 14, the one or more processors configured to perform the fade-in operation with respect to the vector element during the frame to compensate for energy change occurring as a result of the fade-out of the ambient higher-order ambisonic coefficient.

27. An audio decoding device configured to decode a bitstream of encoded audio data, the audio decoding device comprises:

means for storing a frame of the bitstream;

means for obtaining, from the frame, a bit indicative of a reduced vector, the reduced vector representative, at least in part, of a spatial component of a sound field;

means for obtaining, from the frame, a bit indicative of a transition of an ambient higher-order ambisonic coefficient, the ambient higher-order ambisonic coefficient representative, at least in part, of an ambient component of the sound field, wherein the reduced vector includes a vector element associated with the ambient higher-order ambisonic coefficient in transition;

means for performing a fade-out operation with respect to the ambient higher-order ambisonic coefficient during the frame; and means for performing a fade-in operation with respect to the vector element during the frame to compensate for energy change occurring as a result of the fade-out of the ambient higher-order ambisonic coefficient.

28. The audio decoding device of claim 27, wherein the means for obtaining the bit indicative of the reduced vector comprises means for obtaining the bit indicative of the reduced vector in accordance with a first mode of a plurality of modes, the first mode indicating that the reduced vector includes the vector element associated with the ambient higher-order ambisonic coefficient in transition.

29. The audio decoding device of claim 28, wherein the plurality of modes further includes a second mode indicating that the vector element associated with the ambient higher-order ambisonic coefficient is not included in the reduced vector.

30. The audio decoding device of claim 27, further comprising:

means for maintaining transition state information based on the bit indicative of the transition of the ambient higher-order ambisonic coefficient; and means for determining that the fade-out operation is to be performed with respect to the ambient higher-order ambisonic coefficient based on the transition state information.

31. The audio decoding device of claim 30, wherein the transition state information indicates one of a no transition state, a fade-in state and a fade-out state.

32. The audio decoding device of claim 30, further comprising means for obtaining the transition state information from a bit indicative of state information, the bit indicative of the state information enabling the bitstream of the encoded audio data of the frame to be decoded without reference to previous frames of the bitstream.

33. The audio decoding device of claim 32, further comprising means for dequantizing the reduced vector based on quantization information included in the bit indicative of the state information.

34. The audio decoding device of claim 32, further comprising means for decoding the frame to switch from a first representation of content to a second representation of the content, the second representation is different than the first representation.

35. The audio decoding device of claim 27, wherein the bit indicative of the transition indicates whether the ambient higher-order ambisonic coefficient is faded-out during the frame.

36. The audio decoding device of claim 27, wherein the bit indicative of the transition indicates whether the ambient higher-order ambisonic coefficient is faded-in during the frame.

37. The audio decoding device of claim 27, further comprising means for obtaining, during a subsequent frame, from the bitstream, a bit indicative of a second reduced vector, a bit indicative of the ambient higher-order ambisonic coefficient, and a bit indicating that the ambient higher-order ambisonic coefficient is not in transition, wherein the second reduced vector for the subsequent frame does not include an element associated with the ambient higher-order ambisonic coefficient for the subsequent frame.

38. The audio decoding device of claim 27, further comprising:

means for rendering, based on the reduced vector, one or more speaker feeds; and means for outputting the one or more speaker feeds to one or more speakers.

39. The audio decoding device of claim 27, wherein the means for performing the fade-in operation comprises means for performing the fade-in operation with respect to the vector element during the frame to compensate for energy change occurring as a result of the fade-out of the ambient higher-order ambisonic coefficient.

40. A non-transitory computer-readable storage medium having stored thereon instructions that when executed cause one or more processors of an audio decoding device to:

obtain, from a frame of a bitstream of encoded audio data, a bit indicative of a reduced vector, the reduced vector representative, at least in part, of a spatial component of a sound field;

obtain, from the frame, a bit indicative of a transition of an ambient higher-order ambisonic coefficient, the ambient higher-order ambisonic coefficients representative, at least in part, of an ambient component of the sound field, wherein the reduced vector includes a vector element associated with the ambient higher-order ambisonic coefficient in transition;

perform a fade-out operation with respect to the ambient higher-order ambisonic coefficient during the frame; and perform a fade-in operation with respect to the vector element during the frame to compensate for energy change occurring as a result of the fade-out of the ambient higher-order ambisonic coefficient.

41. The non-transitory computer-readable storage medium of claim 40 having further stored thereon instructions that when executed cause the one or more processors of the audio decoding device to:

render, based on the reduced vector, one or more speaker feeds; and output the one or more speaker feeds to one or more speakers.

42. The non-transitory computer-readable storage medium of claim 40, wherein the fade-in operation is performed with respect to the vector element during the frame to compensate for energy change resulting from the fade-out of the ambient higher-order ambisonic coefficient.

43. A method of decoding, by an audio decoding device, a bitstream of encoded audio data, the method comprising:

obtaining, by the audio decoding device and from a frame of the bitstream, a bit indicative of a reduced vector, the reduced vector representative, at least in part, of a spatial component of a sound obtaining, from the frame, a bit indicative of a transition of an ambient higher-order ambisonic coefficient, the ambient higher-order ambisonic coefficient representative, at least in part, of an ambient component of the sound field, wherein the reduced vector includes a vector element associated with the ambient higher-order ambisonic coefficient in transition;

performing a fade-in operation with respect to the ambient higher-order ambisonic coefficient during the frame; and performing a fade-out operation with respect to the vector element during the frame to compensate for energy change occurring as a result of the fade-in of the ambient higher-order ambisonic coefficient.

44. The method of claim 43, further comprising:

rendering, based on the reduced vector, one or more speaker feeds; and outputting the one or more speaker feeds to one or more speakers.

45. The method of claim 43, wherein performing the fade-out operation comprises performing the fade-out operation with respect to the vector element during the frame to compensate for the fade-in of the ambient higher-order ambisonic coefficient.

46. An audio decoding device configured to decode a bitstream of encoded audio data, the audio decoding device comprising:

a memory configured to store a frame of the bitstream of encoded audio data; and one or more processors coupled to the memory, and configured to:

obtain, from the frame, a bit indicative of a reduced vector, the reduced vector representative, at least in part, of a spatial component of a sound field;

obtain, from the frame, an indication of a transition of an ambient higher-order ambisonic coefficient, the ambient high-order ambisonic coefficient representative, at least in part, of an ambient component of the sound field, wherein the reduced vector includes a vector element associated with the ambient higher-order ambisonic coefficient in transition;

perform a fade-in operation with respect to the ambient higher-order ambisonic coefficient during the frame; and perform a fade-out operation with respect to the vector element during the frame to compensate for energy change occurring as a result of the fade-in of the ambient higher-order ambisonic coefficient.

47. The audio decoding device of claim 46, wherein the one or more processors are further configured to:

render, based on the reduced vector, one or more speaker feeds; and output the one or more speaker feeds to one or more speakers.

48. The audio decoding device of claim 46, the one or more processors configured to perform the fade-out operation with respect to the vector element during the frame to compensate for energy change occurring as a result of the fade-in of the ambient higher-order ambisonic coefficient.

49. An audio decoding device configured to decode a bitstream of encoded audio data, the audio decoding device comprises:

means for storing a frame of the bitstream;

means for obtaining, from the frame, a bit indicative of a reduced vector, the reduced vector representative, at least in part, of a spatial component of a sound field;

means for obtaining, from the frame, a bit indicative of a transition of an ambient higher-order ambisonic coefficient, the ambient higher-order ambisonic coefficient representative, at least in part, of an ambient component of the sound field, wherein the reduced vector includes a vector element associated with the ambient higher-order ambisonic coefficient in transition;

means for perform a fade-in operation with respect to the ambient higher-order ambisonic coefficient during the frame; and means for perform a fade-out operation with respect to the vector element during the frame to compensate for energy change occurring as a result of the fade-in of the ambient higher-order ambisonic coefficient.

50. The audio decoding device of claim 49, further comprising:

means for rendering, based on the reduced vector, one or more speaker feeds; and means for outputting the one or more speaker feeds to one or more speakers.

51. The audio decoding device of claim 49, wherein the means for performing the fade-out operation comprises means for performing the fade-out operation with respect to the vector element during the frame to compensate for energy change occurring as a result of the fade-in of the ambient higher-order ambisonic coefficient.

52. A non-transitory computer-readable storage medium having stored thereon instructions that when executed cause one or more processors of an audio decoding device to:

obtain, from a frame of a bitstream of encoded audio data, a bit indicative of a reduced vector, the reduced vector representative, at least in part, of a spatial component of a sound field;

obtain, from the frame, a bit indicative of a transition of an ambient higher-order ambisonic coefficient, the ambient higher-order ambisonic coefficients representative, at least in part, of an ambient component of the sound field, wherein the reduced vector includes a vector element associated with the ambient higher-order ambisonic coefficient in transition;

perform a fade-in operation with respect to the ambient higher-order ambisonic coefficient during the frame; and perform a fade-out operation with respect to the vector element during the frame to compensate for energy change occurring as a result of the fade-in of the ambient higher-order ambisonic coefficient.

53. The non-transitory computer-readable storage medium of claim 52 having further stored thereon instructions that when executed cause the one or more processors of the audio decoding device to:

render, based on the reduced vector, one or more speaker feeds; and output the one or more speaker feeds to one or more speakers.

54. The non-transitory computer-readable storage medium of claim 52, wherein the fade-out operation is performed with respect to the vector element during the frame to compensate for energy change resulting from the fade-in of the ambient higher-order ambisonic coefficient.

* * * * *